US011406241B2

(12) United States Patent
Pellegrino

(10) Patent No.: US 11,406,241 B2
(45) Date of Patent: Aug. 9, 2022

(54) TILE AND GROUT CLEANING PADS AND TOOLS

(71) Applicant: Leonard Pellegrino, San Diego, CA (US)

(72) Inventor: Leonard Pellegrino, San Diego, CA (US)

( * ) Notice: Subject to any disclaimer, the term of this patent is extended or adjusted under 35 U.S.C. 154(b) by 288 days.

(21) Appl. No.: 16/580,352

(22) Filed: Sep. 24, 2019

(65) Prior Publication Data

US 2020/0085272 A1 Mar. 19, 2020

Related U.S. Application Data

(63) Continuation of application No. 15/476,859, filed on Mar. 31, 2017, now Pat. No. 10,506,906, and a continuation-in-part of application No. 13/349,945, filed on Jan. 13, 2012, now Pat. No. 10,595,625.

(60) Provisional application No. 62/318,009, filed on Apr. 4, 2016.

(51) Int. Cl.

| | |
|---|---|
| ***A47L 13/12*** | (2006.01) |
| ***A47L 13/16*** | (2006.01) |
| ***A47L 13/44*** | (2006.01) |
| ***A46B 5/00*** | (2006.01) |
| ***A46B 7/04*** | (2006.01) |
| ***A47L 13/256*** | (2006.01) |
| ***A47L 13/46*** | (2006.01) |

(52) U.S. Cl.

CPC ..... *A47L 13/12* (2013.01); *A46B 5/0095* (2013.01); *A46B 7/042* (2013.01); *A47L 13/16* (2013.01); *A47L 13/256* (2013.01); *A47L 13/44* (2013.01); *A46B 7/044* (2013.01); *A46B 2200/3033* (2013.01); *A47L 13/46* (2013.01)

(58) Field of Classification Search

CPC ..... A46L 13/12; A46L 13/16; A46L 13/44; A46L 13/46; A46L 13/254; A46L 13/256; A46B 7/04; A46B 7/042; A46B 7/044

See application file for complete search history.

(56) References Cited

U.S. PATENT DOCUMENTS

| | | | | |
|---|---|---|---|---|
| D274,098 | S | 5/1984 | Kaufman | |
| 4,852,210 | A * | 8/1989 | Krajicek | A47L 13/20 15/228 |
| 5,522,110 | A | 6/1996 | Borofsky | |
| D401,099 | S | 11/1998 | Pawson et al. | |
| D417,117 | S | 11/1999 | Gerk | |
| D474,031 | S | 5/2003 | Wassil et al. | |

(Continued)

*Primary Examiner* — Laura C Guidotti

(74) *Attorney, Agent, or Firm* — Gary L. Eastman, Esq.; Eastman IP

(57) ABSTRACT

A disposable cleaning pad having a grout cleaning brush includes a bristle attachment for use with a disposable pad. The bristle attachment is molded into a rectangular base piece forming a stand-alone removable brush that can be removably attached to a disposable pad. A top rectangular piece of similar dimensions to the base is connected to the end portion of the base by way of a hinge. The ends opposite the hinge have mating clasps that allow for the brush assembly to be securely yet removably fastened to an existing cleaning pad which is then mounted in the normal manner to the cleaning system. The brush assembly enjoys a longer life than that expected from a disposable cleaning pad thus the brush assembly may be reused many times before it needs to be replaced.

5 Claims, 48 Drawing Sheets

(56) References Cited

U.S. PATENT DOCUMENTS

| | | | | |
|---|---|---|---|---|
| 6,842,936 | B2 | 1/2005 | Policicchi et al. | |
| 6,871,372 | B2 * | 3/2005 | Vosbikian | A47L 13/12 15/115 |
| D523,274 | S | 6/2006 | Miyoshi | |
| D549,030 | S | 8/2007 | Kessler et al. | |
| D551,408 | S | 9/2007 | Pung et al. | |
| 7,591,040 | B2 * | 9/2009 | Jou-Chen | A47L 13/12 15/115 |
| D608,127 | S | 1/2010 | Venugopal | |
| D623,882 | S | 9/2010 | Oster | |
| D642,759 | S | 8/2011 | Otsuka et al. | |
| D666,860 | S | 9/2012 | Lubart | |
| D674,566 | S | 1/2013 | Colangelo | |
| 10,781,078 | B2 * | 9/2020 | Reese | A47L 13/06 |
| 2005/0011536 | A1 | 1/2005 | Hofte et al. | |
| 2007/0107155 | A1 | 5/2007 | Kacher et al. | |
| 2012/0042467 | A1 | 2/2012 | Mandhai et al. | |

* cited by examiner

TILE AND GROUT CLEANING PADS AND TOOLS

RELATED APPLICATIONS

This application is a continuation application of, and claims the benefit of priority to, U.S. patent application Ser. No. 15/476,859 entitled "Tile and Grout Cleaning Pads and Tools" filed on Mar. 31, 2017, which claims the benefit of priority to U.S. Provisional Patent Application Ser. No. 62/318,009 entitled "Tile Cleaning Pads and Tools" filed on Apr. 4, 2016. This application is also a continuation-in-part application of, and claims the benefit of priority to, U.S. patent application Ser. No. 13/349,945 entitled "Tile and Grout Cleaning Pad" filed on Jan. 13, 2012.

FIELD OF INVENTION

The present invention relates generally to an apparatus for simultaneously cleaning multiple leveled surfaces. More particularly, though not exclusively, the present invention relates to an apparatus for simultaneously cleaning tile and the lower leveled grout.

BACKGROUND OF THE INVENTION

The use of tile and stone floors is increasing, especially in upscale homes. The need to frequently clean the grout in between the tiles and stone is a well-known problem without any current satisfactory solution that allows for the grout to be cleaned simultaneously with the tile or stone. Without a satisfactory solution, the cleaning effort usually consists of a first process to clean the grout followed by a second process to clean the tile or stone.

The grout between tile and stone flooring is known for being difficult to clean. Some areas of grout become noticeably dirty over time due to the presence of foot traffic, food and drink spills, and pets, which can result in the accumulation of unsightly dirt and buildup. If dirt and buildup is allowed to remain on the grout for an extended period of time, the grout can become dull or stained. This effect can be compounded when unsightly areas of grout are in close proximity to areas of cleaner grout. This causes the unsightly grout to stand out even more.

Typical floor cleaning routines usually include sweeping, using a damp sponge mop, or using a cleaning agent in conjunction with a sponge mop or scrub brush. Several products have been introduced into the market that aid in the cleaning of tile, stone, or wood flooring. The more common ones consist of simple brushes connected to various handle configurations, custom made systems for specific tile designs, as well as hand held devices which are generally very labor intensive to use. These hand held devices require the user to maintain a kneeling position that becomes uncomfortable in a short period of time and results in undue stress on the users back, muscles, and joints.

In light of the above, there is currently a need for a low cost, easy to use brush and pad system to simultaneously clean extensive flooring areas where grout also needs cleaning. There is also a need for a device that is able to easily convert from a grout cleaning system to a floor cleaning system.

SUMMARY OF THE INVENTION

The present invention is a multiple leveled surface cleaning system including pads and tools. The brush and cleaning surface combination attached to the cleaning head allows the cleaning head to simultaneously clean multiple leveled surfaces. As the cleaning surface contacts and cleans a first surface, the brush extends to a depth deeper than the cleaning surface to reach the lower leveled surface, such as when cleaning tile and grout. While cleaning, the cleaning surface contacts and cleans the tiles and the brush extends to the lower depth of the grout to enable simultaneous cleaning. By being able to simultaneously clean the tile and grout, the work is cut in half. Additionally, grout is laid in between the tile at a lower depth and is difficult to clean. Typically, cleaning pads have a single flat surface which does not allow the cleaning of the grout between the tiles as it lies beneath the surface of the tiles.

In a preferred embodiment the multiple leveled surface cleaning system includes a cleaning head with attached handle, a removable brush and removable cleaning pad with a cleaning surface. The handle is attached to the cleaning head to allow articulation of the cleaning head relative to the handle. This allows the cleaning head to contact the floor as a user brushes the cleaning head against a surface to be cleaned. The articulation also allows the cleaning head to get into hard to reach places such as under tables, cabinets, and in various openings.

In the preferred embodiment, the removable brush and the removable cleaning pad are independently attached to the cleaning head. This allows the cleaning pad to be replaced without the need to replace the brush. The removable brush is designed for heavy duty scrubbing and thus has a longer life expectancy than the cleaning pad, and as a result the brush can be reused multiple times before replacement. Further, there may be different types of leveled surfaces which require different cleaning pads and cleaning brushes. The removability allows the removable brush and cleaning pad to be interchanged to meet all types of surfaces requirements. This allows the multiple leveled surface cleaning system to clean all types of multi-leveled surfaces.

In an alternative embodiment, the multiple leveled surface cleaning system includes a handle attachment with attached handle and a removable cleaning pad with brush. The handle is attached to the handle attachment to allow articulation of the cleaning head relative to the handle. The handle attachment is removably attached to cleaning pad with brush. The cleaning pad with brush has a rigid backing in which a brush is attached approximately in the middle of the rigid backing with a cleaning surface on either side of the brush. The rigid backing provides the structural support required to clean multi-leveled surfaces simultaneously as a user brushes the cleaning head back and forth against the surfaces.

In another alternative embodiment, a cleaning pad with brush takes advantage of currently existing floor cleaning systems, which are generally available in local grocery and hardware stores. Such systems available today are Clorox's ReadyMop system, Rubbermaid's Reveal system, and Procter & Gamble's Swiffer Sweeper. Some of these systems use a disposable pad that can be replaced when it becomes heavily soiled while others use reusable pads that need to be washed when they become soiled. In the alternative embodiment, the cleaning pad with brush includes a brush that is removably attached in a disposable cleaning pad. This design allows for the user to apply the cleaning pad and brush combination of the present invention to a floor cleaning system to clean the floor grout and tile, and then remove the remove the brush from the cleaning pad when to clean areas where the grout does not need brush level cleaning or other non-grout floor areas.

In another alternative embodiment of the present invention, an alternative cleaning brush is configured to attached with any currently existing floor cleaning systems with a disposable pad. The cleaning brush is molded into a rectangular base piece forming a stand-alone, removable brush that can be removably attached to any preexisting floor cleaning system having a disposable cleaning pad. The cleaning brush is placed over the disposable cleaning pad and provides the ability to clean a different leveled surface than the disposable cleaning pad. In another alternative embodiment, the cleaning brush is molded into a rectangular base piece forming a stand-alone, removable brush that can be removably attached directly to any disposable pad for use in preexisting floor cleaning systems.

Further, in another alternative embodiment, a tile and grout cleaning pad having a cleaning pad and integrated cleaning brush is made to be used with preexisting cleaning systems. The tile and grout cleaning pad attaches directly to existing cleaning systems.

The present invention is especially suited to undertake extensive grout and floor cleaning tasks. It has the capacity to allow the grout cleaning brush and pad to be used for extensive periods of time without having to rinse and clean it. It provides for the user to clean grout without having to kneel for extended periods of time. Also, it has the advantage of being able to easily convert from a grout and tile cleaner to a floor cleaner.

DETAILED DESCRIPTION OF THE INVENTION

Figure 1:
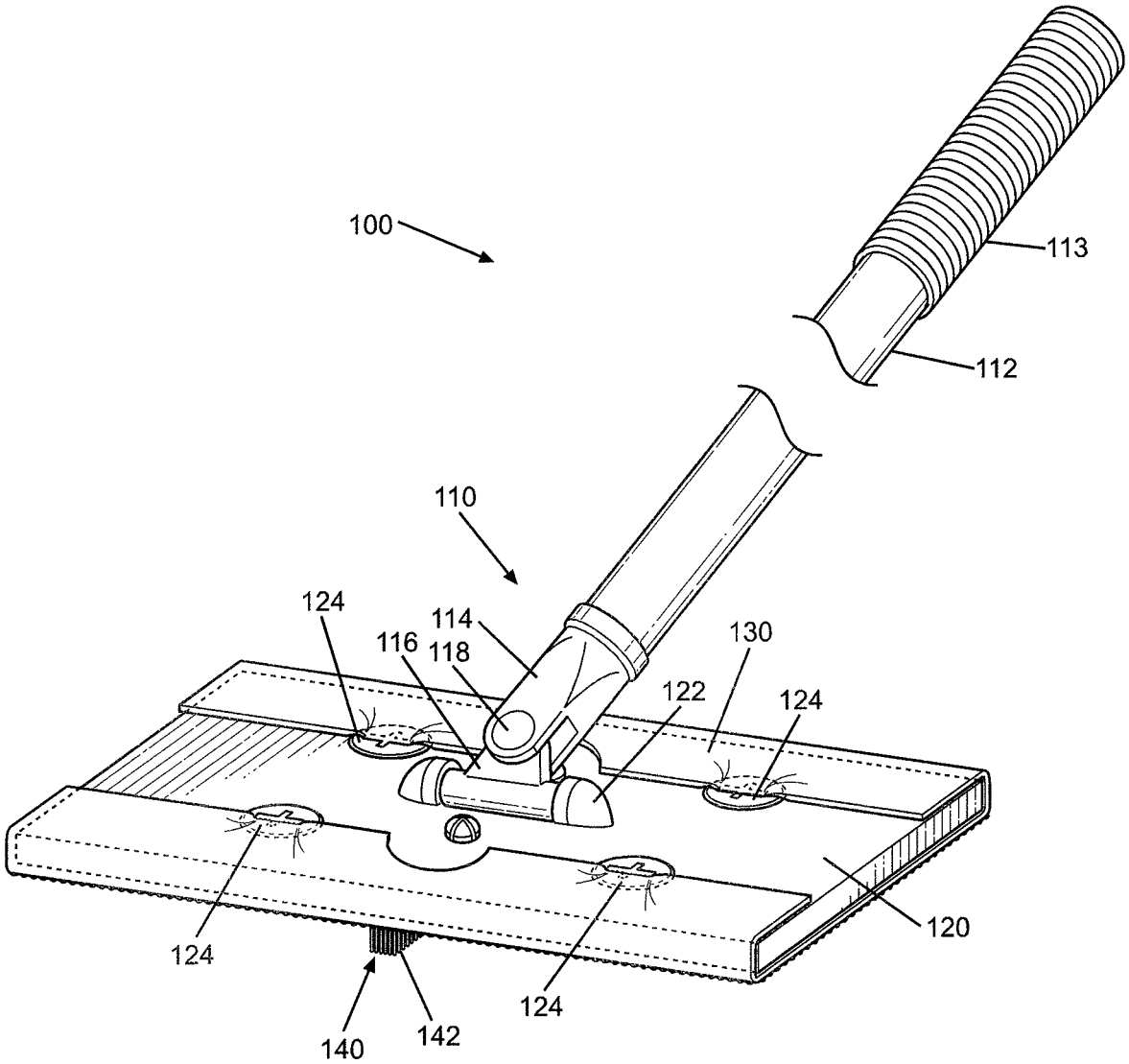
FIG. 1 is a perspective view of a preferred embodiment of the tile and grout cleaning system with removable brush and removable cleaning pad attached to a cleaning head with articulable handle.
Figure 2:
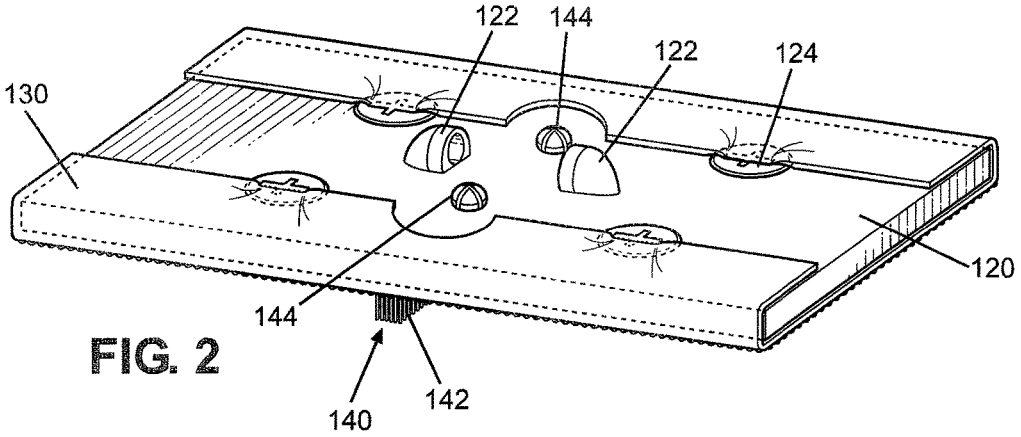
FIG. 2 is a perspective view of the cleaning head with handle removed, and having the removable brush and removable cleaning pad attached.
Figure 3:
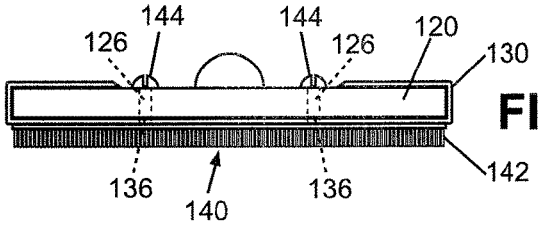
FIG. 3 is a side elevation view of the cleaning head with handle removed, and having the removable brush and removable cleaning pad attached.
Figure 4:
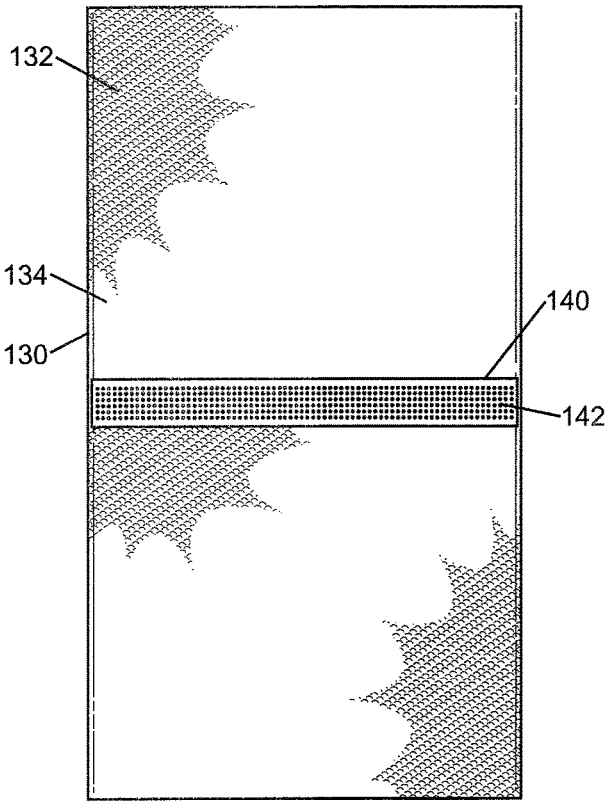
FIG. 4 is a bottom plan view of the cleaning head with handle removed, and having the removable brush and removable cleaning pad attached.
Figure 5:
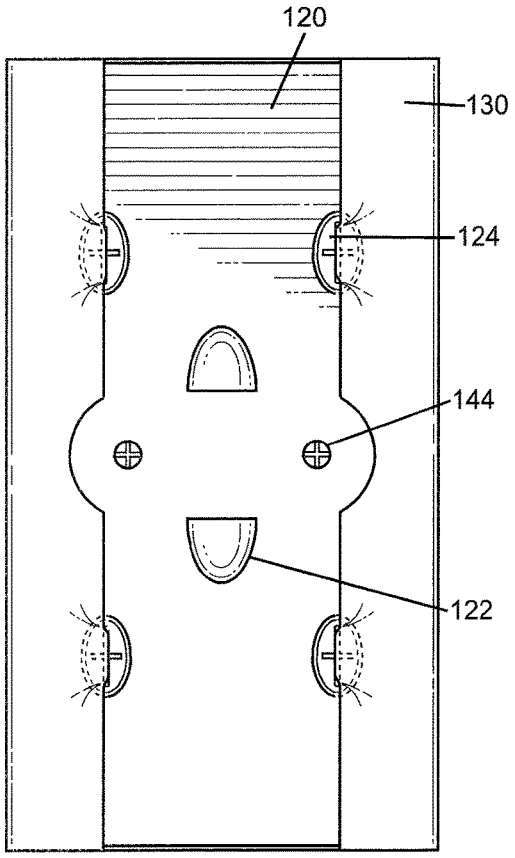
FIG. 5 is a top plan view of the cleaning head with handle removed, and having the removable brush and removable cleaning pad attached.
Figure 6:
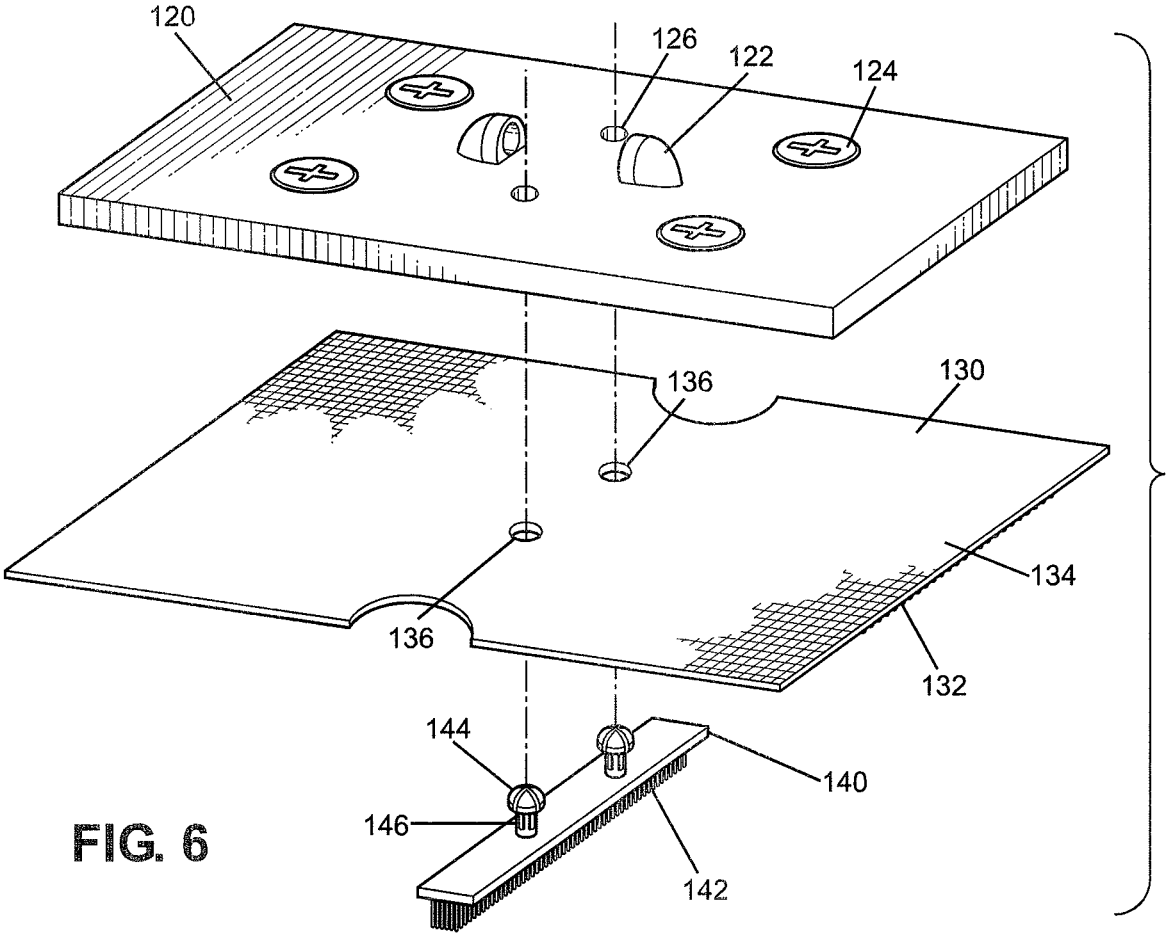
FIG. 6 is an exploded view of the cleaning head the removable brush and removable cleaning pad.

Referring initially to FIG. 1, in conjunction with FIGS. 2-6, a preferred embodiment of the tile and grout cleaning system 100 with removable brush 140 and removable cleaning pad 130 attached to a cleaning head 120 with articulable handle 110 is shown. The articulable handle 110 includes a shaft 112 with a joint coupling 114 attached at one end and a handle grip 113 attached at the opposite end. The joint coupling 114 is attached to another joint coupling 116 by a pin 118. The joint coupling 116 is further rotatably attached to the handle mounts 122 of the cleaning head 120. The joint couplings 114 and 116 allow the handle 110 to articulate relative to the cleaning head 120 in multiple directions.

The cleaning head 120 is generally rectangular shaped having six faces: a top, a bottom, a right, a left, a front, and a back. Formed onto the top face of the cleaning head 120 are handle mounts 122 and grippers 124. A plurality of grippers 124 are formed in the top face of the cleaning head 120 to provide a gripping surface for the cleaning pad 130. The cleaning pad 130 is forced into the grippers 124 and the grippers 124 hold the cleaning pads in place. Formed approximately in the middle of the cleaning head 120 are mounting holes 126, shown in dashed lines in FIG. 3, extending through the cleaning head 120 from the bottom to the top.

The cleaning pad 130 includes a backing 134 having a cleaning surface 132 configured to clean various types of surfaces. Cleaning surface 132 may be made of a soft material to clean delicate surfaces or made of harder materials to clean durable surfaces. Backing 134 provides structural support to the cleaning surface 132 to provide durability to the cleaning surface 132 as well as attachment points to attach to grippers 124 of the cleaning head 120. Located approximately at the midline of the cleaning pad 130 is a plurality of holes 136.

Figure 7:
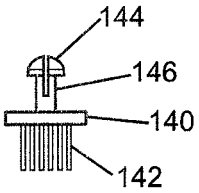
FIG. 7 is a front elevation view of the removable cleaning brush.
Figure 8:
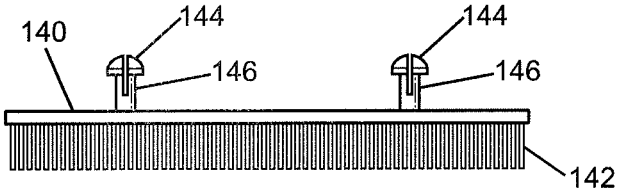
FIG. 8 is a side elevation view of the removable cleaning brush.
Figure 9:
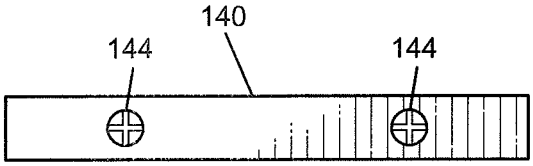
FIG. 9 is a top plan view of the removable cleaning brush.
Figure 10:
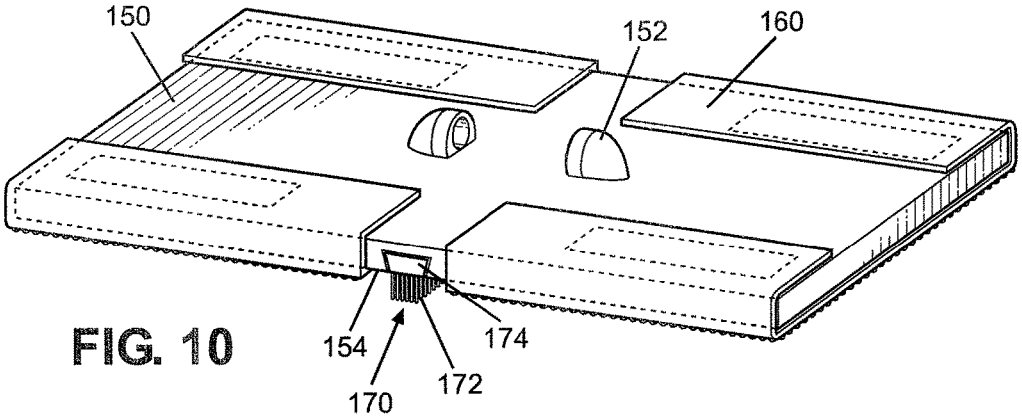
FIG. 10 is a perspective view of an alternative embodiment of the cleaning head having a removable brush and a removable pad attached.
Figure 11:
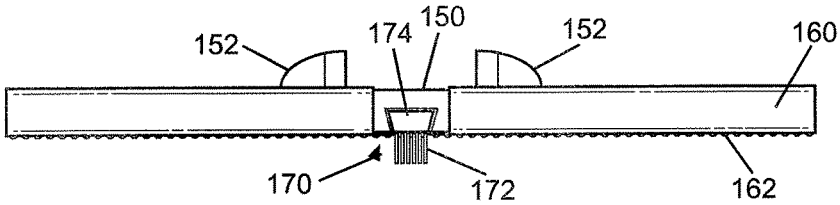
FIG. 11 is a front elevation view of the cleaning head having a removable brush and a removable pad attached.
Figure 12:
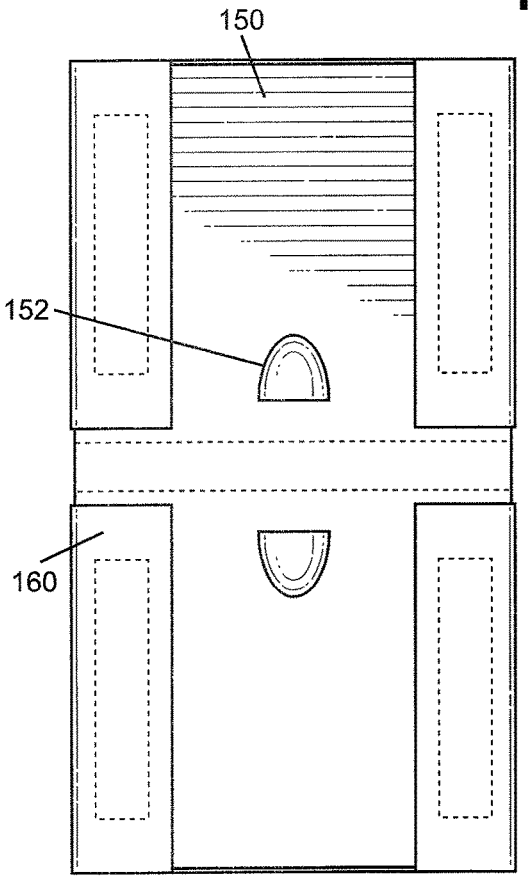
FIG. 12 is a top plan view cleaning head having a removable brush and a removable pad attached.
Figure 13:
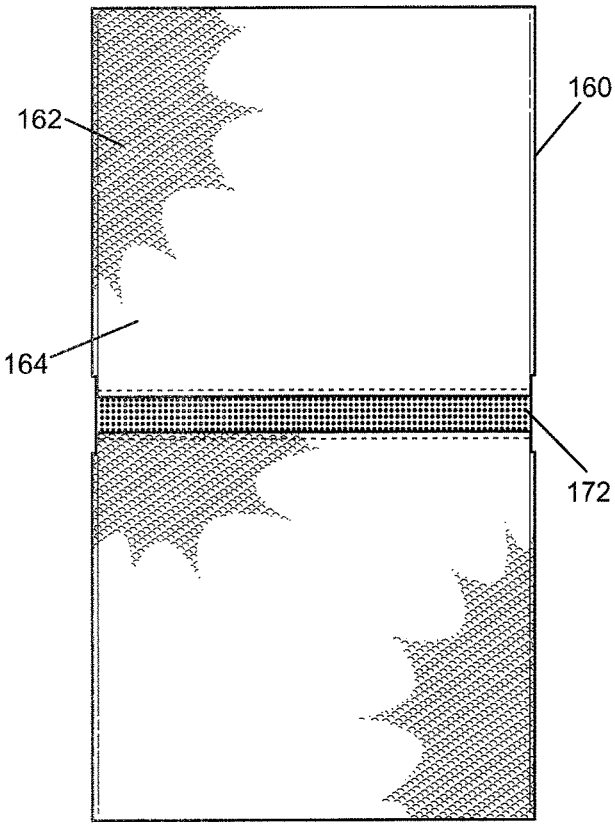
FIG. 13 is a bottom plan view of the cleaning head having a removable brush and a removable pad attached.
Figure 14:
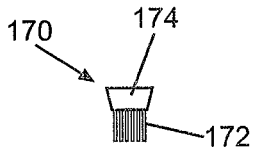
FIG. 14 is a front elevation view of the removable brush having a base formed as a wedge insert with bristles extending from the base.
Figure 15:
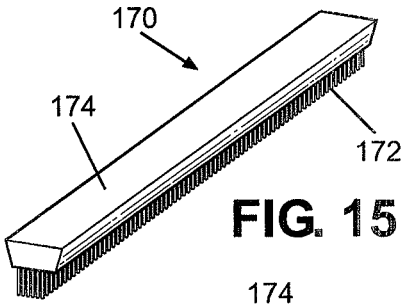
FIG. 15 is a perspective view of the removable brush.
Figure 16:
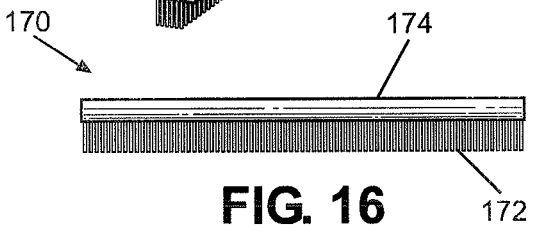
FIG. 16 is a side elevation view of the removable brush.
Figure 17:
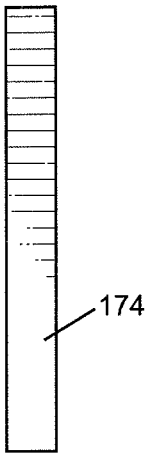
FIG. 17 is a top plan view of the removable brush.
Figure 18:
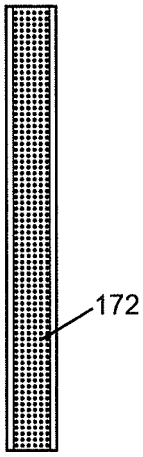
FIG. 18 is a bottom plan view of the removable brush.

The removable brush 140 includes a generally rectangular body with bristles 142 attached to and protruding from one end and a plurality of fasteners 144 protruding from the opposite end. As shown in FIGS. 7-9, the fastener 144 has the general shape of a hemisphere split into four equal sections. Between each section is a gap, which when the four equal sections are compressed together form a smaller diameter circle. The smaller diameter circle allows the fasteners 144 to pass through the holes 136 of the removable pad 130 and the mounting holes 126 of the cleaning head 120. The fasteners 144 also include a spacer/pin 146 with a length to provide adequate clearance for the insertion of the fastener 144 all the way through the holes 136 of the removable pad 130 and the mounting holes 126 of the cleaning head 120. To remove the removable brush 140, the fasteners 144 are compressed and pushed out of the holes 136 of the removable pad 130 and the mounting holes 126 of the cleaning head 120. It is contemplated that other shapes may be utilized for the fastener 144 such as a cone, a square or a rectangle.

Referring back to FIG. 6, the exploded view of tile and grout cleaning system 100 with removable brush 140 and removable cleaning pad 130 attached to a cleaning head 120 with articulable handle 110 is shown. The cleaning pad 130 is placed between the removable cleaning brush 140 cleaning head 120. The cleaning pad 130 provides a first cleaning surface for a first leveled surface, such as tile or any flat floor having a relatively flat surface. The removable cleaning brush 140 provides a second cleaning surface for a second leveled surface which is at a lower depth, such as grout between tiles. By utilizing both, the cleaning pad 130 and the cleaning brush 140, two surfaces at different levels may be simultaneously cleaned. Additionally, the cleaning pad 130 and removable cleaning brush 140 are not dependent on one another to function. The cleaning brush 140 may be used independently from the cleaning pad 130 and vice versa in instance where only a single surface is to be cleaned.

Referring now to FIGS. 10-13, a perspective view of an alternative embodiment of the cleaning head 150, the cleaning pad 160 and cleaning brush 170 is shown. The cleaning head 150 utilizes the handle 110, which is attached to the cleaning head 150 at the handle mounts 152.

The cleaning brush 170, described in conjunction with FIGS. 14-18, includes a trapezium body 174 formed with bristles 172 extending, and protruding, from the smaller base of the trapezium body 174.

Figure 19:
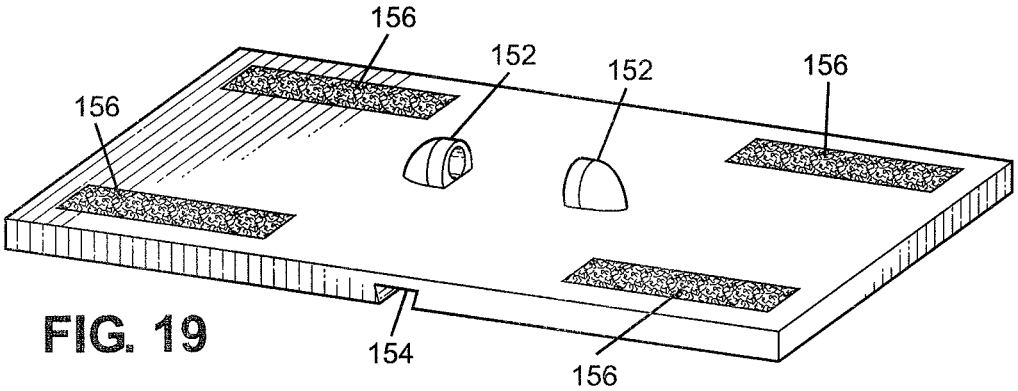
FIG. 19 is a perspective view of the cleaning head including the base formed with an insert receiver and a plurality of loop receivers.
Figure 20:
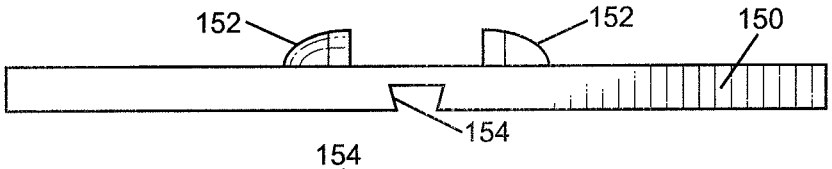
FIG. 20 is a front elevation view of the cleaning head.
Figure 21:
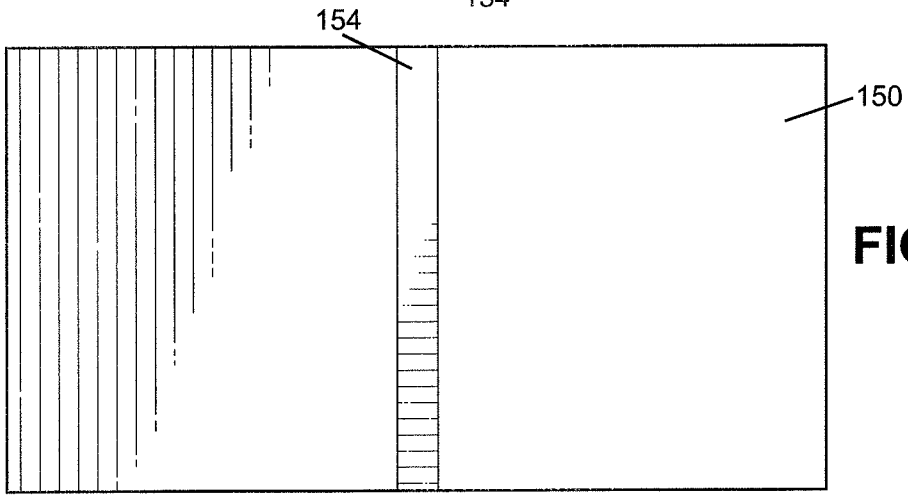
FIG. 21 is a bottom plan view of the cleaning head.

The cleaning head 150, described in conjunction with FIGS. 19-21, is generally rectangular shaped having six faces: a top, a bottom, a right, a left, a front, and a back. Formed onto the top face of the cleaning head 150 are handle mounts 152 and a plurality of loops 156 formed approximately in the middle of the cleaning head 150, on the bottom face, is receiver 154. Receiver 154 is a trapezium channel extending partially through the cleaning head 150. The receiver 154 does not extend through the cleaning head 150, but rather leaves a portion of the cleaning head intact to serve as a stop in which the removable brush 170, when inserted into the receiver 154, will abut and be stopped from further movement. This provides a secure fitment for the removable brush 170 and prevents the removable brush 170 from slipping out when used to clean surfaces.

Figure 22:
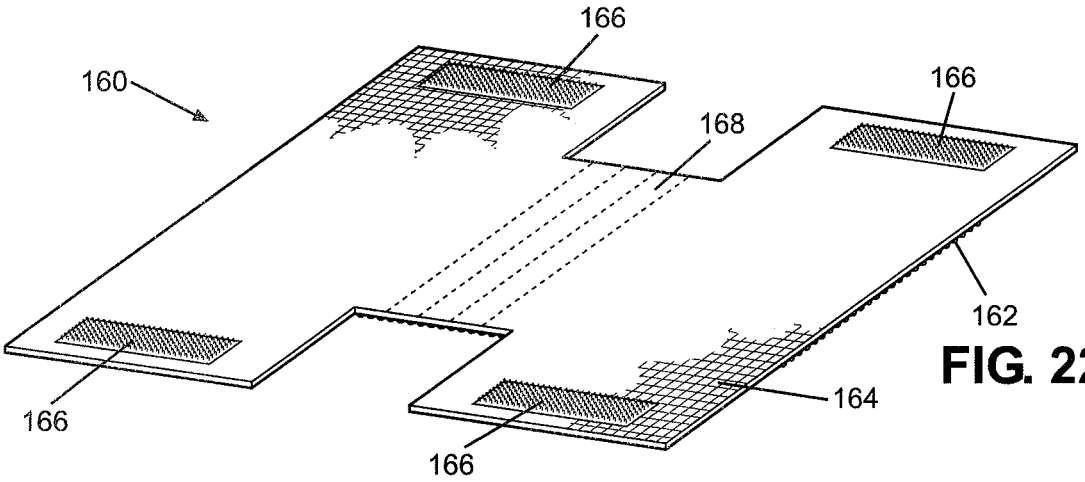
FIG. 22 is a perspective view of the removable cleaning pad having a general H shape having a base with four extending legs, the base formed with shaping indents and each leg having hooks.
Figure 23:
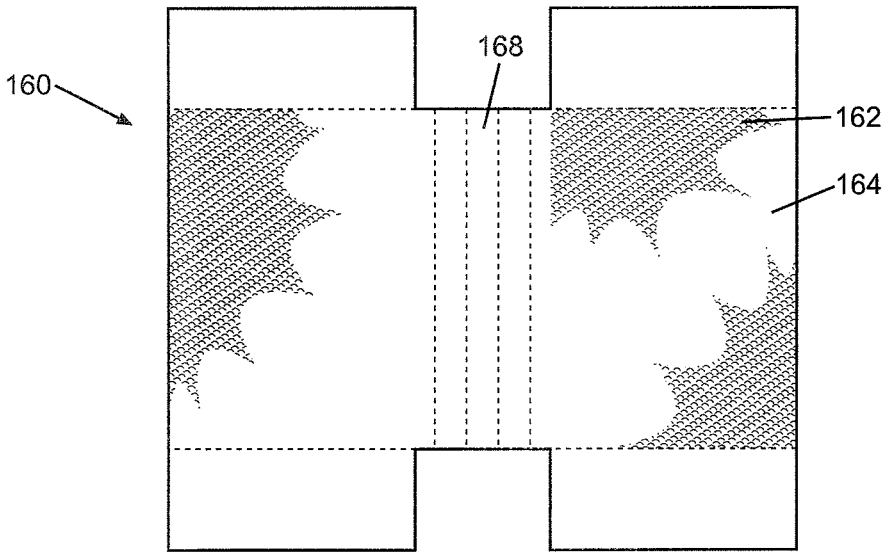
FIG. 23 is a bottom plan view of the cleaning pad.
Figure 24:
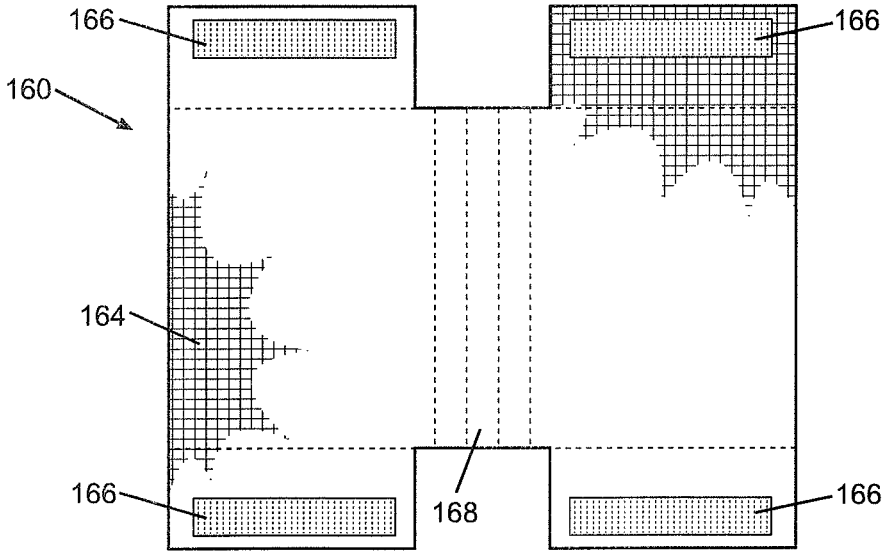
FIG. 24 is a top plan view of the cleaning pad.

The cleaning pad 160, described in conjunction with FIGS. 22-24, includes a backing 164 having a cleaning surface 162 configured to clean various types of surfaces. The backing 164 is generally H shaped with a base and four extending legs. Cleaning surface 162 covers the base section of the backing 164 and may be made of a soft material to clean delicate surfaces or made of harder materials to clean durable surfaces. Backing 164 provides structural support to the cleaning surface 162 to provide durability to the cleaning surface 162. Each leg section of the backing 164 has hooks 166 attached in a square pattern to allow attachment to loops 156 of the cleaning head 150. In approximately the midline of the backing 164 at the base section, shaping indents 168 are formed. The shaping indents 168 are preformed to allow configuration into a trapezium outline.

Figure 25:
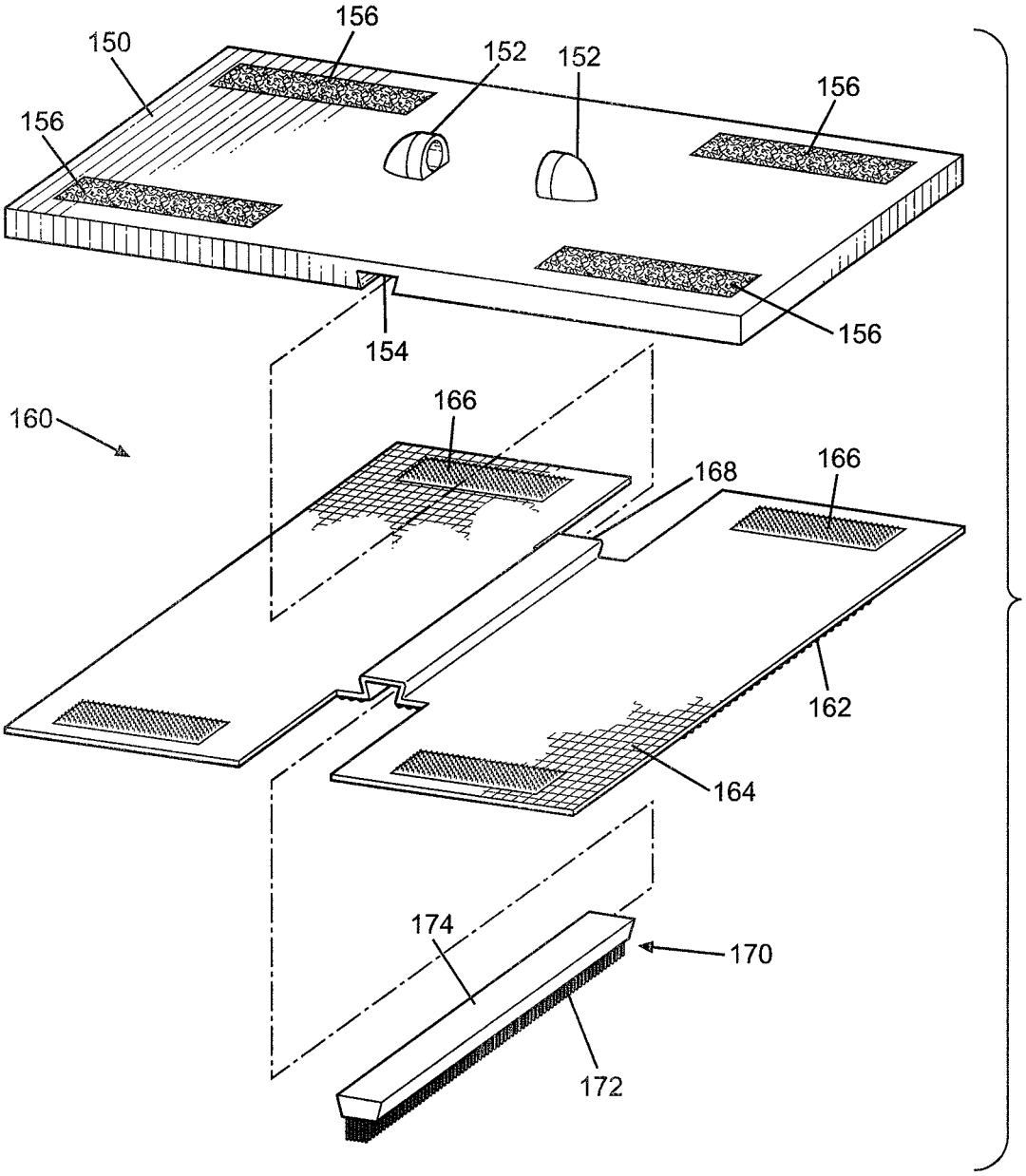
FIG. 25 is an exploded view of the alternative embodiment of the cleaning head having a removable brush and a removable pad attached showing the base of the cleaning pad configured to receive the removable brush and the cleaning head configured to receive both the cleaning pad and brush combination.

Referring now to FIG. 25, an exploded view of the cleaning head 150, the cleaning pad 160 and cleaning brush 170 is shown. The cleaning pad 160 is placed between the removable cleaning brush 170 and cleaning head 150. The shaping indents 168 of the cleaning pad 160 are preformed into the shape of a trapezium to receive the trapezium base 174 of the removable cleaning brush 170. The trapezium base 174 of the removable cleaning brush 170 is placed within the shaping indents 168 of the cleaning pad 160 and the assembly of the cleaning brush 170 and cleaning pad 160 is inserted into, and forming a secure fitment with, the receiver 154 of the cleaning head 150. The legs of the backing 164 are wrapped around cleaning head 150 and the hooks 166 are pressed and locked into the loops 156 of the cleaning head further securing the cleaning pad 160 and cleaning brush 170 to the cleaning head.

The cleaning pad 160 provides a first cleaning surface for a first leveled surface, such as tile or any flat floor having a relatively flat surface. The removable cleaning brush 170 provides a second cleaning surface for a second leveled surface which is at a lower depth, such as grout between tiles. By utilizing both, the cleaning pad 160 and the cleaning brush 170, two surfaces at different levels may be simultaneously cleaned.

Figure 26:
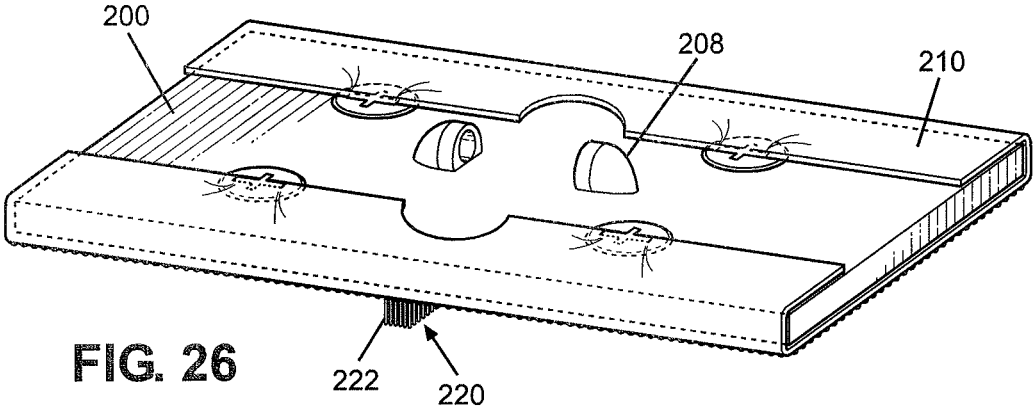
FIG. 26 is a perspective view of an alternative embodiment of the cleaning head with a removable brush attached to the cleaning head using magnets and the cleaning pad attached to the cleaning head using grips.
Figure 27:
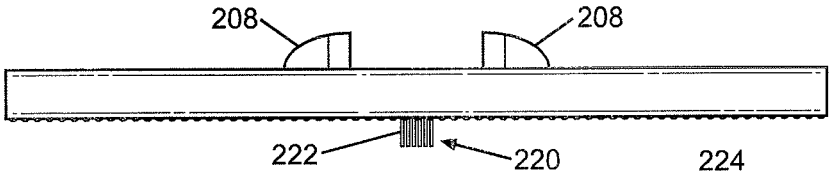
FIG. 27 is a front elevation view of the alternative embodiment of the cleaning head.
Figure 28:
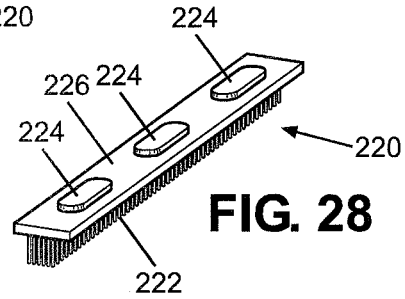
FIGS. 28-31 show the removable brush having a base with bristles protruding from a face with a plurality of magnets formed into base, opposite of the bristles.
Figure 32:
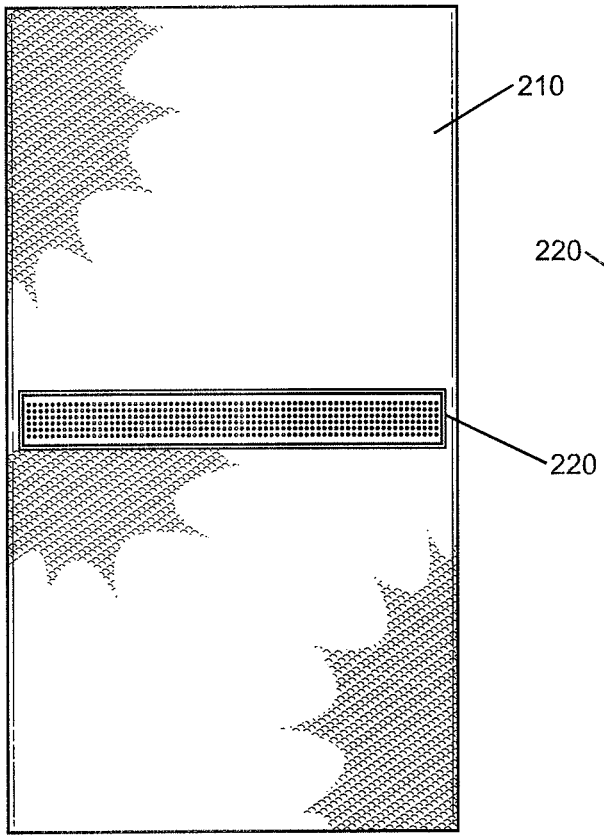
FIG. 32 is a bottom plan view of the alternative embodiment of the cleaning head.
Figure 29:
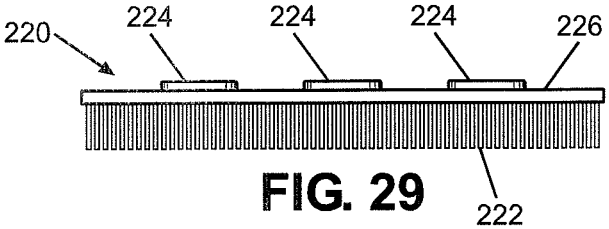
Figure 30:
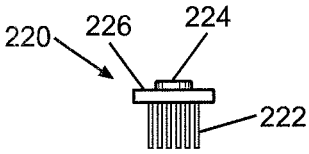
Figure 31:
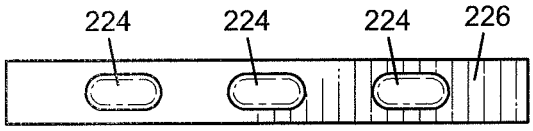
Figure 33:
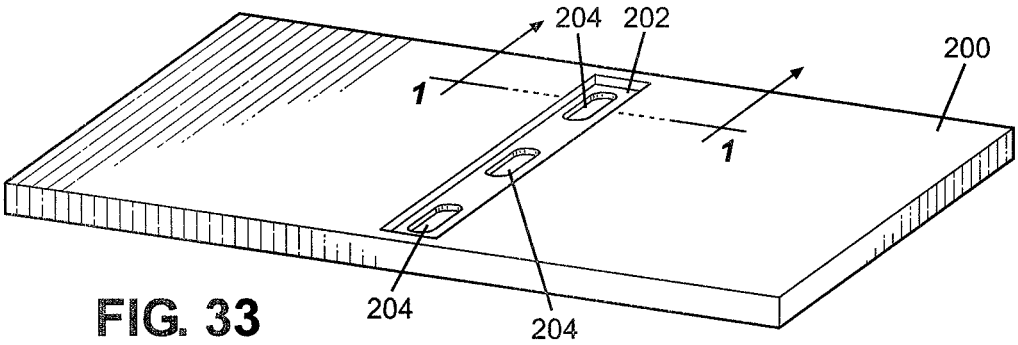
FIG. 33 is a bottom perspective view of the cleaning head formed with a receiver having a plurality of magnets, the receiver formed to receive the removable magnet.
Figure 34:
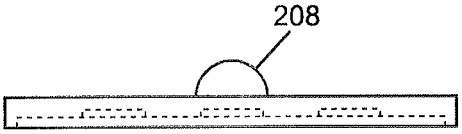
FIG. 34 is a side elevation view of the cleaning head.
Figure 35:
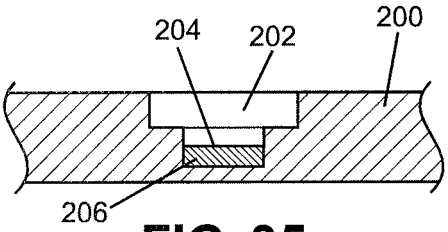
FIG. 35 is a cross-sectional view of the cleaning head showing the receiver of the cleaning head formed with a plurality of magnets.

Referring now to FIG. 26, in conjunction with FIG. 27 and FIG. 32, an alternative embodiment of the cleaning head 200, the cleaning pad 210 and the cleaning brush 220 is shown. The cleaning pad 210 and the cleaning brush 220 are independently removable from the cleaning head 200. The cleaning pad 210 provides a first cleaning surface and the cleaning brush 220 protrudes past the first cleaning surface to provide a second cleaning surface for lower depths.

Referring now to FIGS. 28-31, the cleaning brush 220 has a body 226 with a generally rectangular shaped body. Protruding from one surface of the body 226 are bristles 222. On the opposite surface of the body 226, magnets 224 are attached to or integrally formed with the surface of the body 226.

Referring now to FIGS. 33-35 and 37, the cleaning head 200 is generally rectangular shaped and includes handle mounts 208 on a top surface of the cleaning head 200 and on a bottom a receiver 202 is formed into the cleaning head 200. The receiver 202 is generally rectangular shaped and is configured to receive the body 226 of the cleaning brush 220. The receiver 202 is further formed with magnetic inserts 204 with a magnet 206 pressed within. The magnetic inserts 204 are configured to receive the magnets 224 of the cleaning brush 220. The magnets 224 and 206 are oriented wherein the poles are opposite. This allows the magnets 224 and 206 to attract and maintain a magnetic force to keep them together. This allows the cleaning brush 220 to attach to the cleaning head. Additionally, the recessed receiver 204 and magnet insert 204 provides lateral and vertical support for the cleaning brush 220 when used in the cleaning head.

Figure 36:
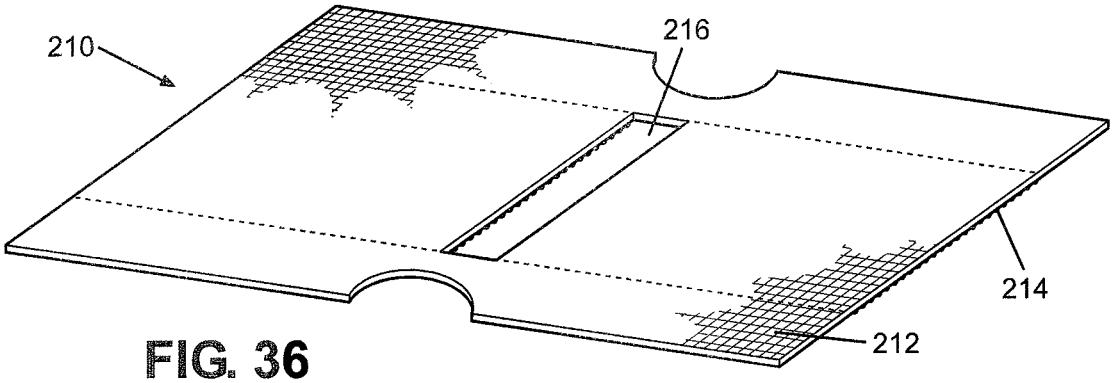
FIG. 36 is a perspective view of the cleaning pad.
Figure 37:
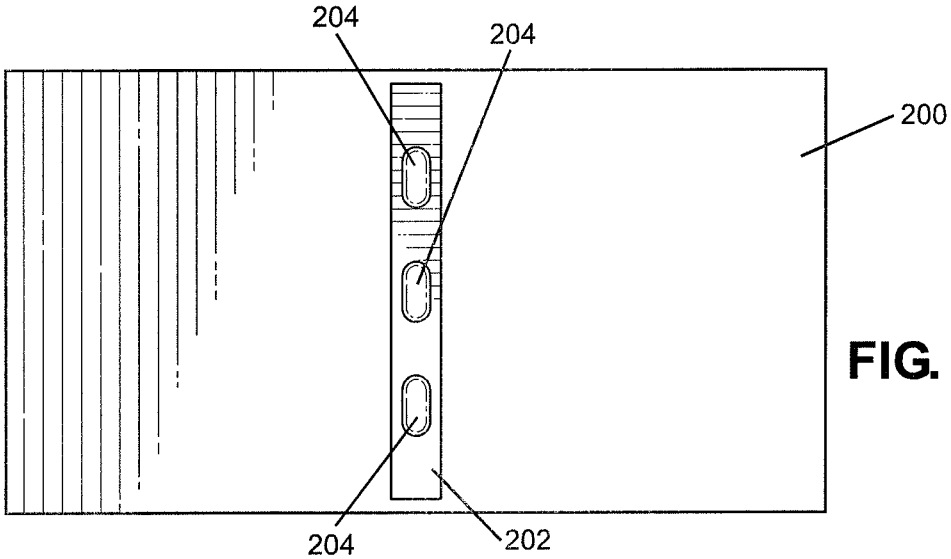
FIG. 37 is a bottom plan view of the cleaning pad.

Referring now to FIG. 36, the cleaning pad includes a backing 212 with a cleaning surface 214 on one side. At approximately the midline of the backing 212, a brush pass-through 216 shaped has a rectangular opening is formed. The brush pass-through 216 allows the bristles 222 of the brush 220 to extend through and pass the cleaning pad 210. The brush pass-through 216 also allows the cleaning brush 220 to be easily removed from the cleaning head 200 for when cleaning only a single surface. For the cleaning of two surfaces at different levels, the cleaning surface 214 of the cleaning pad 210 provides a first cleaning surface and the bristles 222 of the cleaning brush 220 provides a second cleaning surface, located at a lower depth.

Figure 38:
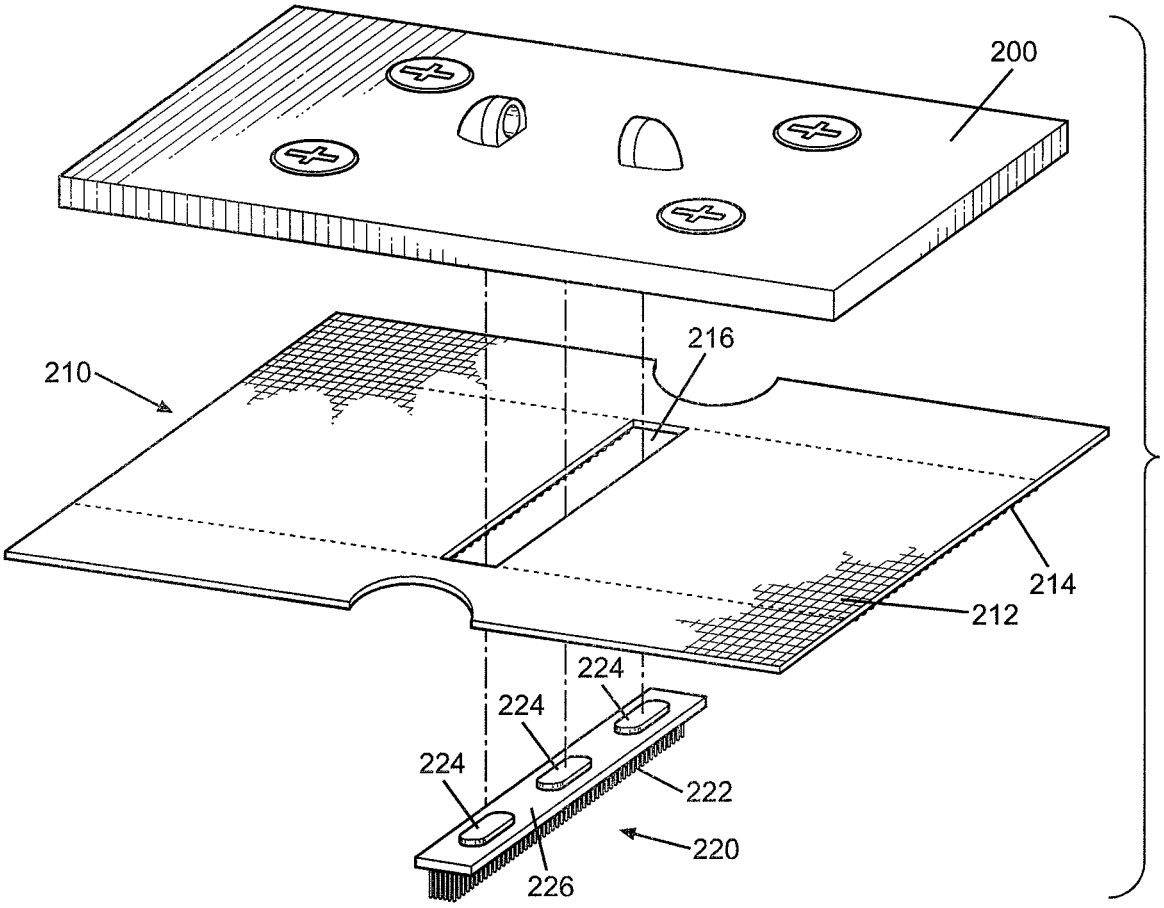
FIG. 38 is an exploded view of the tile and grout cleaning system.
Figure 39:
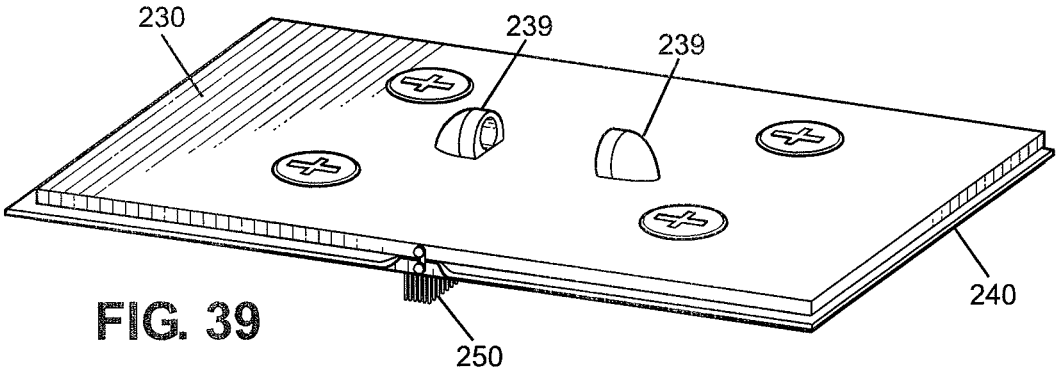
FIGS. 39-42 show an alternative embodiment of the tile and grout cleaning system.
Figure 40:
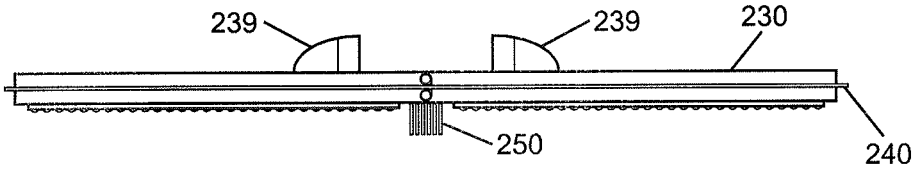
Figure 41:
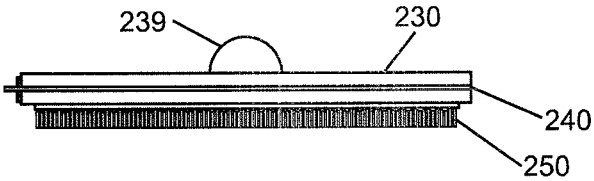
Figure 42:
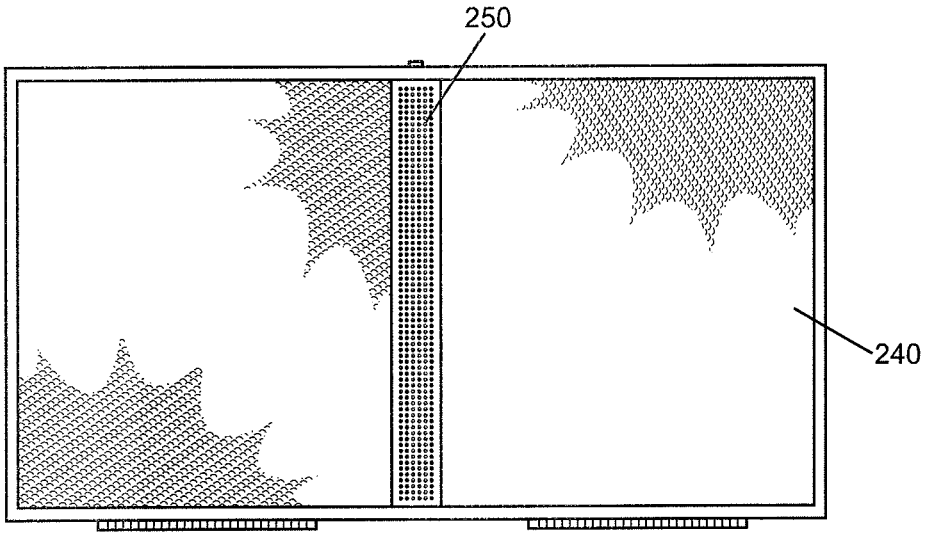
Figure 43:
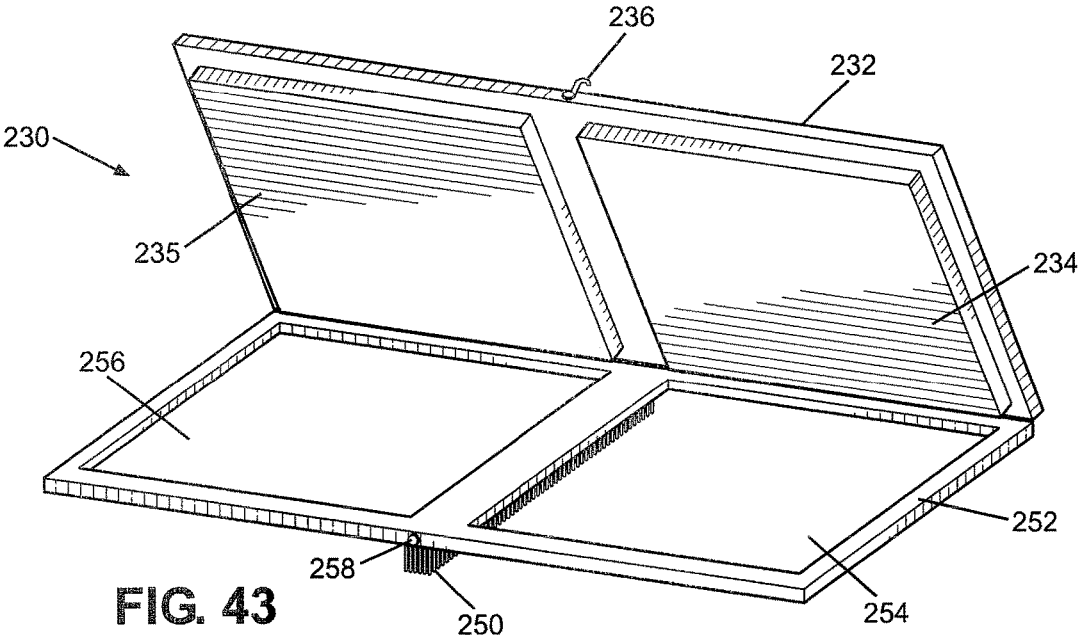
FIGS. 43-44 show the cleaning head of the alternative of the tile and grout cleaning system of FIGS. 38-41.
Figure 44:
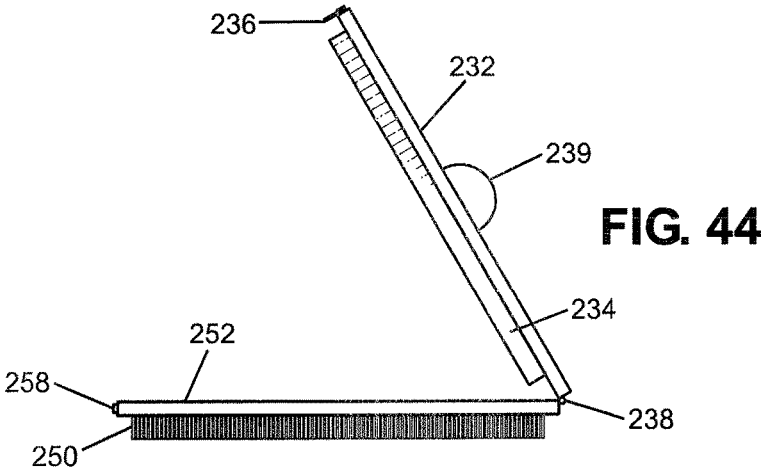

Referring now to FIG. 38, an exploded view of the cleaning head 200, the cleaning pad 210 and the cleaning brush 220 is shown. The cleaning pad 210 is formed with the brush pass-through 216 which allows the cleaning brush 220 to be removed or inserters into the cleaning head 200 without the need to first remove the cleaning pad 210.

Referring now to FIG. 38-42, an alternative embodiment of a cleaning head 230 and a cleaning pad 240 is shown. The cleaning head 230 is formed with bristles 250 protruding from the cleaning head 230 for use as a brush.

Referring now to FIGS. 43-44 and 47-48 the cleaning head 230 is formed as a rectangular clam shell and includes a top portion 232 and a bottom portion 252 attached together by hinge 238. The hinge 238 allows the top portion 232 and bottom portion 252 to pivot relative to one another to an open and a closed position.

The top portion 232 includes a first square protrusion 234 and a second square protrusion 235 projecting from the bottom surface of the top portion 232. Located at the front of the top portion 232 is a clasp 236. The top of the top portion 232 is formed with handle mounts 239. The bottom portion 252 includes a first opening 254 and a second opening 256. The first opening 254 and the second opening 256 are sized larger than the first square protrusion 234 and a second square protrusion 235, respectively. Located at the front of the bottom portion 252 is a prong 258 to receive the clasp 236 for a secure lock. Protruding from the bottom of the bottom surface 258, in between the first opening 254 and the second opening 256 are the bristles 250.

Figure 45:
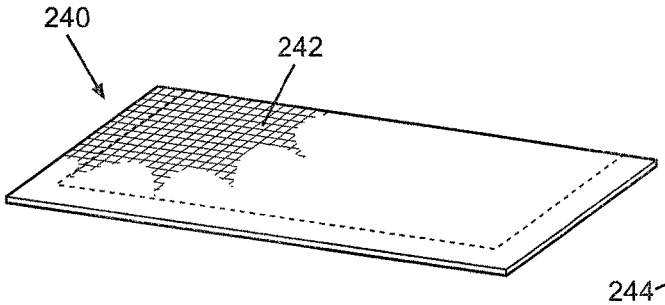
FIGS. 45-46 show the cleaning pad of the of the tile and grout cleaning system FIGS. 39-42.
Figure 46:
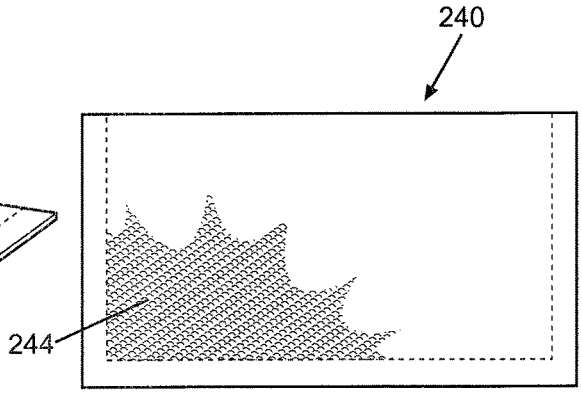
Figure 47:
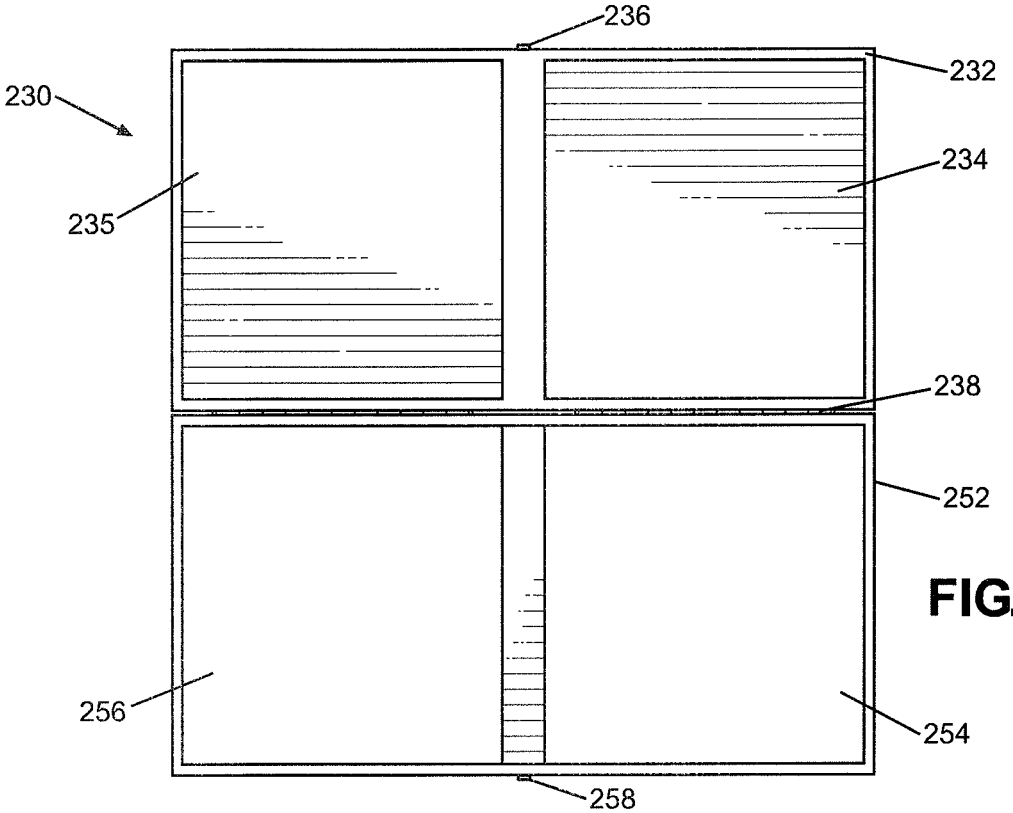
FIGS. 47 and 48 show the cleaning head of the alternative embodiment of the tile and grout cleaning system FIGS. 39-42.
Figure 48:
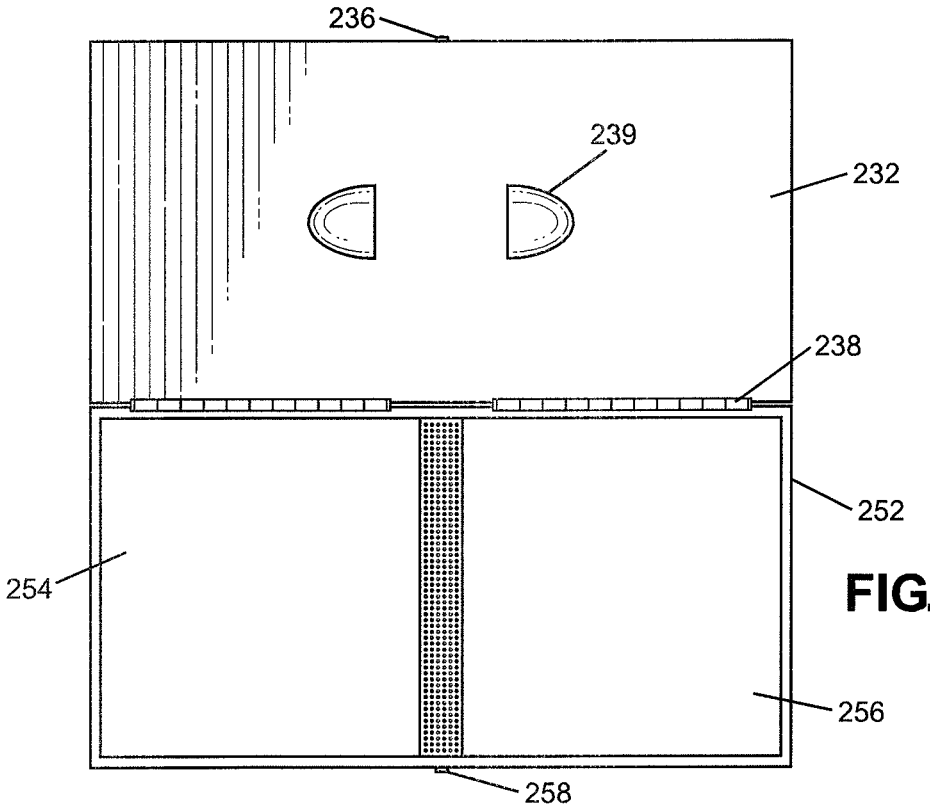

Referring now to FIG. 45 and FIG. 46, the cleaning pad 240 includes a backing 242 with a cleaning surface 244. The backing 242 is pliable, supple and easily deformable into various shapes. The pliability and suppleness of the backing 242 allows the cleaning pad 240 to deform when inserted into the cleaning head 230. The cleaning pad 240 is positioned between the top portion 232 and the bottom portion 252 of the cleaning head 230. When the cleaning head 230 is closed, the first square protrusion 234 and the second square protrusion 235 presses the cleaning pad through the first opening 254 and the second opening 256, respectively. The cleaning surface 244 of the cleaning pad 240 is exposed through the first opening 254 and the second opening 256 of the cleaning head 230 to provide a cleaning surface for a first surface. The bristles 250 of the cleaning head provide a second cleaning surface located at a different level than the first surface.

Figure 49:
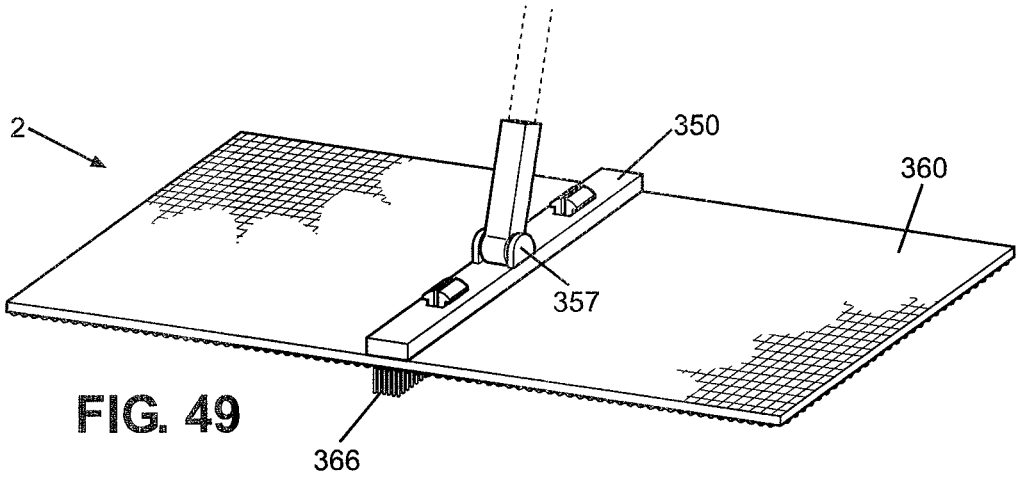
FIG. 49 shows an alternative embodiment of the tile and grout cleaning system.
Figure 50:
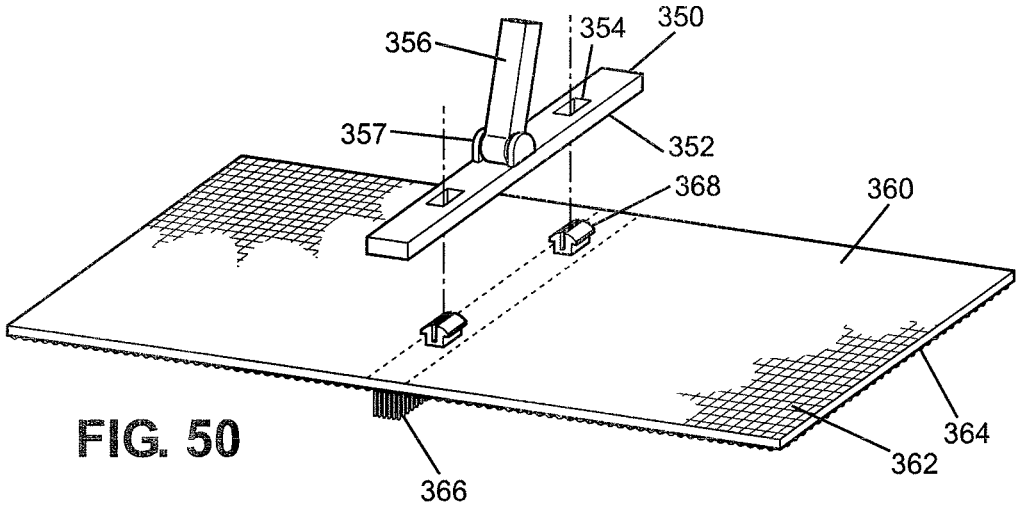
FIG. 50 is an exploded view of the alternative embodiment of the tile and grout cleaning system of FIG. 49.
Figure 51:
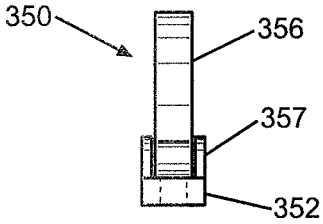
FIGS. 51-54 show the handle attachment of the alternative embodiment of the tile and grout cleaning system of FIG. 48.
Figure 52:
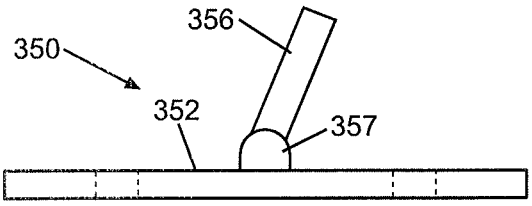
Figure 53:
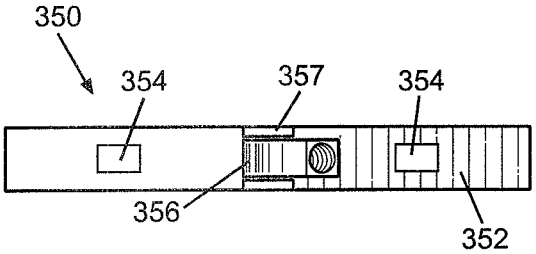
Figure 54:
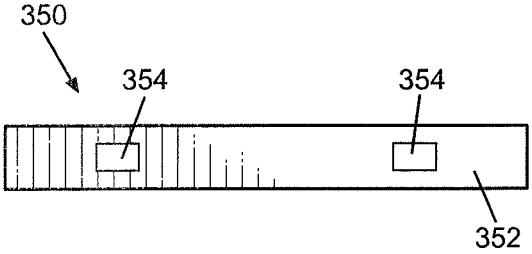

Referring now to FIG. 49, an alternative embodiment of the Tile and Grout Cleaning System 2 is shown and includes a handle attachment 350 and a cleaning pad 360. As shown in FIG. 50, an exploded view of the Tile and Grout Cleaning System 2 shows the handle attachment 350 removed from the cleaning pad 360.

The handle attachment 350, described in conjunction with FIGS. 51-54 includes a body 352 having a general rectangular shape formed with a plurality of receiving holes 354 and a handle receiver mount 357, and a handle receiver 356. The receiving holes 354 are generally rectangular shaped holes and the receiver mount 357 are two tabs formed flush with the edge of the body 352. The handle receiver 356 is rotatably mounted to the receiver mount 357 to allow articulation of the handle receiver 356.

Figure 55:
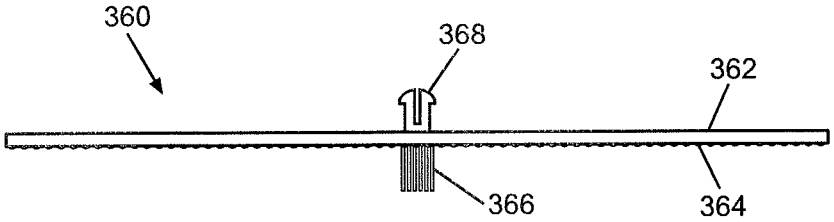
FIGS. 55-57 show the cleaning pad of the alternative embodiment of the tile and grout cleaning system of FIG. 48.
Figure 56:
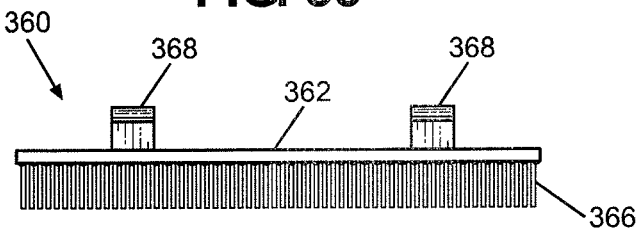
Figure 57:
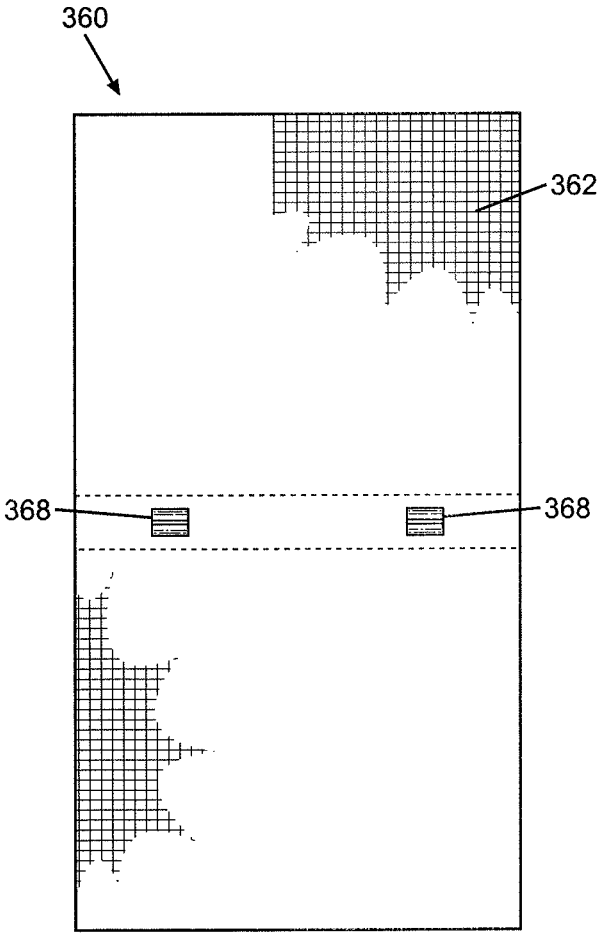

The cleaning pad 360, described in conjunction with FIGS. 55-57 includes a rigid backing 362 in which a brush 366 is attached approximately in the middle of the rigid backing 362 and on either side of the brush is a cleaning pad surface 364. The rigid backing 362 provides the structural support required to clean tile and grout surfaces simultaneously as a user brushes the cleaning pad 360 and forth against the multiple surfaces. Attached or formed to the rigid backing 362 in line with the brush 362 is a plurality of fasteners 368.

The fastener 368 has the general shape of a trapezium split into two equal sections. Between each section is a gap, which when the two equal sections are compressed together form a smaller footprint. The smaller footprint allows the fasteners 368 to pass through the receiving holes 354 of the fasteners 368 also include an elongated neck to provide adequate clearance for the insertion of the fastener 368 all the way through the receiving holes 354 of the handle attachment 350. To remove the handle attachment 350 the fasteners 368 are compressed and pushed out of the receiving holes 354. It is contemplated that other shapes may be utilized for the fastener 368 such as a hemisphere, cone, a square or a rectangle.

By placing the fastener 368 and the brush 366 in line and on opposite sides of the rigid backing 362, the force applied to the cleaning pad 360 through the handle attachment 350 is concentrated over the brush 366. This allows more force to be used on the brush 366 to clean, as the deeper surfaces typically do not receive the same amount of cleaning as elevated surfaces typically do. The rigid backing 362 has sufficient structural strength to provide the force needed to clean surfaces in contact with the cleaning surface 364, thereby not needing the concentrated force applied through the handle attachment 350.

Figure 58:
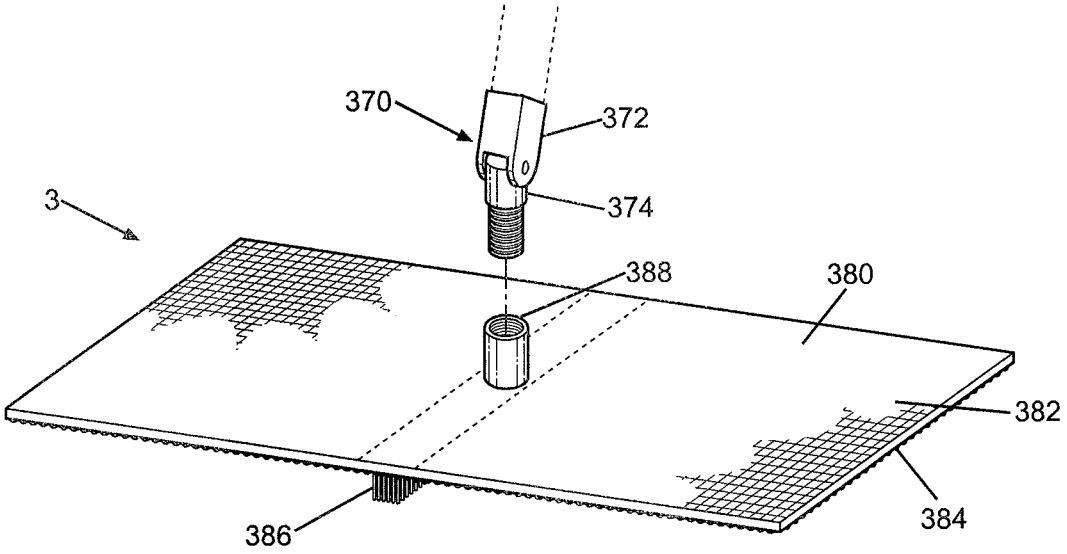
FIG. 58 shows an alternative embodiment of the tile and grout cleaning system.
Figure 59:
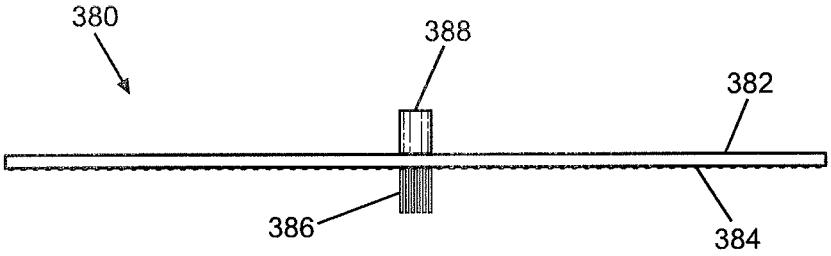
FIGS. 59-62 show the cleaning pad of the alternative embodiment of the tile and grout cleaning system of FIG. 58.
Figure 60:
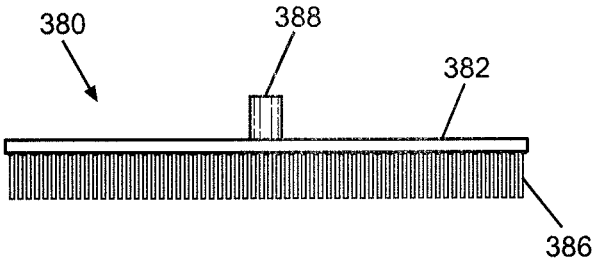
Figure 61:
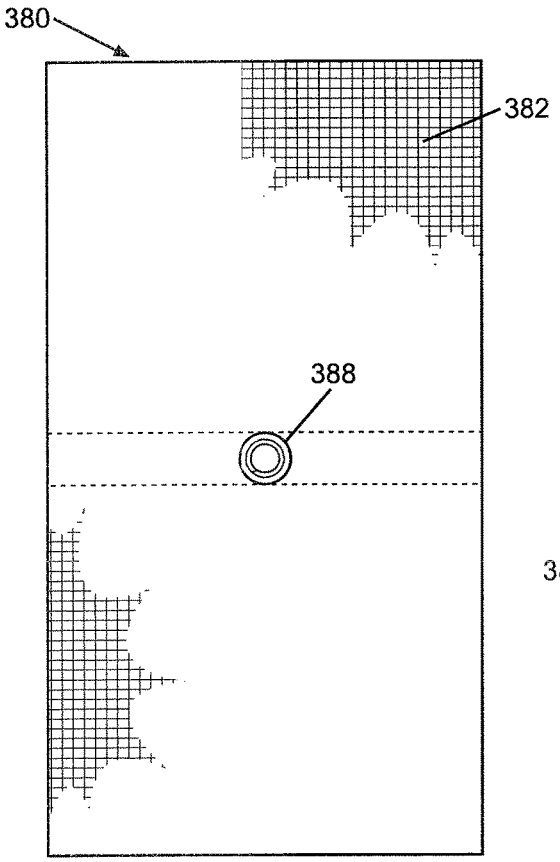
Figure 62:
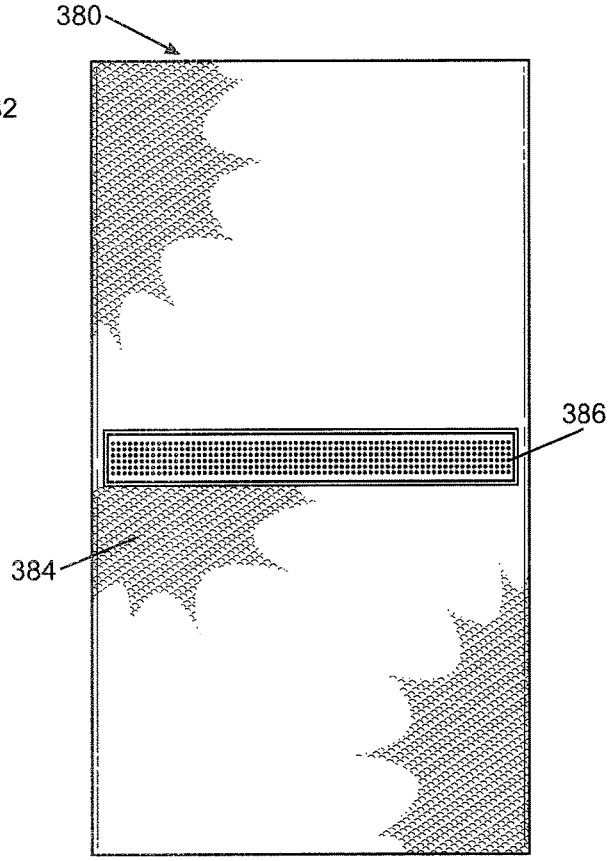

Referring now to FIG. 58, an alternative embodiment of the Tile and Grout Cleaning System 3 is shown and includes a handle attachment 370 and a cleaning pad 380. The handle attachment 370 includes a pivot base 372 attached to a threaded insert 374 with a pin which allows the pivot base 372 to pivot relative to the threaded insert 374. The pivot base 372 is formed with a threaded bore to receive a handle having a threaded insert.

The cleaning pad 380, described in conjunction with FIGS. 59-62, includes a rigid backing 382 in which a brush 386 is attached approximately in the middle of the rigid backing 382 and on either side of the brush is a cleaning surface 384. The rigid backing 382 provides the structural support required to clean tile and grout surfaces simultaneously as a user brushes the cleaning pad 380 and forth against the multiple surfaces. The cleaning surface 384 cleans a first surface and the brush 386 cleans a second surface at a different elevation. Attached or formed to the rigid backing 382 in line with the brush 386 is a threaded receiver 388 formed to receive the threaded insert 374 of the handle attachment 370. Similar to fasteners 368 of cleaning pad 360, the threaded receiver 388 and the brush 386 is formed in line and opposite of the rigid backing 382 to concentrate the majority of downward force on the brush 386.

Figure 63:
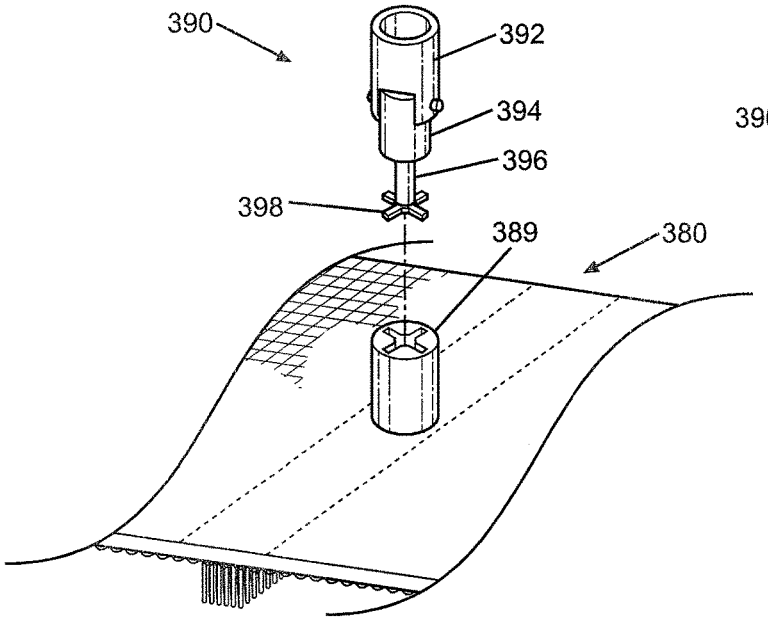
FIGS. 63-64 show an alternative embodiment of the handle attachment of the alternative embodiment of the tile and grout cleaning system of FIG. 58.
Figure 64:
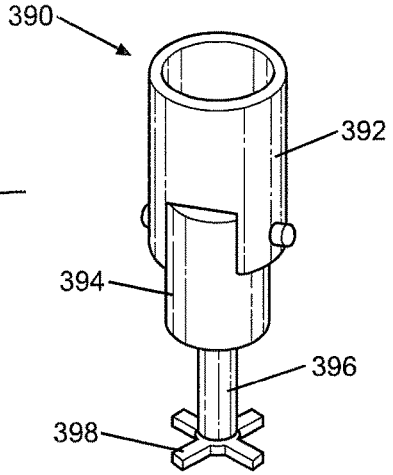

FIGS. 63 and 64 shows an alternative embodiment of the handle attachment 390 and includes a pivot base 392 attached an insert assembly 394 having a pin 396 extending therefrom with a cross 398 attached at the end. The insert assembly 394 is attached to the pivot base 392 with a pin which allows the pivot base 392 to pivot relative to the insert 394. The pivot base 392 is formed with a threaded bore to receive a handle having a threaded insert. The cross 398 and pin 396 is inserted into a receiver 389 attached to the cleaning pad 380 and locked in place.

Figure 65:
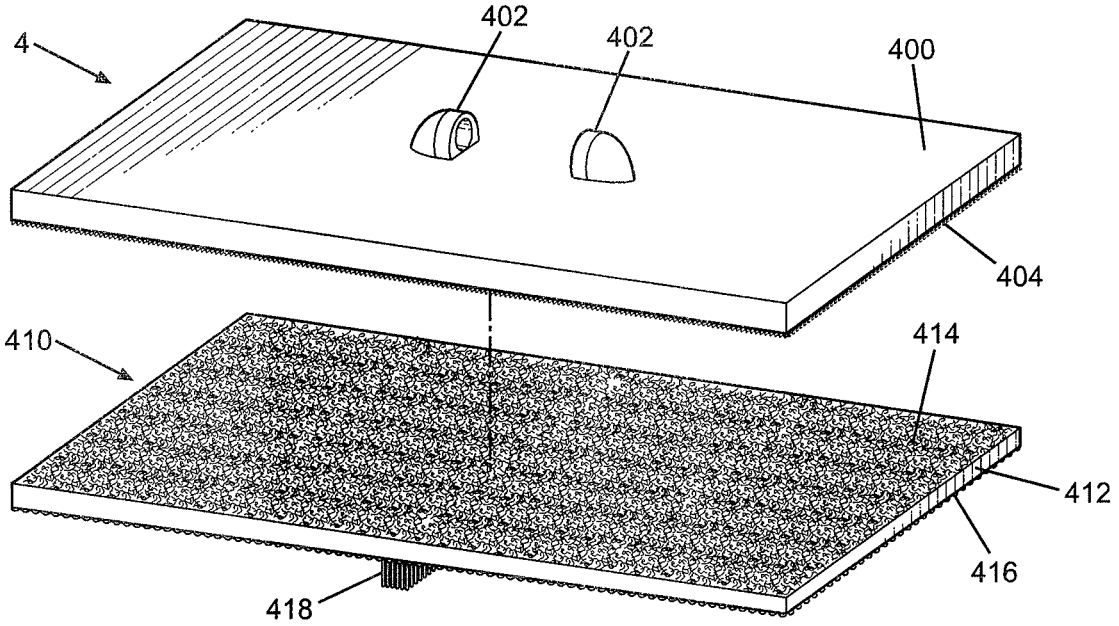
FIG. 65 shows an alternative embodiment of the tile and grout cleaning system.

Referring now to FIG. 65, an alternative embodiment of the Tile and Grout Cleaning System 4 is shown and includes a cleaning head 400 and a cleaning pad 410. The cleaning head 400 is generally rectangular shaped and includes a handle mount 402 formed on one surface and on the opposite surface of the cleaning head 400 has hooks 404 attached. As shown, the hooks 404 cover the entirety of a single surface of the cleaning head 400 but are not required to cover the entire surface. The hooks 404 may cover as much surface area as necessary to create a secure mounting surface for the cleaning pad 410.

Figure 66:
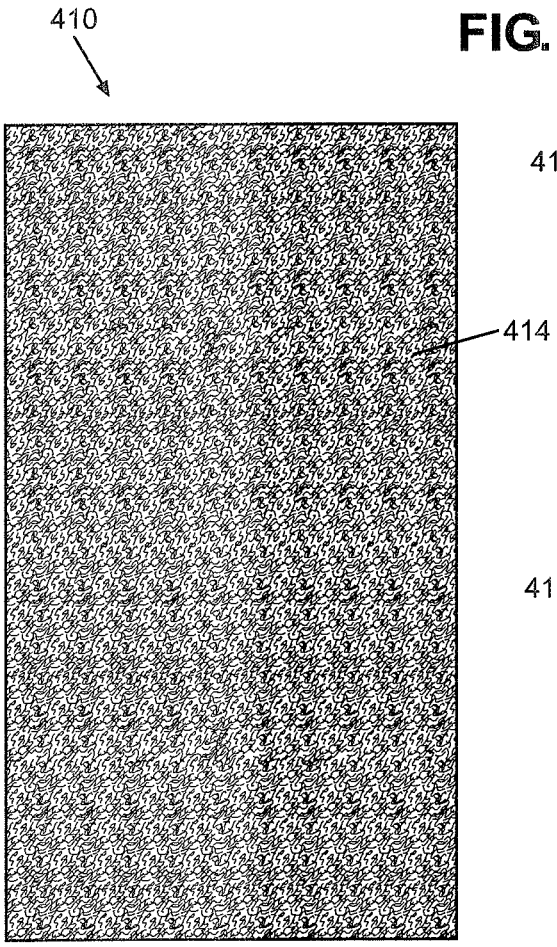
FIGS. 66-67 show the cleaning pad of the alternative embodiment of the tile and grout cleaning system of FIG. 64.
Figure 67:
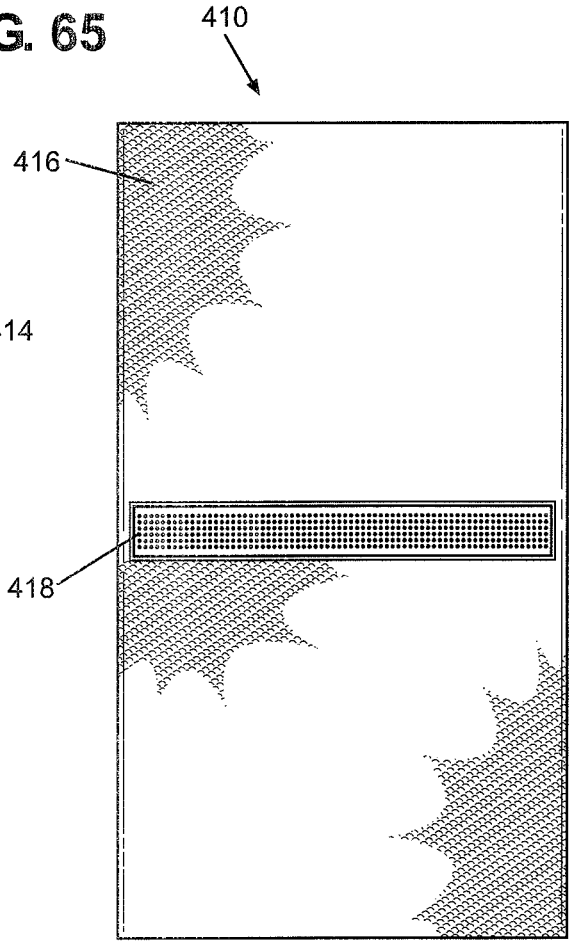

The cleaning pad 410, described in conjunction with FIG. 66 and FIG. 67, includes a backing 412 having loops 414 disposed on one surface and a cleaning surface 416 disposed on the opposite surface of the backing 412. Formed at approximately the midpoint of the backing 412 and extending longitudinally is the brush 418.

Figure 68:
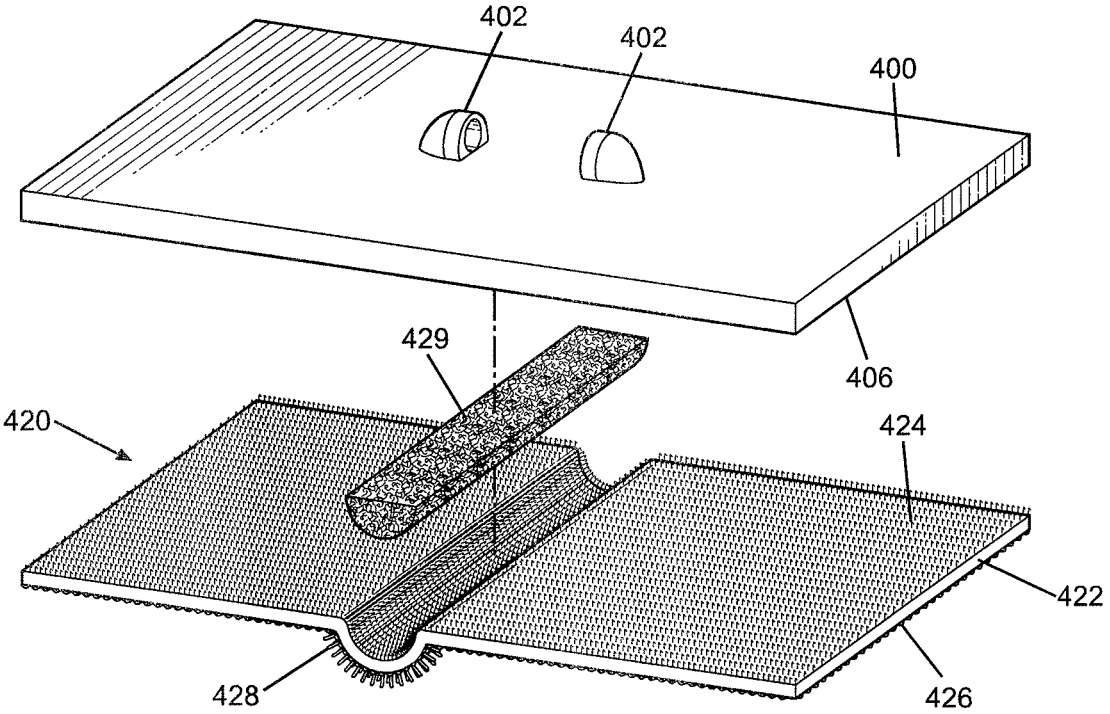
FIG. 68 shows an alternative embodiment of the tile and grout cleaning system.

Referring now to FIG. 68, an alternative embodiment of the cleaning pad 420 of the Tile and Grout Cleaning System 4 is shown. The clean head 400 includes loops 406 instead of hooks 404 as shown in FIG. 64. The cleaning pad 420, described in conjunction with FIG. 69, includes a pliable, ductile and deformable backing 422. On one side of the backing 422 are hooks 424 which cover the entirety of the surface. On the opposite side of the backing 422 is a cleaning surface 426. At the midpoint of the backing 422 with the cleaning surface 426, a plurality of bristles 428 are attached. In an alternative embodiment, the bristles 428 may be omitted and the cleaning surface 426 may extend through the surface of the backing 422 for use on less demanding surfaces.

Figure 69:
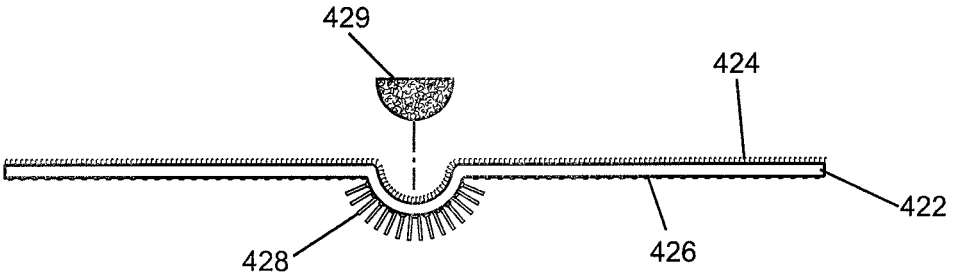
FIGS. 69-70 show the cleaning pad of the alternative embodiment of the tile and grout cleaning system of FIG. 67.
Figure 70:
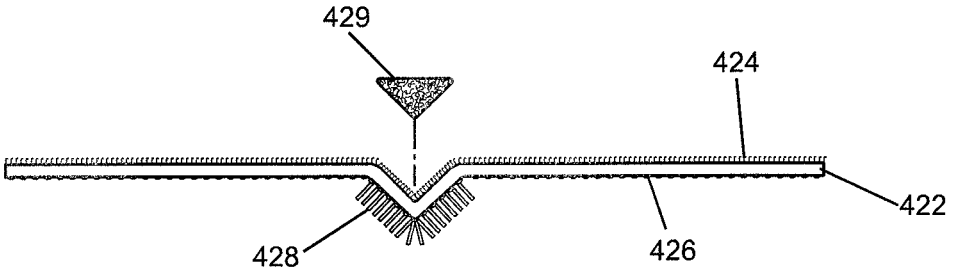

The pliable and deformable nature of the backing 422 allows the cleaning pad 420 to be formed into numerous shapes. Specifically, the portion of the cleaning pad 420 with attached bristles 428 may be deformed into different shapes such as a half circle as shown in FIG. 69 or a triangle as shown in FIG. 70. In order to maintain the shape, a shape insert 429 is placed between the cleaning head 400 and the cleaning pad 420. The ability to modify the shapes instantaneously allows a user to clean various surfaces at the same time with different surface shapes. The circular shaped insert 429 may be used to clean grout having a hemispherical shape and the triangular shaped insert 429 may be used to clean triangular shaped grout.

Figure 71:
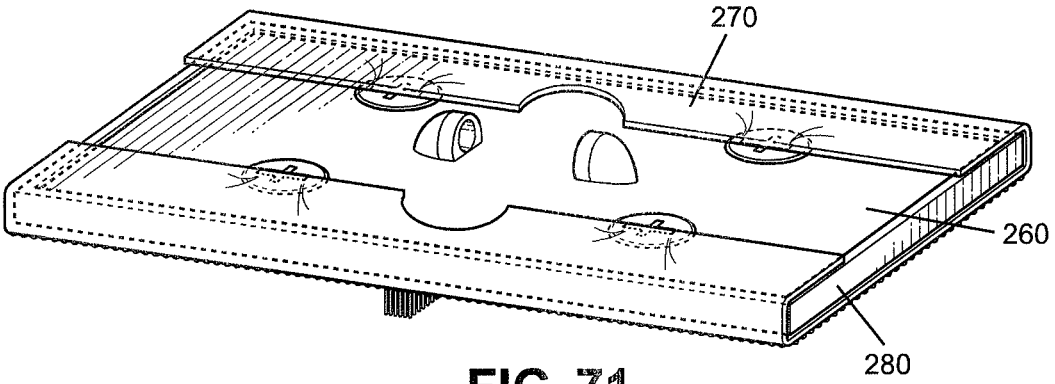
FIG. 71 shows an alternative embodiment of the tile and grout cleaning system.
Figure 72:
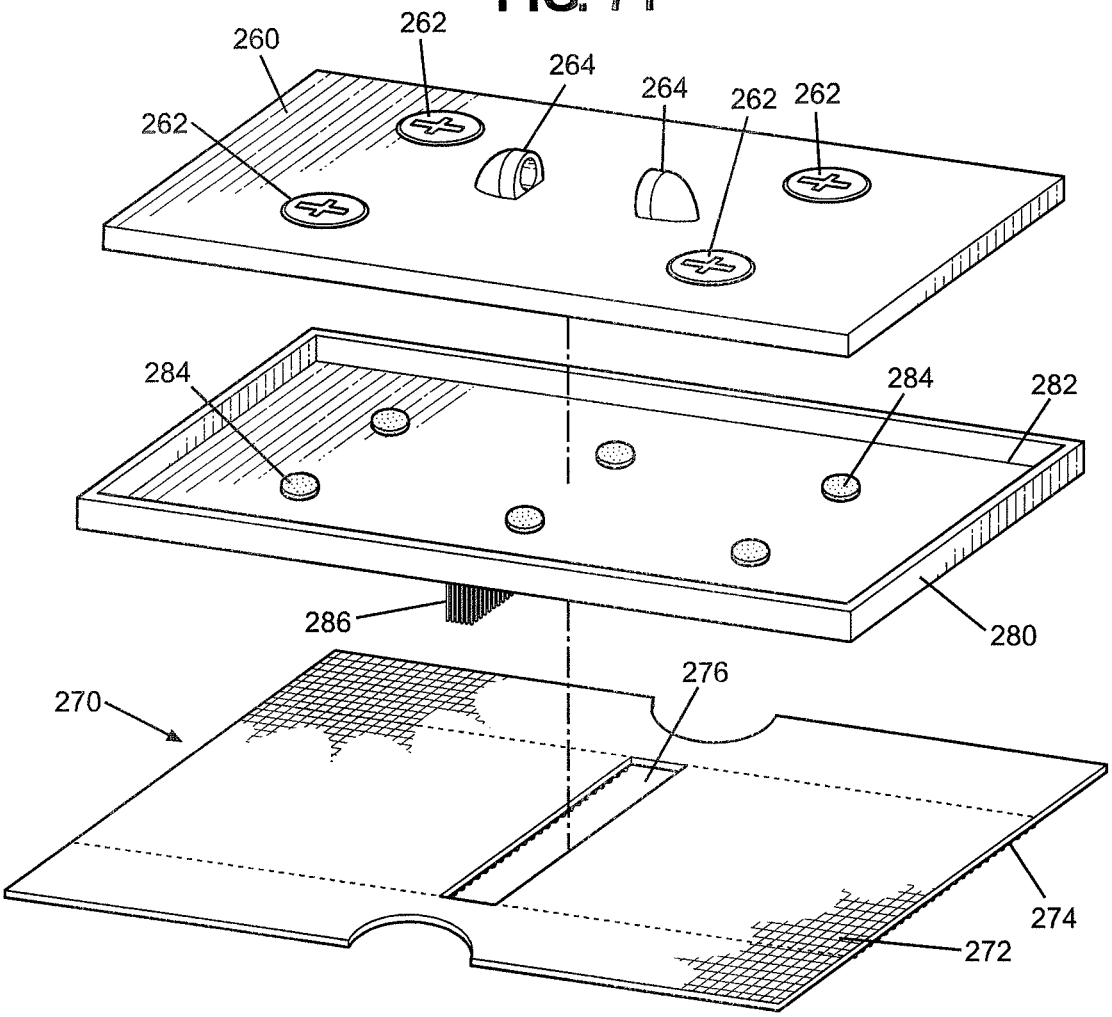
FIG. 72 is an exploded view of the alternative embodiment of the tile and grout cleaning system of FIG. 71.
Figure 73:
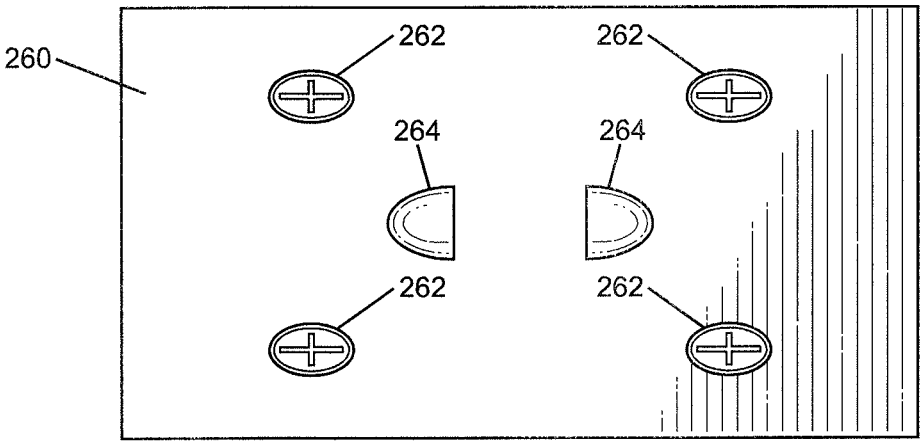
FIGS. 73-76 show the cleaning head of the alternative embodiment of the tile and grout cleaning system of FIG. 71.
Figure 74:
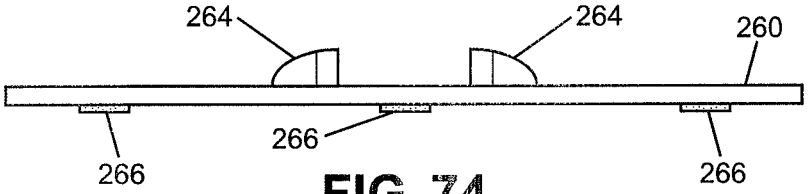
Figure 75:
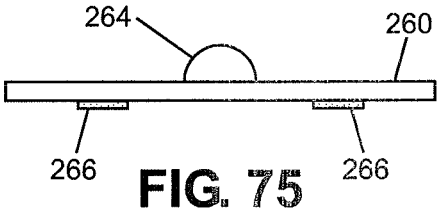
Figure 76:
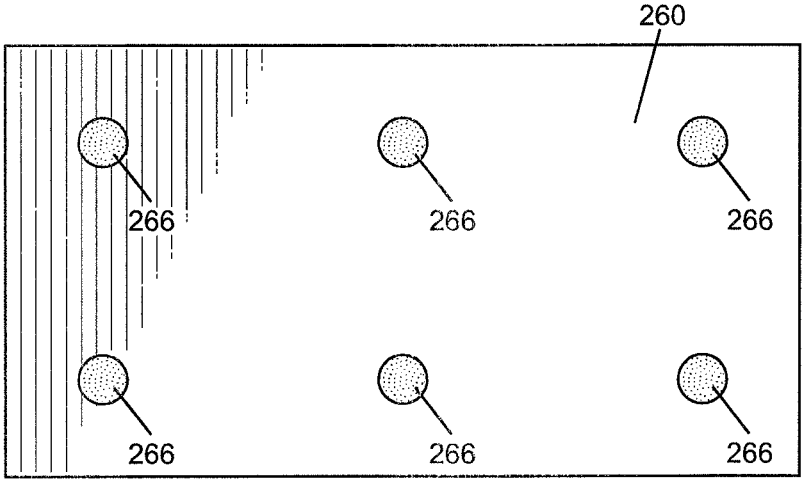
Figure 77:
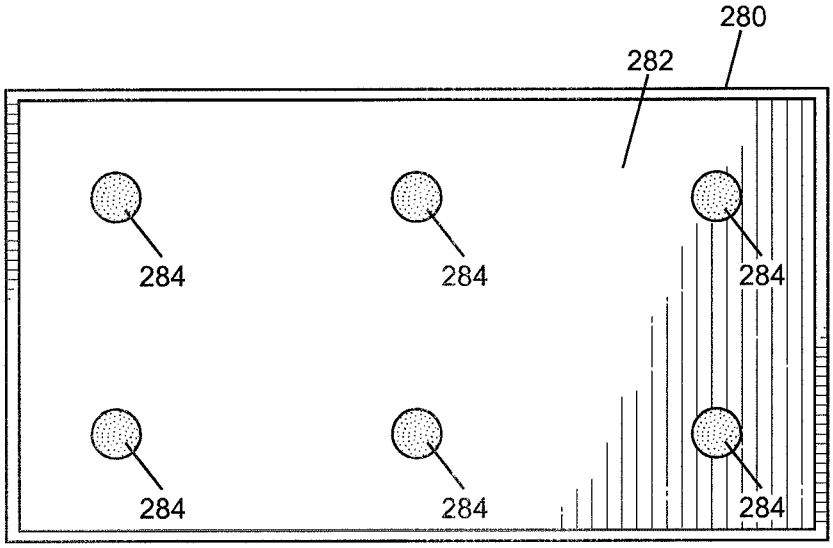
FIGS. 77-80 show the cleaning brush of the alternative embodiment of the tile and grout cleaning system of FIG. 71.
Figure 78:
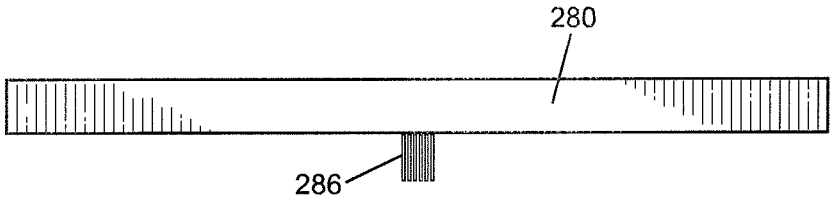
Figure 79:
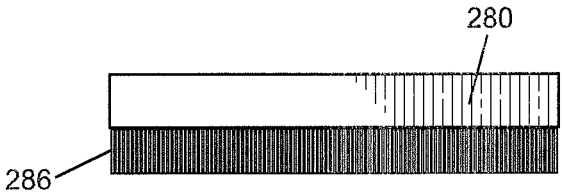
Figure 80:
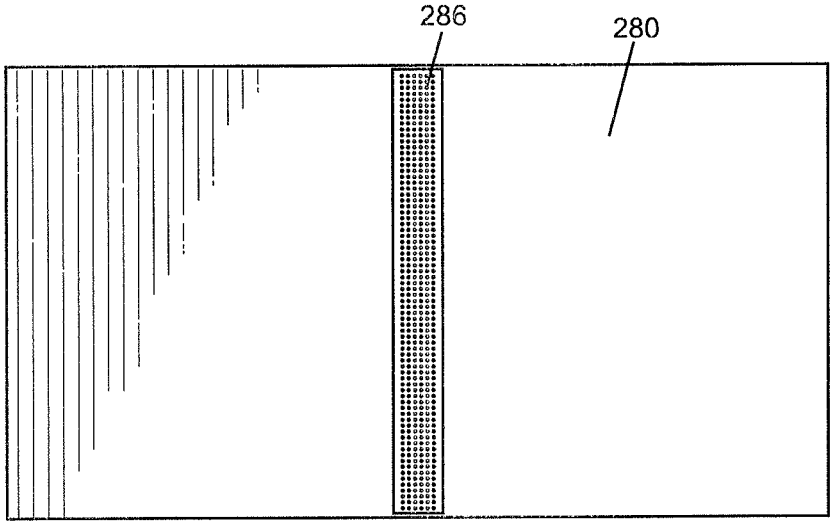

Referring now to FIG. 71, an alternative embodiment of a cleaning head 260, a cleaning pad 270, and a cleaning brush 280 is shown. The cleaning head 260 is inserted within the cleaning brush 280 and the cleaning pad 270 wraps around the cleaning head 260 and the cleaning brush 280 to provide a cleaning head capable of cleaning multiple leveled surfaces simultaneously. FIG. 72 is an exploded view showing the cleaning head 260, the cleaning pad 270, and the cleaning brush 280 detached from one another.

Referring now to FIG. 73-76, the cleaning head 260 is generally rectangular shaped and includes a plurality of grippers 262 and a handle mount 264 formed into the top surface of the cleaning head 260. Located on the opposite surface of the cleaning head 260 is a plurality of recessed magnets 266.

Referring now to FIGS. 77-80, the cleaning brush 280 is shown having a general shape of a rectangle. A recess 282 is formed into the top surface of the cleaning brush 280 and is sized to receive the cleaning head 260. Attached or formed within the recess 282 of the cleaning brush 280 is a plurality of magnets 284. The magnets 284 protrude from the surface of the recess 282. Opposite the recess 282 on the cleaning brush 280 is a plurality of bristles 286 formed into the cleaning brush 280.

Figure 81:
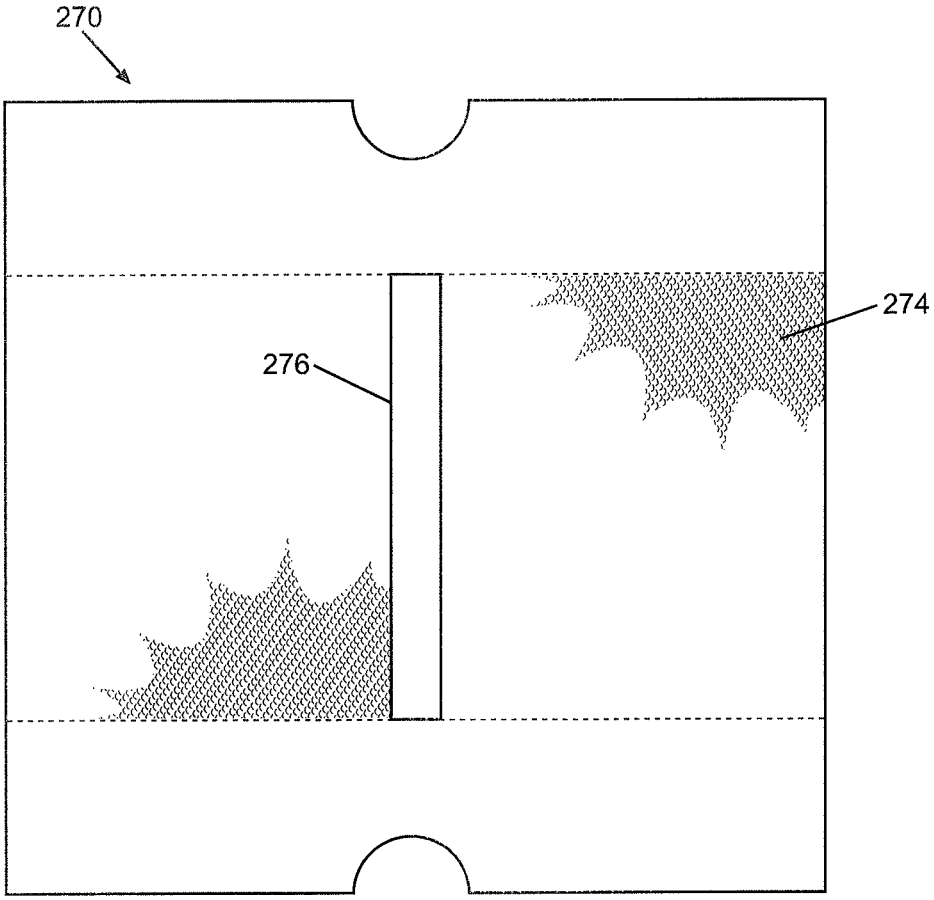
FIG. 81 show the cleaning pad of the alternative embodiment of the tile and grout cleaning system of FIG. 71.

Referring now to FIG. 81, the cleaning pad 270 includes a backing 272 (shown in FIG. 72) with a cleaning surface 274. Formed at the midline of the backing 272 is a brush pass-through 276 for the bristles 286 of the cleaning brush 280 to extend through the cleaning pad to clean an alternative surface at a different level.

Referring back to FIG. 72, the cleaning head 260 is inserted into the recess 282 of the cleaning brush 280. The magnet inserts 266 of the cleaning head 260 are correspondingly located with the magnets 284 of the cleaning brush 280. This allows the magnets to mate and create a magnetic force to keep the cleaning head 260 and cleaning brush 280 coupled. Once coupled, the cleaning pad 270 is wrapped around the assembly and the brush pass-through 276 allows the bristles 286 of the cleaning brush 280 to extend through the cleaning pad 270.

Alternatively, instead of magnets a fastening system may be used wherein one part of the fastener is located on the cleaning head 260 and the corresponding part of the fastener is located on the cleaning brush 280, wherein the mating of the two parts locks the pieces together.

Figure 82:
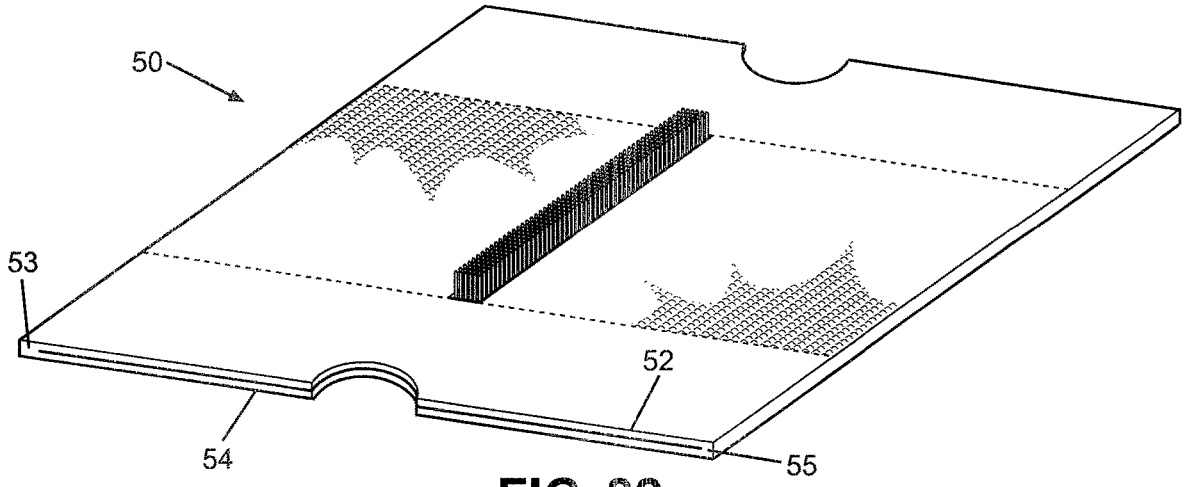
FIG. 82 shows an alternative embodiment of a cleaning pad with brush to clean multiple leveled surfaces simultaneously.
Figure 83:
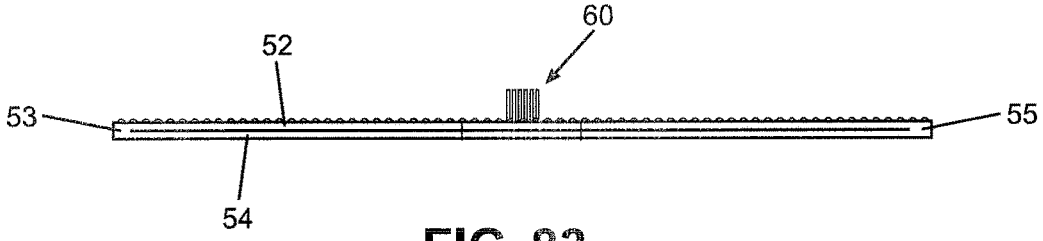
FIGS. 83-85 show several view of the alternative embodiment of the tile and grout cleaning system of FIG. 82.
Figure 84:
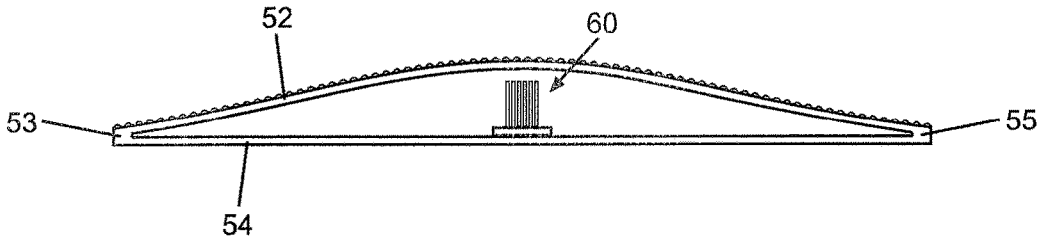
Figure 85:
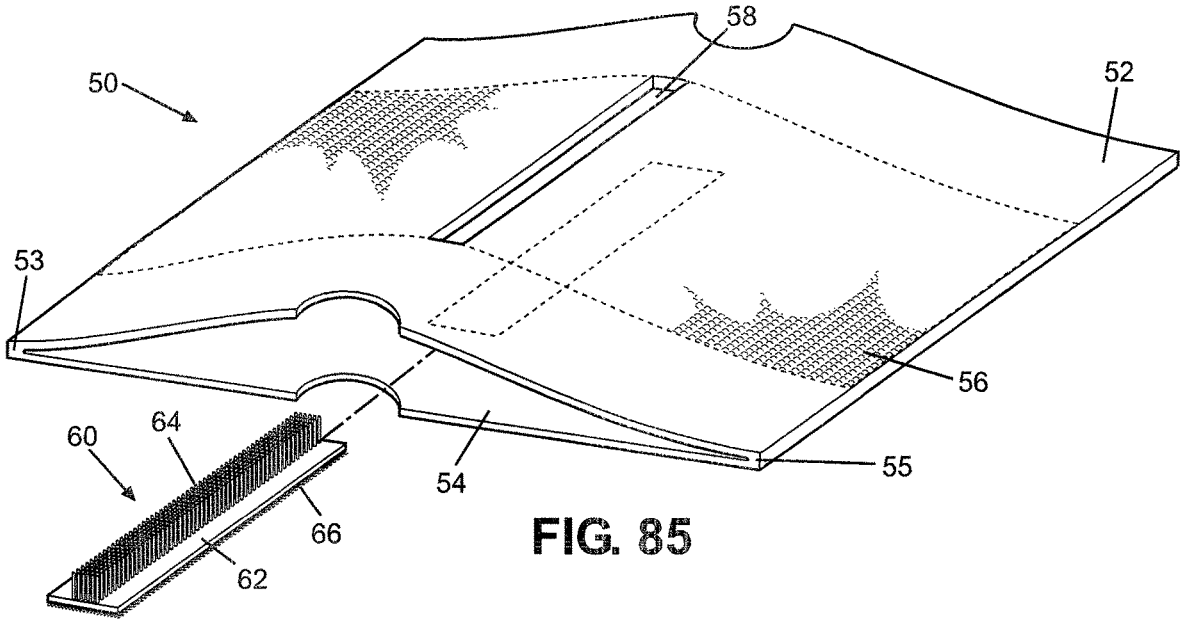
Figure 86:
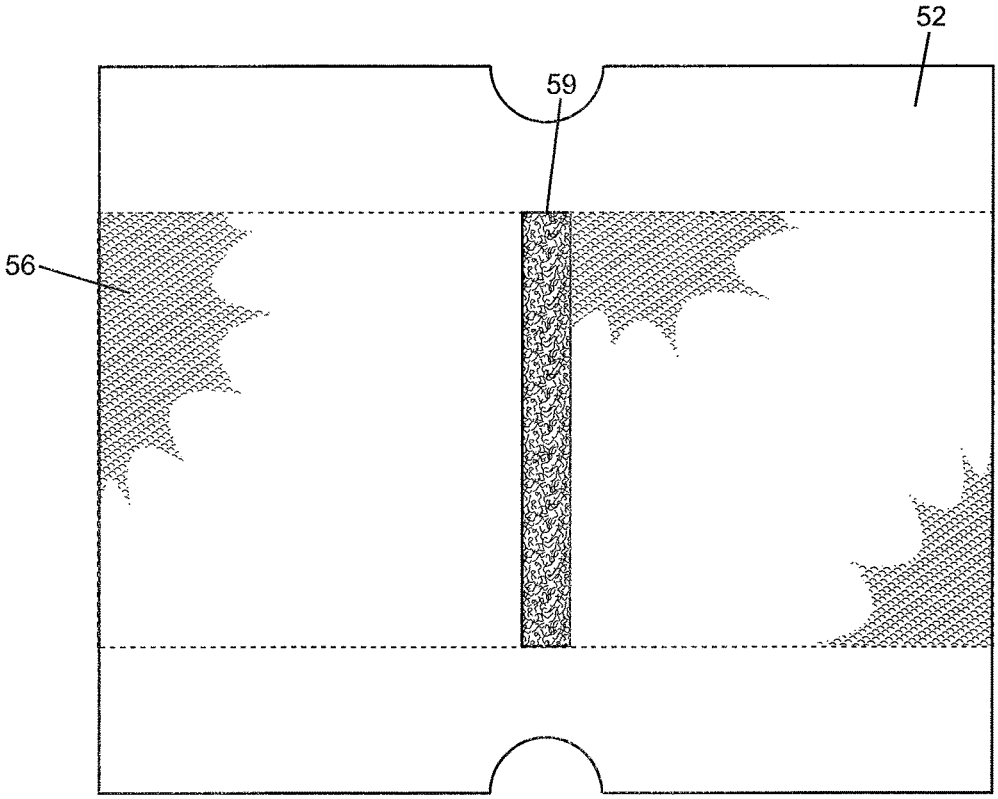
FIG. 86 shows the cleaning pad of the alternative embodiment of the tile and grout cleaning system of FIG. 82.

Referring now to FIG. 82, an alternative embodiment of the cleaning pad is shown and generally designated 50 and includes a removable cleaning brush 60. The cleaning pad 50, described in conjunction with FIGS. 83-86, includes a first layer 52 and a second layer 54 attached together by a first seam 53 and a second seam 55, located on the opposite edge of the first seam 53, leaving two open edges. The open edges allow the first layer 52 and the second layer 54 to be parted along the open edges.

The first layer 52 includes a cleaning surface 56 on the exterior side and a brush pass-through 58 oriented longitudinally at the midpoint of the first layer 52. The brush pass-through 58 is a rectangular hole formed in the first layer. The second layer includes a looped section 59 configured in a rectangular shape. The looped section 59 is size larger than the opening formed by the brush pass-through. This provides more contact surface area for the brush 60 to fasten to. The first layer 52 and second layer 56 are pliable, supple and easily deformable to fit around any currently existing floor cleaning system.

Figure 87:
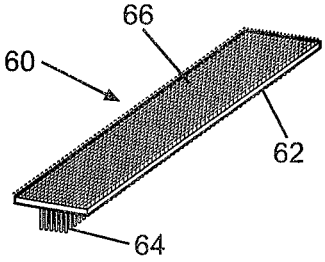
FIGS. 87-89 show the cleaning brush of the alternative embodiment of the tile and grout cleaning system of FIG. 82.
Figure 88:
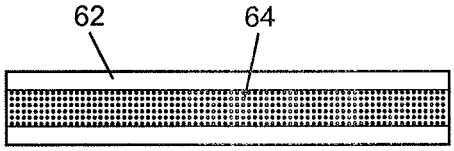
Figure 89:
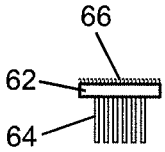

The brush 60, described in conjunction with FIGS. 87-89, includes a base 62 with bristles 64 protruding form one surface and hooks 66 attached on the opposite surface of the base 62. The hooks 66 fasten to the loops of the looped section 59, thereby fastening the brush 60 to the cleaning pad 50. The brush 60 may be attached to the cleaning pad 50 to create a cleaning pad 50 capable of cleaning multiple leveled surfaces simultaneously or may be removed to clean only a single surface.

The cleaning pad 50 and attached brush 60 is designed to be used with any currently existing floor cleaning systems having a fastening system. The deformable nature of the cleaning pad 50 allows the cleaning pad to adapt to the various shapes of the currently existing fastening system as well as attach itself to these systems.

Figure 90:
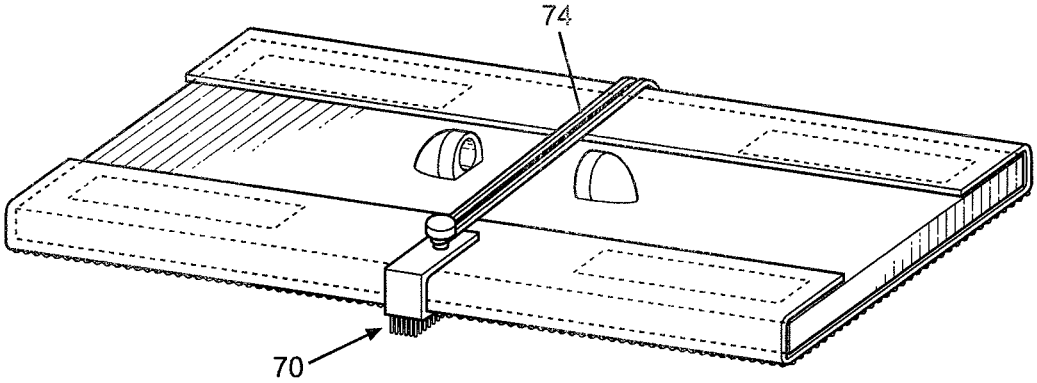
FIG. 90 show an alternative embodiment of an attachable cleaning brush.
Figure 91:
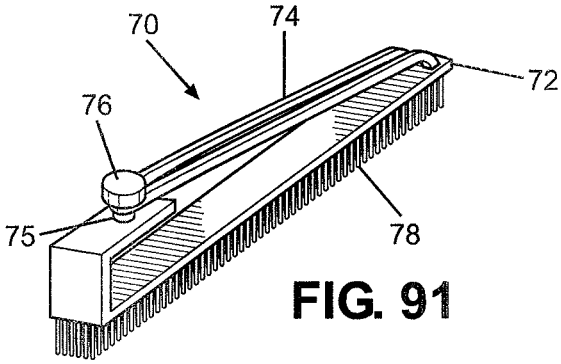
FIGS. 91-96 show various view of the alternative embodiment of the tile and grout cleaning system of FIG. 90.
Figure 92:
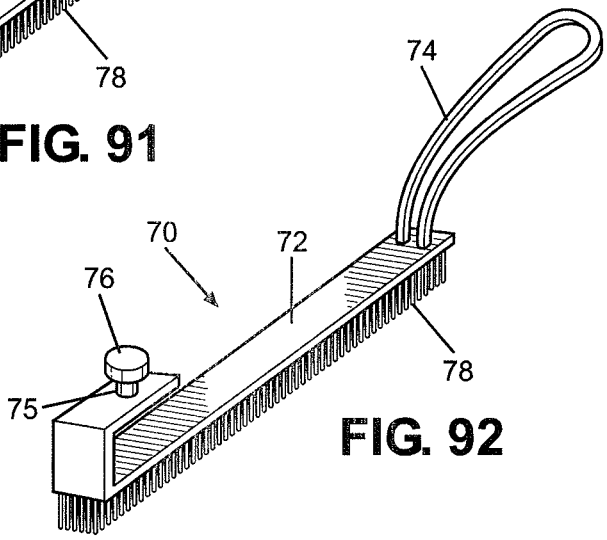
Figure 93:
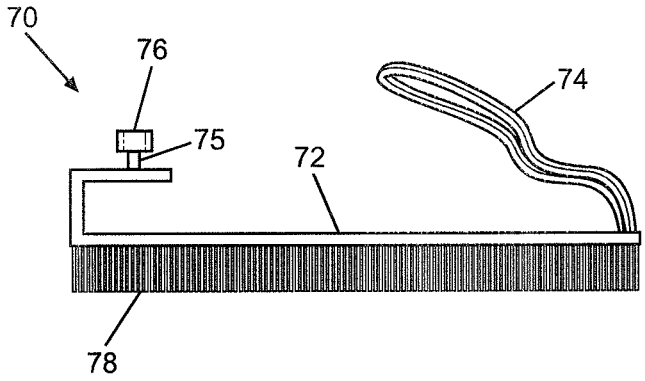
Figure 94:
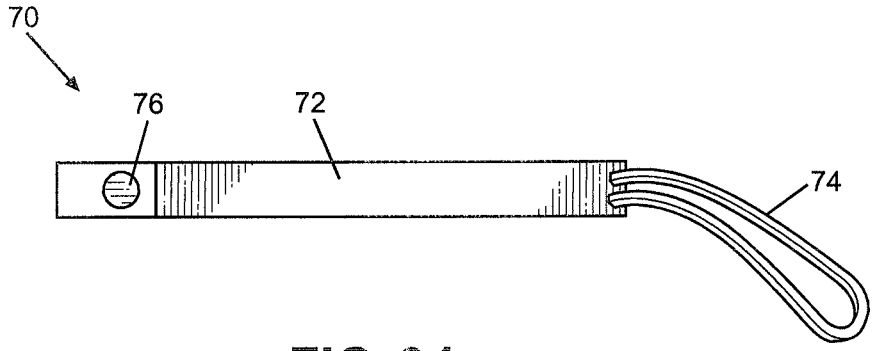
Figure 95:
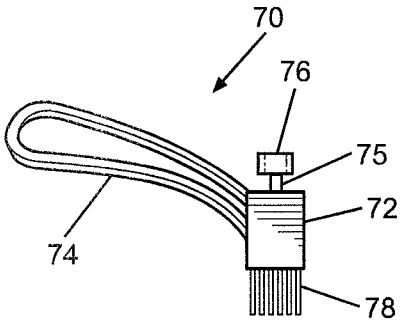
Figure 96:
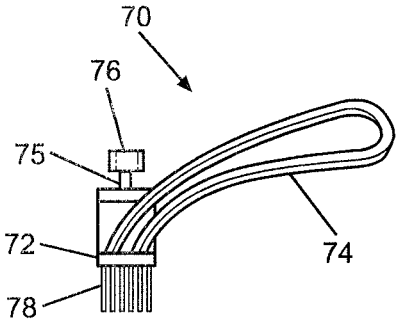

Referring now to FIG. 90, an alternative embodiment of the cleaning brush is shown attached to a currently existing cleaning system and is generally designated 70. The cleaning brush, described in conjunction with FIGS. 91-96, includes a base 72 having the shape of an elongated J-hook. Protruding from the hook portion of the base 72 is a pin 75 with an enlarged circular disk 76 attached to the end. Attached to the base 72, opposite the hook end, is an elastic cord 74. The elastic cord 74 is capable of stretching from its resting length to an elongated length to wrap around the pin 75 with the circular disk 76 ensuring the elastic cord 74 from slipping off the pin 75. Protruding from the base 72, opposite the surface with the hook and the elastic cord 74, is a plurality of bristles 78.

The cleaning brush 70 is designed to be used with any currently existing floor cleaning systems with a disposable pad. The cleaning brush 70 is a stand-alone, removable brush that can be removably attached to any preexisting floor cleaning system with a disposable pad. The cleaning brush 70 attaches directly to the preexisting floor cleaning system without the need for any modifications. As the elastic cord 74 stretches and couples itself to the pin 75 it forms a closed loop. This allows the cleaning brush 70 to be secured to any preexisting cleaning system.

The shape of the base 72 is not meant to be limiting and may be any shape which may promote the use of the cleaning brush with preexisting cleaning systems. Additionally, the use of various other attachment means alternate to the elastic cord may be use such as an adjustable loop and fastener system or various other types of fastening means.

Figure 97:
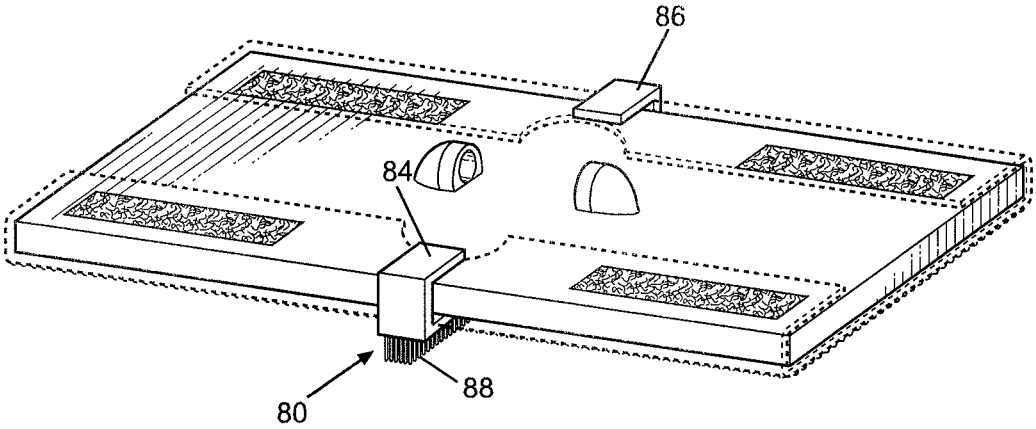
FIG. 97 shows an alternative embodiment of an attachable cleaning brush.
Figure 98:
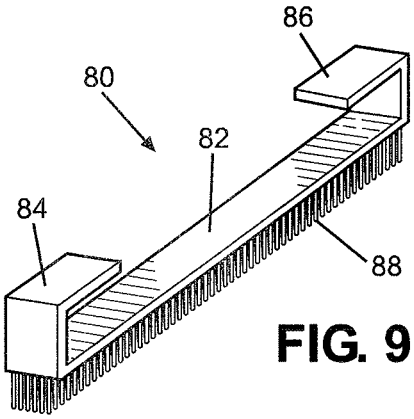
FIGS. 98-103 show various view of the alternative embodiment of the tile and grout cleaning system of FIG. 97.
Figure 99:
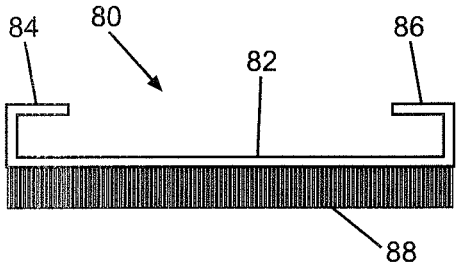
Figure 100:
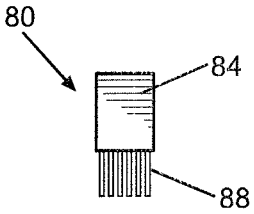
Figure 101:
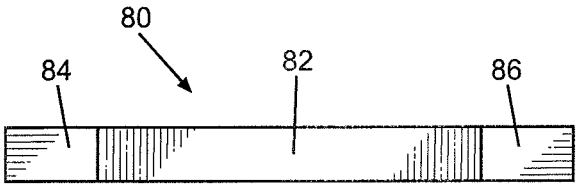
Figure 102:
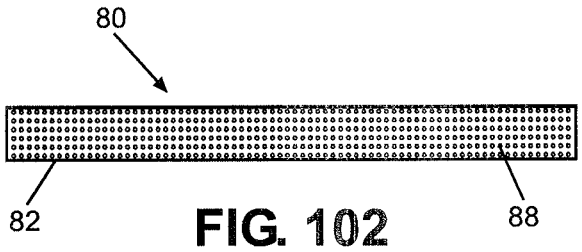

Referring now to FIG. 97, an alternative embodiment of the cleaning brush is shown attached to a currently existing cleaning system and is generally designated 80. The cleaning brush, described in conjunction with FIGS. 98-102, includes a base 82 with a general rectangular shape having a first hook 84 formed at one end and a second hook 86 formed at the opposite end. Protruding from the base 82, opposite the surface with the first hook 84 and the second hook 86 is a plurality of bristles 88.

Figure 103:
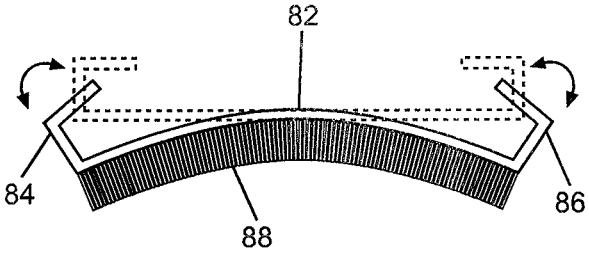

Referring now to FIG. 103, the base 82 of the cleaning brush 80 is generally rigid with elastic characteristics. As shown, when force is applied to the first hook 84 and the second hook 86, the base 82 bends and creates a separation distance between the first hook 84 and the second hook 86. Removal of the force allows the base 82 to return to its original shape. By having elastic characteristics, the first hook 84 and the second hook 86 may be separated and clipped around a preexisting floor cleaning systems with a disposable pad.

Figure 104:
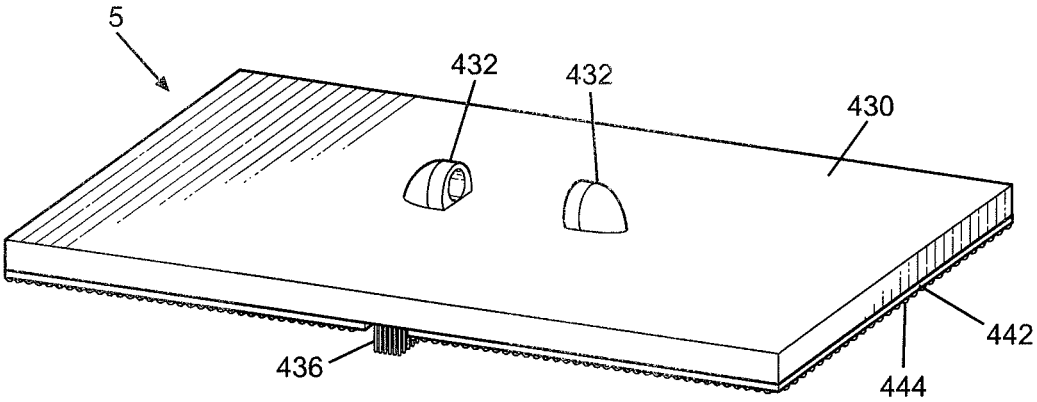
FIG. 104 shows an alternative embodiment of the tile and grout cleaning system.
Figure 105:
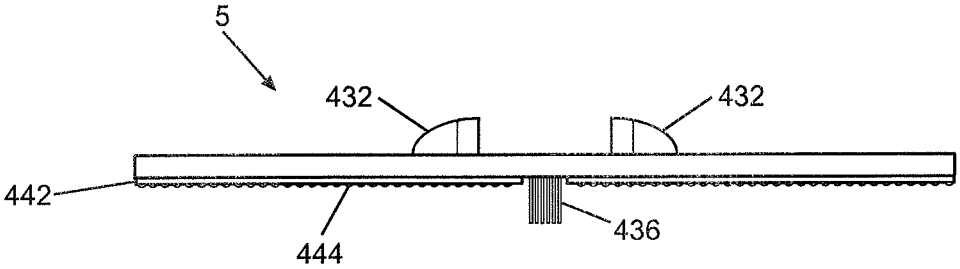
FIG. 105-106 show various views of the alternative embodiment of the tile and grout cleaning system of FIG. 104.
Figure 106:
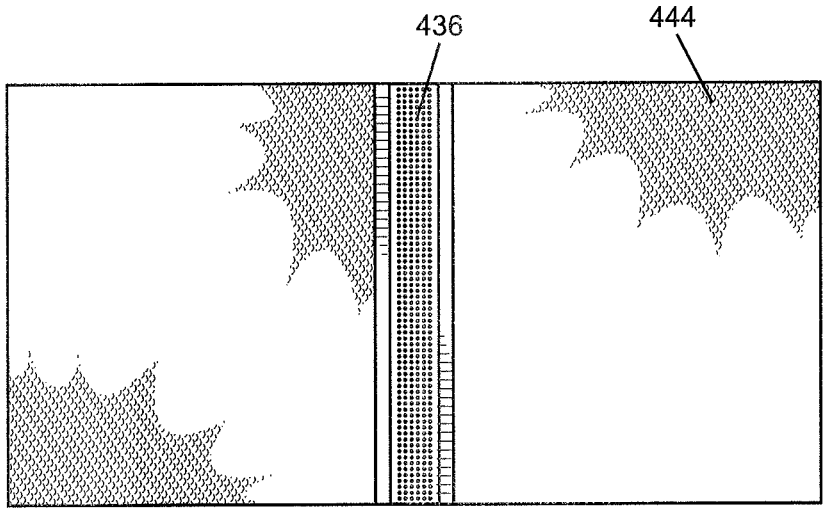
Figure 107:
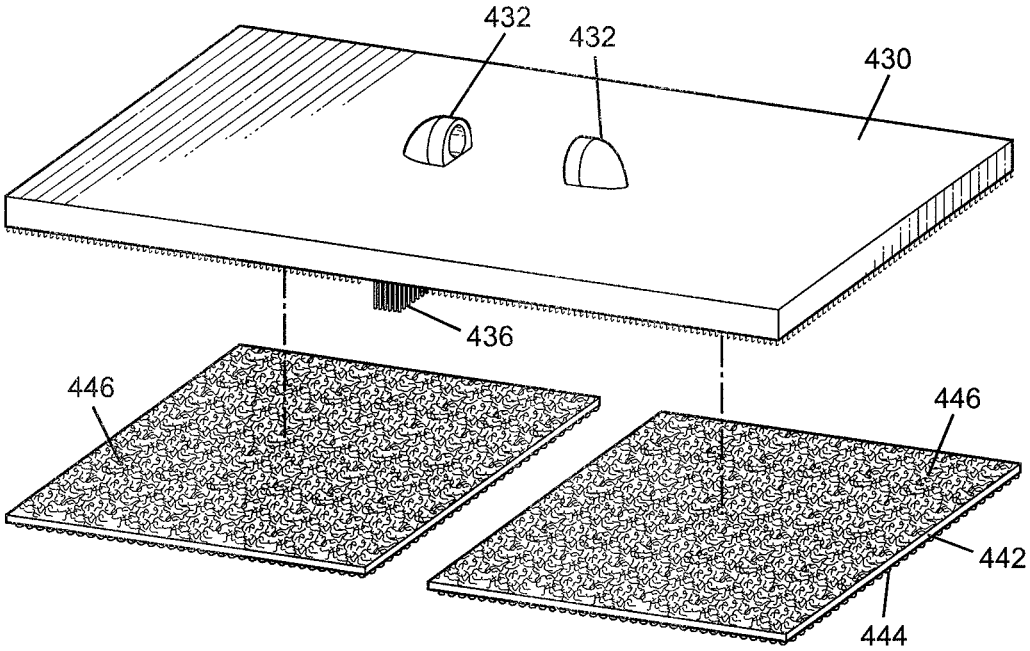
FIG. 107 is an exploded view of the alternative embodiment of the tile and grout cleaning system of FIG. 104.

Referring now to FIG. 104, in conjunction with FIGS. 104-107, an alternative embodiment of the Tile and Grout Cleaning System is shown and generally designate 5. The Tile and Grout Cleaning System includes a cleaning head 430 and removable cleaning pads 440. The cleaning head 430 is generally rectangular shaped and has a handle attachment 432 on one surface and on the opposite surface of the cleaning head 430 at the midpoint is a plurality of bristles 436 protruding from the cleaning head. Surrounding the bristles is a plurality of hooks 434. The cleaning pads 440 include a backing 442 with loops 446 covering one surface and a cleaning surface 444 covering the opposite surface. The loops 446 fasten to the hooks 434 of the cleaning head 430 to provide the cleaning of multiple leveled surfaces simultaneously.

Figure 108:
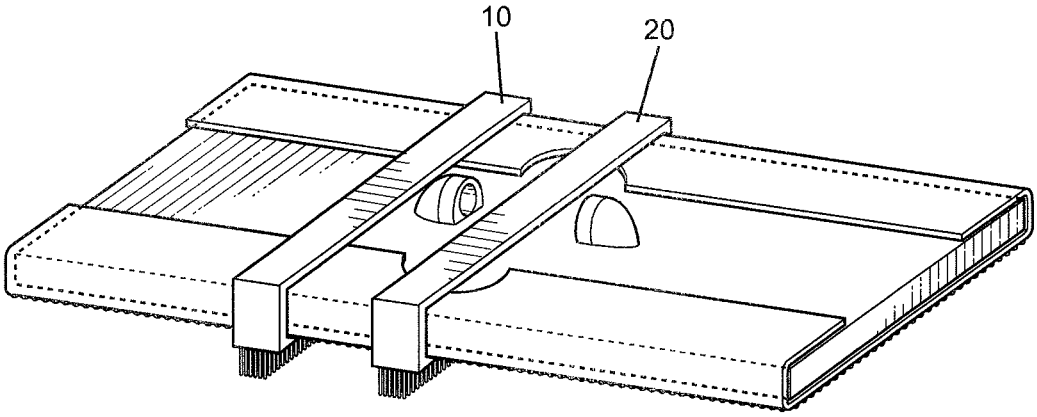
FIG. 108 shows an alternative embodiment of the attachable brush.
Figure 109:
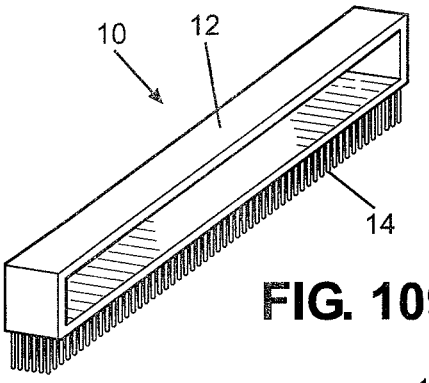
FIGS. 109-112 show various views of the attachable brush of FIG. 108.
Figure 110:
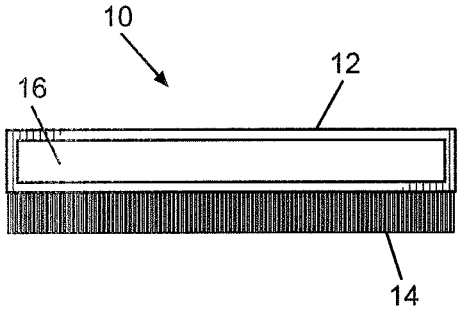
Figure 111:
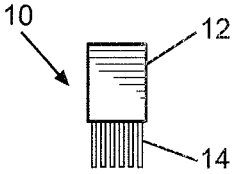
Figure 112:
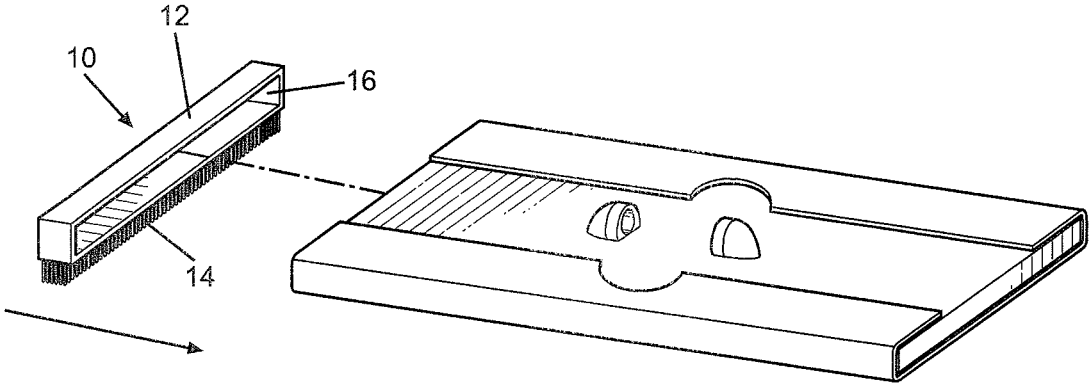
Figure 113:
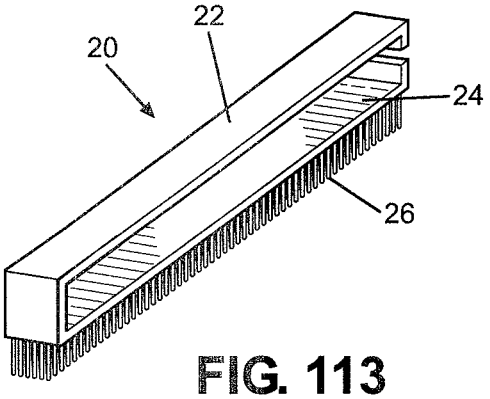
FIGS. 113-117 show various views of an alternative embodiment of the attachable brush.
Figure 114:
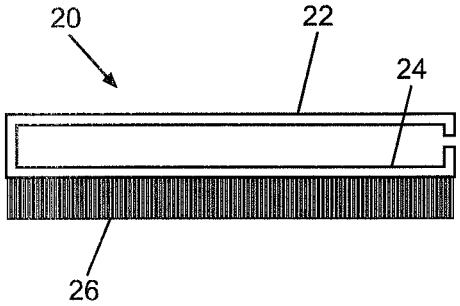
Figure 115:
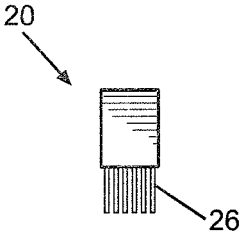
Figure 116:
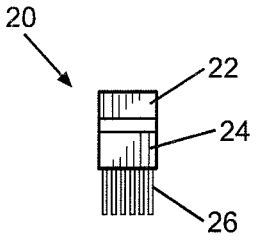
Figure 117:
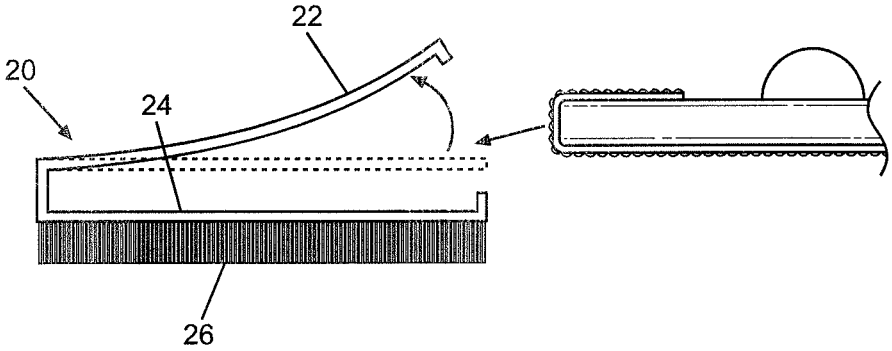

Referring now to FIG. 108, an alternative embodiment of a cleaning brush 10 and another alternative embodiment of the cleaning brush 20 is shown attach to a currently existing floor cleaning system. Cleaning brush 10, described in conjunction with FIGS. 109-112, includes a body 12 having a rectangular bore 16 extending through. Attached to a surface of the body and extending outwards are bristles 14. The rectangular bore 16 of the body 12 allows the cleaning brush 10 to be slid over an existing floor cleaning system to provide the ability to clean multiple leveled surfaces simultaneously.

Referring now to FIGS. 113-117, the cleaning brush 20 includes a first clamp jaw 22 and a second clamp jaw 24 integrally formed together. At one end, the first clamp jaw 22 and a second clamp jaw 24 are joined together whereas at the opposite end of the first clamp jaw 22 and the second clamp jaw 24 are not connected. This leaves the ability for the first clamp jaw 22 and the second clamp jaw 24 to be parted at the open end to be fitted over an object, such as currently existing floor cleaning systems. Attached to the second clamp jaw 24 and protruding outwards is a plurality of bristles 26.

Figure 118:
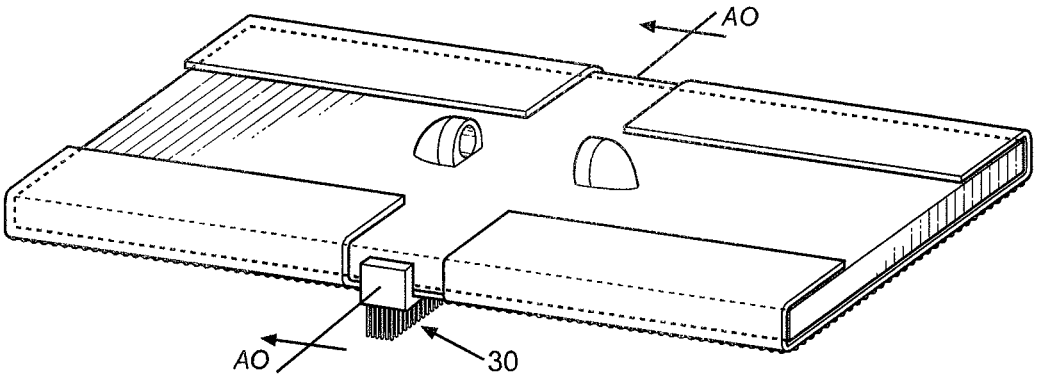
FIG. 118 is shows an alternative embodiment of the attachable brush.

Referring now to FIG. 118 an alternative embodiment of a cleaning brush 30 is shown attached to a currently existing a floor cleaning system. The cleaning brush 30 attaches directly to a cleaning pad of currently existing floor cleaning systems and provide guide tabs to center the brush under the floor cleaning system. This allows the use of the cleaning brush 30 with currently existing products to enable the cleaning of multiple leveled surfaces simultaneously.

Figure 119:
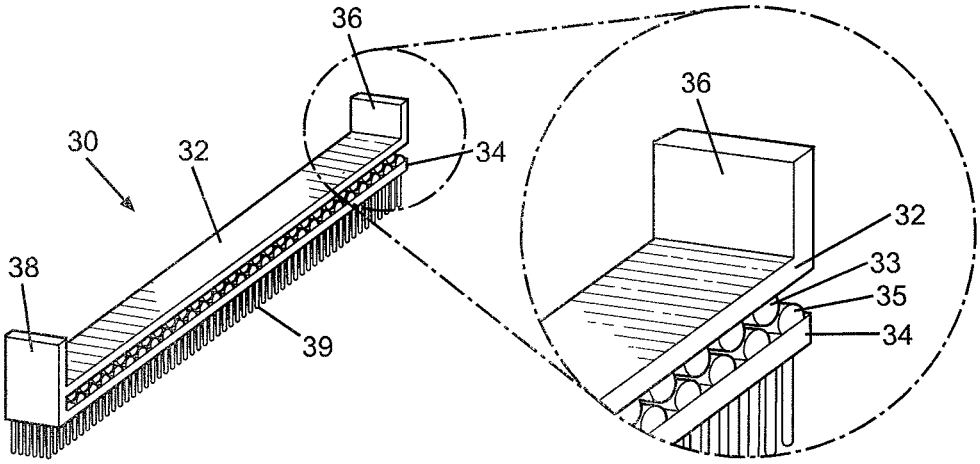
FIGS. 119-123 show various views of the attachable brush of FIG. 118.
Figure 120:
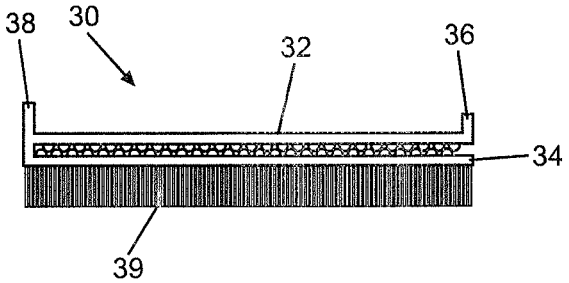

Referring now to FIGS. 119 and 120, the cleaning brush 30 includes an upper jaw 32 and a lower jaw 34. The upper jaw 32 and lower jaw 34 are formed with a plurality of teeth 33 and 35, respectively. The teeth 33 of the upper jaw 32 and the teeth 35 of the lower jaw 34 are both point inwards and interlock. The upper jaw 32 and lower jaw 34 are joined together at one end by second guide tab 38. On the opposite end of the upper jaw 32, first guide tab 36 is attached and protrudes outward from the upper jaw 32. The first guide tab 36 does not extend to the lower jaw 34 which keeps the upper jaw 32 and lower jaw 34 disconnected at that end. Attached to the exterior of the lower jaw, opposite of teeth 35 are bristles 39.

Figure 121:
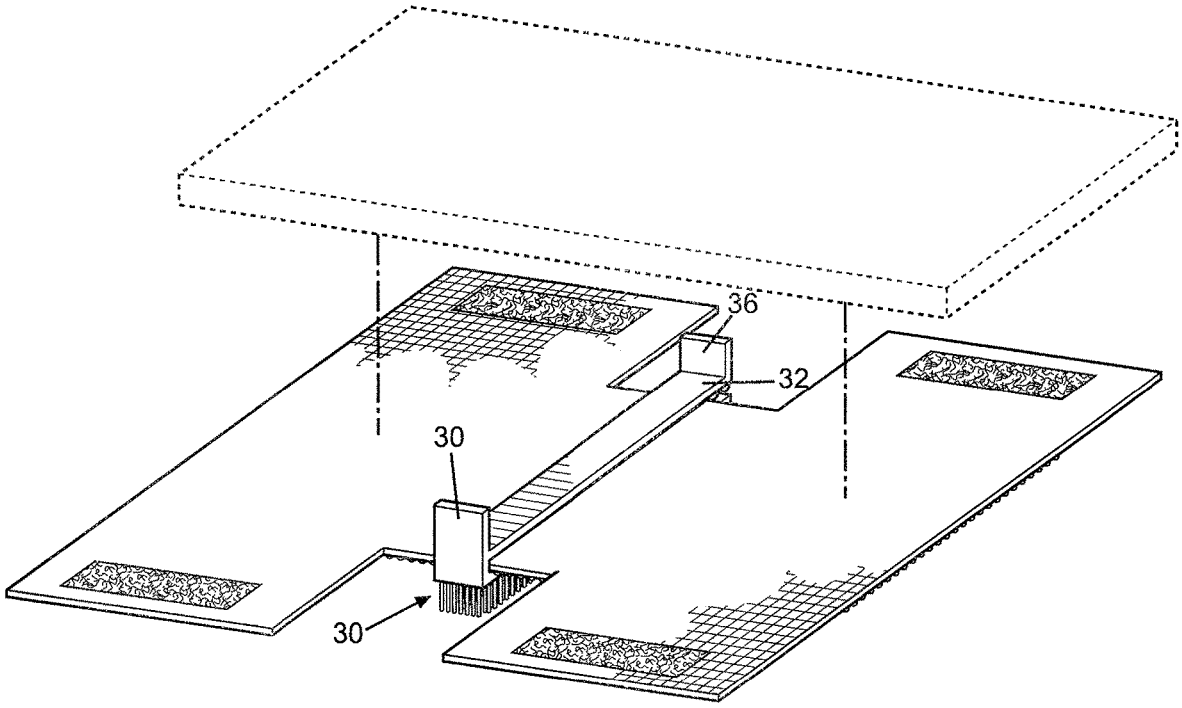
Figure 122:
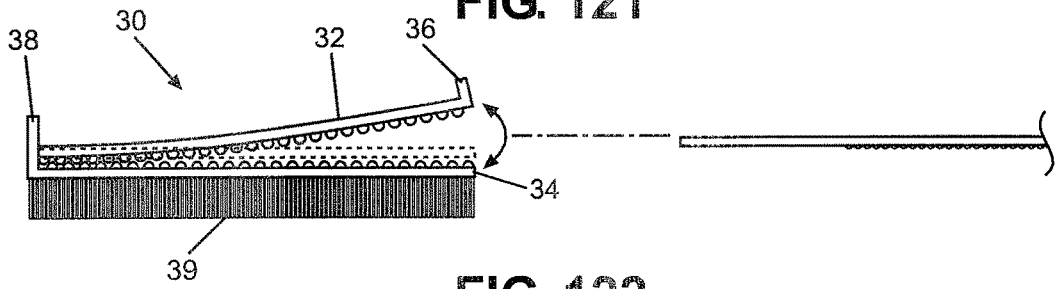

Referring now to FIG. 121, the brush 30 is shown attached to the cleaning pad. As shown in FIG. 122, the brush 30 is attached to the cleaning pad by separating the upper jaw 32 and the lower jaw 34. The brush 30 is made from a riding material having elastic properties. As a result, separating apart the upper jaw 32 and lower jaw 34 does not permanently deform the brush 30. By separating the upper jaw 32 and the lower jaw 34 a gap is creating between which allows the cleaning pad to be inserted between the upper jaw 32 and the lower jaw 34. Upon releasing the upper jaw 32 and the lower jaw 34, they clamp onto the cleaning pad. The interlocking of teeth 33 and teeth 35 ensures a tight clamp on the cleaning pad. Once the brush is attached to the cleaning pad, the cleaning pad with brush 30 is then attached to the cleaning head. The first guide tab 36 and second guide tab 38 ensures the cleaning pad with brush 30 is centered with the cleaning head when attached.

Figure 123:
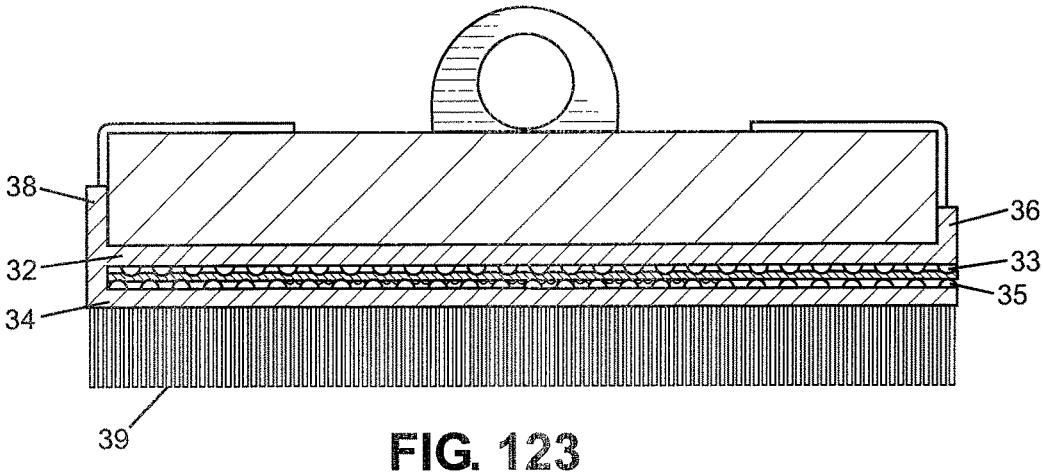

Referring now to FIG. 123, a cross-sectional view of the cleaning brush 30 attached to the cleaning pad and cleaning head taken along line AO-AO of FIG. 118 is shown. As shown, the brush 30 is attached to the cleaning pad by inserting the cleaning pad between the upper jaw 32 and the lower jaw 34. Teeth 33 and teeth 35 ensure the upper jaw 32 and lower jaw 34 have a tight grip on the cleaning pad. The cleaning head is aligned between the first guide tab 36 and second guide tab 38. In addition to providing the correct orientation and placement of the brush 30, the first guide tab 36 and second guide tab 38 serve as barrier to prevent the brush 30 from moving relative to the cleaning pad and cleaning head. The first guide tab 36 and second guide tab 38 prevents the horizontal forces resulting from brushing the brush 30 back and forth to clean.

Figure 124:
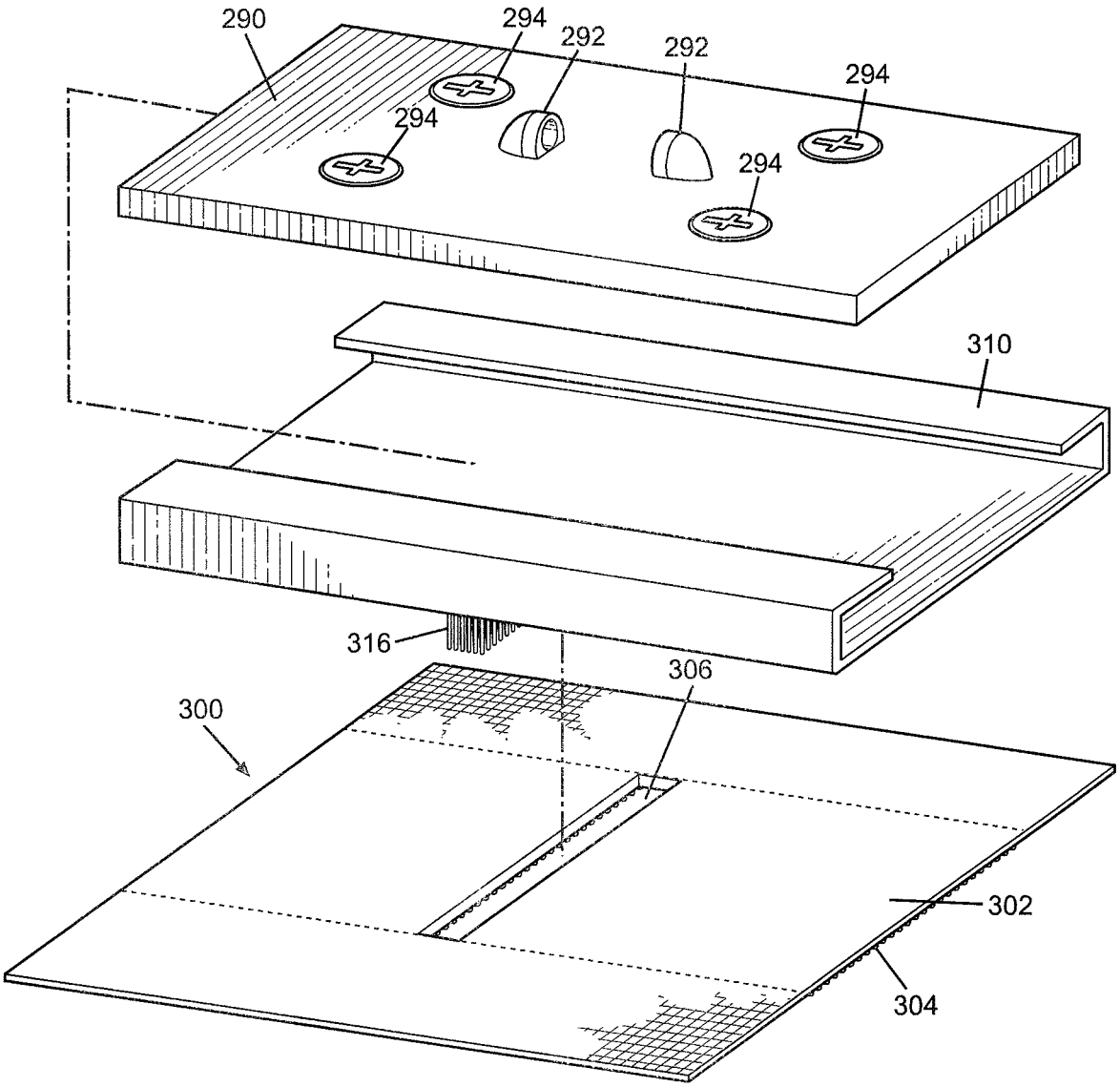
FIG. 124 shows an exploded view of alternative embodiment of the tile and grout cleaning system.
Figure 125:
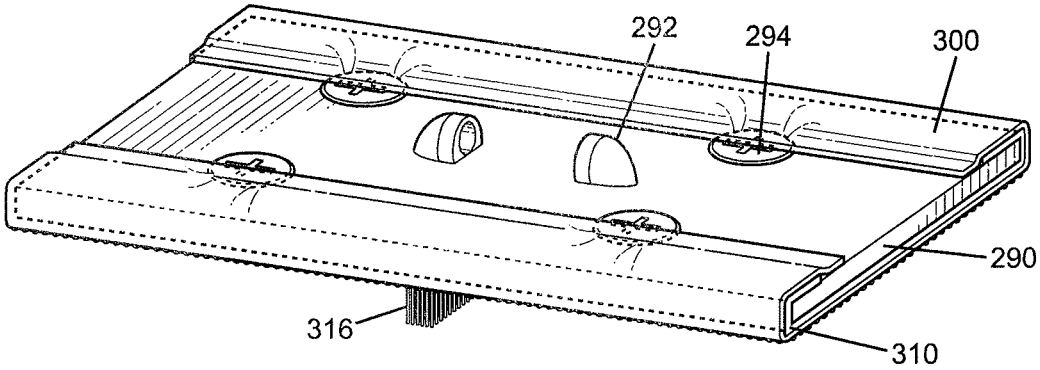
FIGS. 125 and 126 show a perspective view of the alternative embodiment of the tile and grout cleaning system of FIG. 124.
Figure 126:
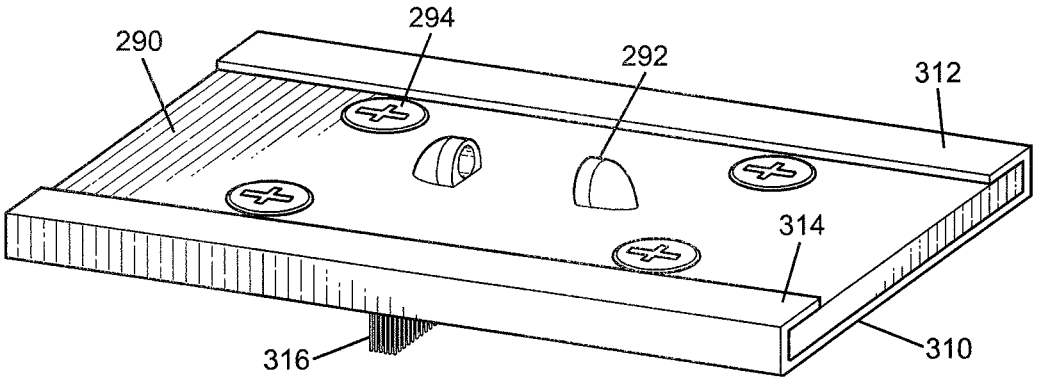
Figure 127:
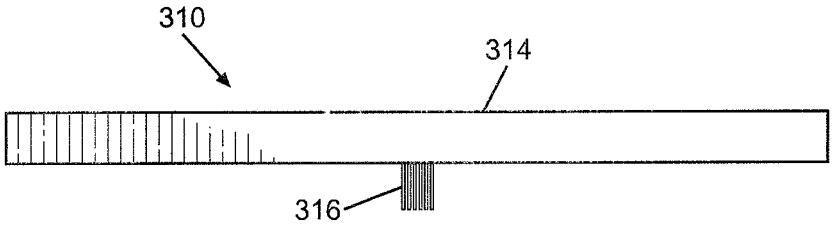
FIGS. 127-130 show the cleaning brush of the alternative embodiment of the tile and grout cleaning system of FIG. 124.
Figure 128:
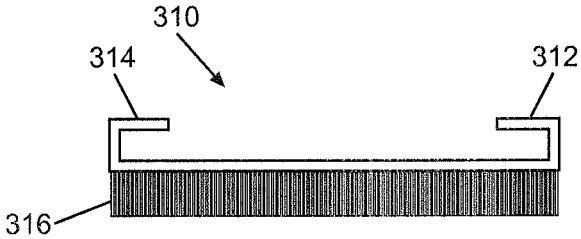
Figure 129:
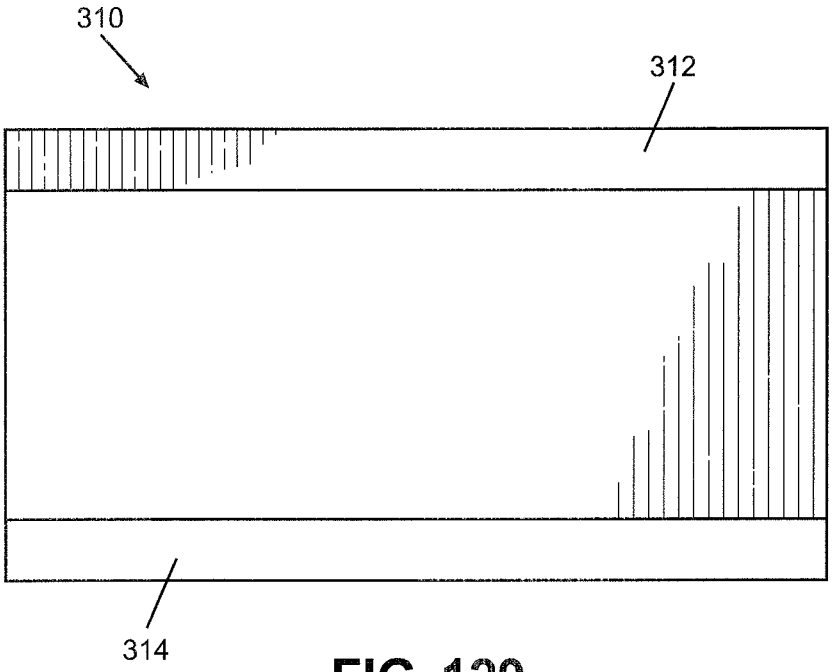
Figure 130:
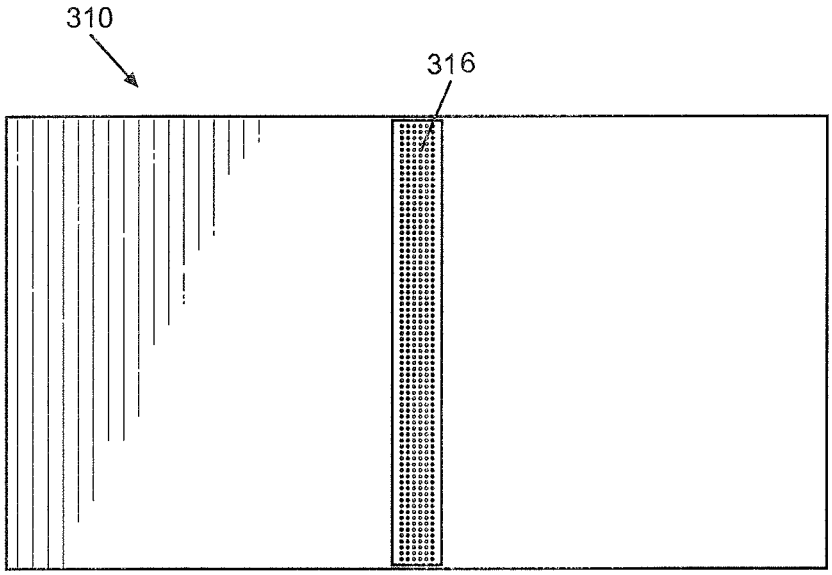

FIG. 124 is an exploded view showing an alternative embodiment of a cleaning head 290, a cleaning pad 300, and a cleaning brush 310 detached from one another. FIG. 125, shows the cleaning head 290 is inserted within the cleaning brush 310 and the cleaning pad 300 wrapped around the cleaning head 290 and the cleaning brush 310 to provide a cleaning head capable of cleaning multiple leveled surfaces simultaneously.

The cleaning head 290 is generally rectangular shaped and includes a plurality of gripper 294 and handle mounts 292 formed into the top surface of the cleaning head 290. The cleaning pad 300 includes a backing 302 with a cleaning surface 304. Formed at the midline of the backing 302 is a brush pass-through 306 for the bristles 316 of the cleaning brush 310 to extend through the cleaning pad 300 to clean an alternative surface at a different level.

Referring now to FIGS. 126-130, the cleaning brush 310 is shown formed as a U-channel with a first ledge 312 and a second ledge 314. Opposite the first ledge 312 and the second ledge 314 on the cleaning brush 310 is a plurality of bristles 316 formed into the cleaning brush 310. Referring back to FIG. 125, the cleaning head 290 is inserted into the cleaning brush 310 formed w a U-channel with a first ledge 312 and a second ledge 314. The first ledge 312 and the second ledge 314 in conjunction with the U-channel surrounds the cleaning head 290 locking the cleaning head 290 to the cleaning brush 310. Once locked, the cleaning pad 300 is wrapped around the assembly and secured in place.

Figure 131:
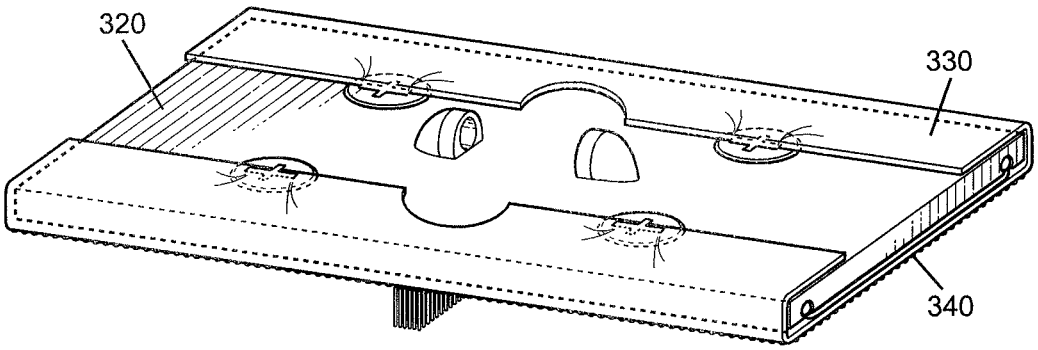
FIG. 131 shows an alternative embodiment of the tile and grout cleaning system.
Figure 132:
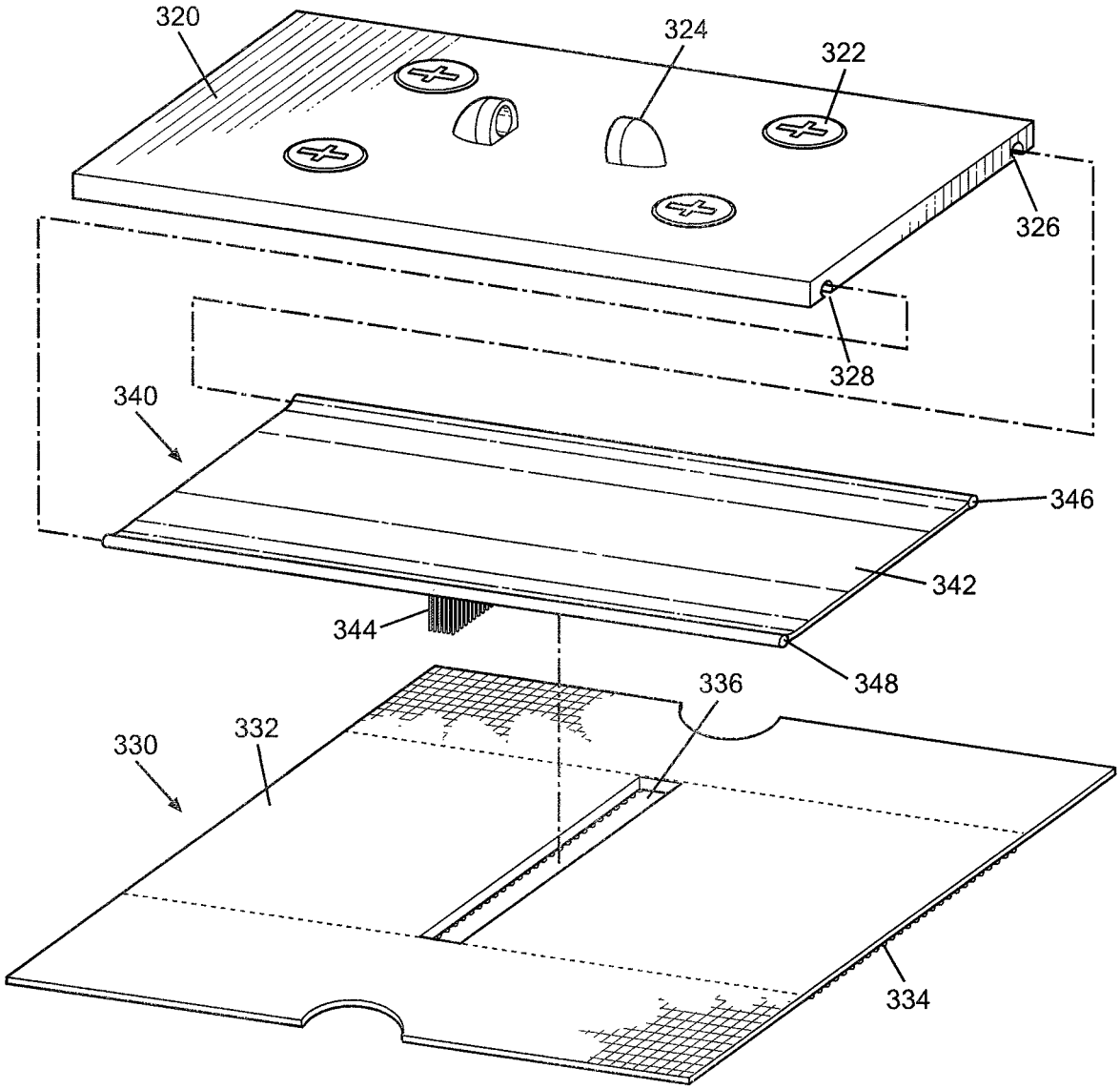
FIG. 132 is an exploded view of the alternative embodiment of the tile and grout cleaning system of FIG. 131.
Figure 133:
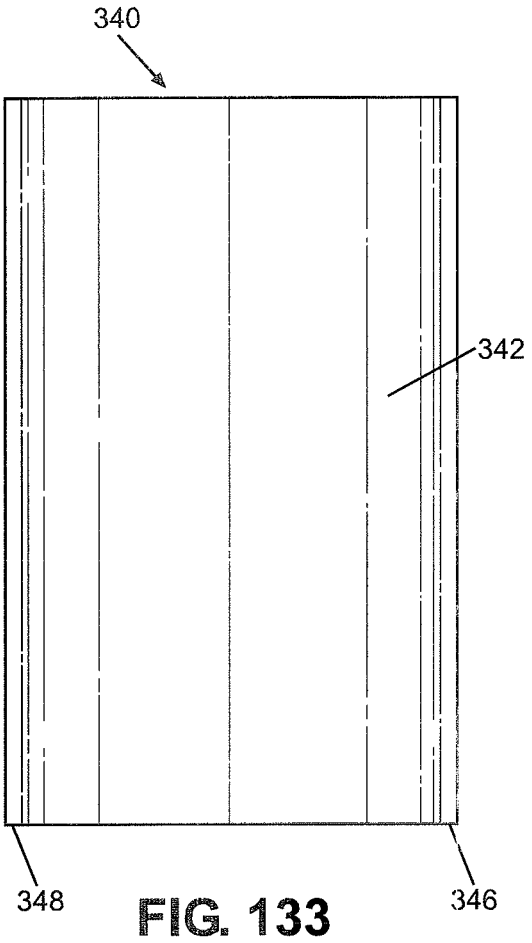
FIGS. 133-136 show the cleaning brush of the alternative embodiment of the tile and grout cleaning system of FIG. 131.
Figure 134:
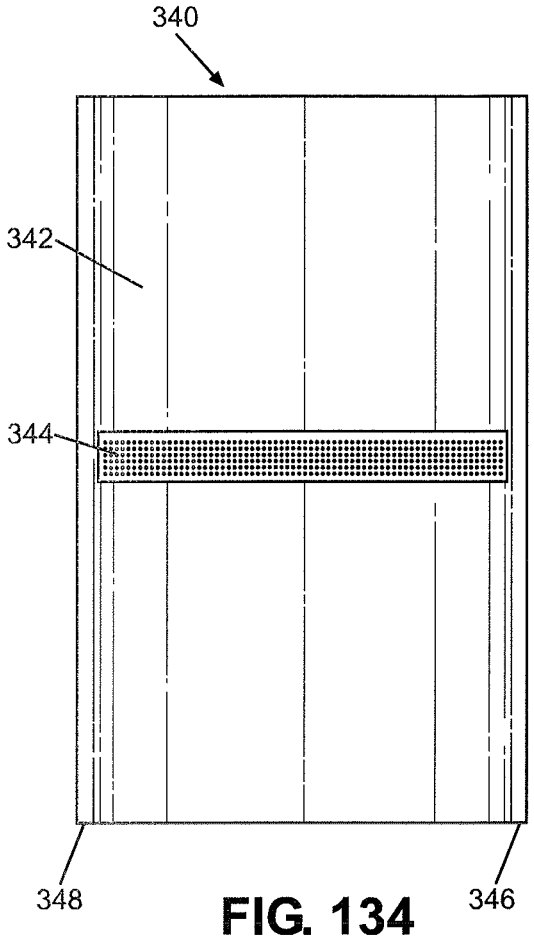
Figure 135:
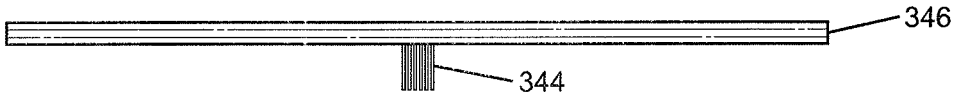
Figure 136:
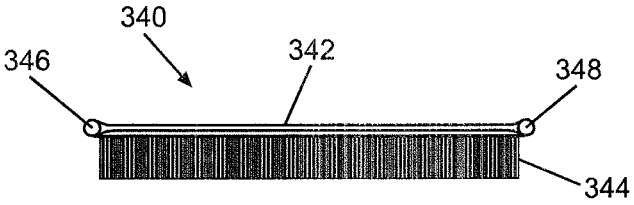

Referring now to FIG. 131 an alternative embodiment of the cleaning head 320, the cleaning pad 330 and the cleaning brush 340 is shown. FIG. 132 shows an exploded view with the cleaning head 320, the cleaning pad 330 and the cleaning brush 340 detached from one another.

The cleaning head 320 has a general rectangular shaped. On one surface of the cleaning 320, handle mounts 324 and a plurality of grippers 322 are formed. Opposite the handle mounts 324 and a plurality of grippers 322, a first channel 326 and a second channel 328 is formed into the cleaning head. The first channel 326 and the second channel 328 has a general circular shape which extends all the way through the body. The cleaning pad 330 includes a backing 332 with a cleaning surface 334 and a brush pass-through 336.

The cleaning brush 340, described in conjunction with FIGS. 133-136 includes a body 342 with a first bead 346 attached longitudinal to the body 342 and a second bead 348 attached longitudinal to the body 342 on the opposite end. A plurality of bristles 344 is formed into the body 342. The first bead 346 and the second bead 348 are inserted into the first channel 326 and the second channel 328, respectively, to secure the cleaning brush 340 to the cleaning head 320. Once secured, the cleaning pad 330 is wrapped around the assembly.

Figure 137:
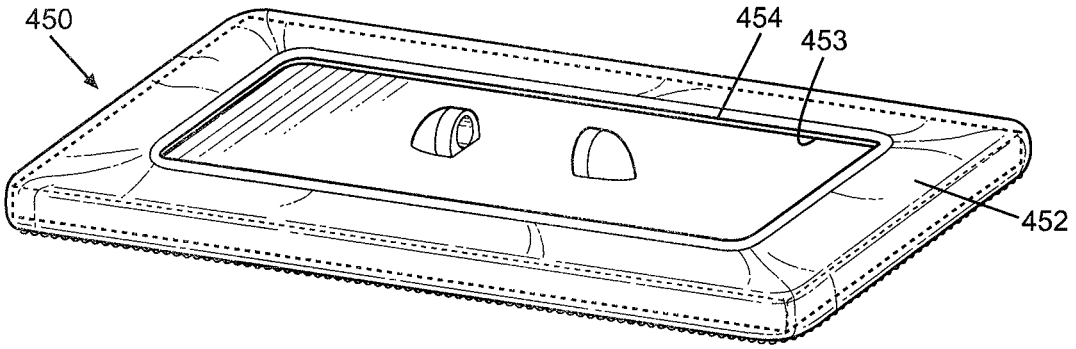
FIG. 137 shows an alternative embodiment of the tile and grout cleaning system.
Figure 138:
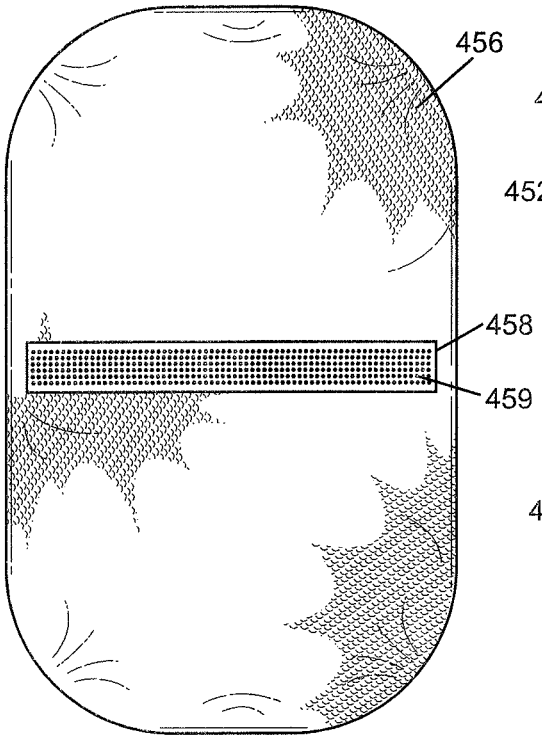
FIG. 138-141 shows the cleaning pad of the alternative embodiment of the tile and grout cleaning system of FIG. 137.
Figure 139:
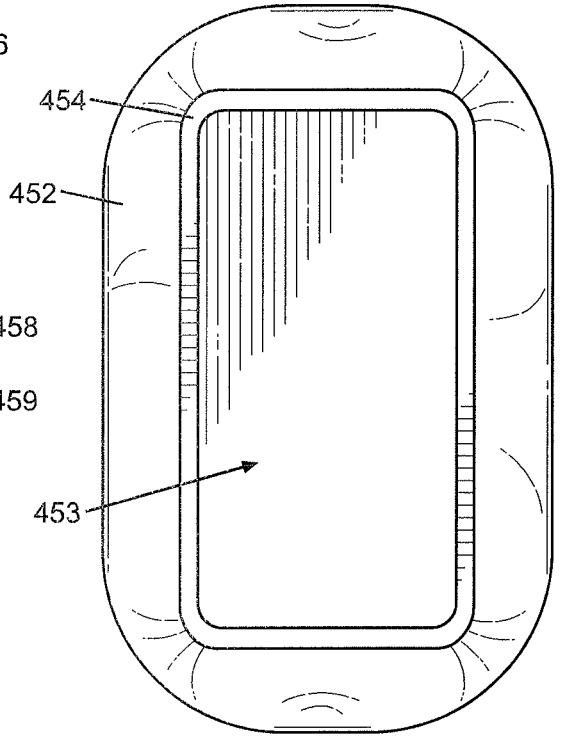
Figure 140:
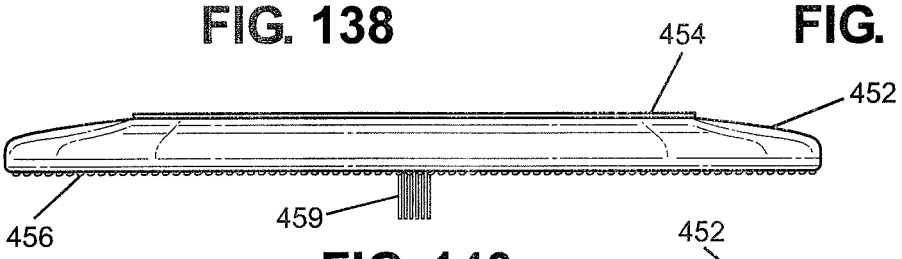
Figure 141:
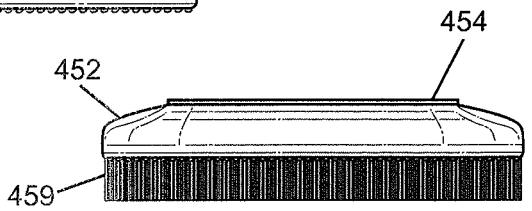

Referring now to FIG. 137, an alternative embodiment of a cleaning pad is shown and generally designated 450. The cleaning pad 450, described in conjunction with FIGS. 138-141, includes an elastic container 452 having an opening 453 surrounded by an elastic band 454. Formed onto a surface of the elastic container 452 is a cleaning surface 456. Disposed towards the midpoint of the elastic container 452 and attached is a brush base 458 with bristles 459. The brush base 458 with bristles 459 is disposed on the same side as the cleaning surface 456. This enables the cleaning pad 150 to clean multiple leveled surfaces simultaneously.

The elastic container 452 is expandable and may alter its shape to fit over currently existing cleaning heads and the elastic band 454 stretches to accommodate different sizes as well. The elastic properties of the elastic container 452 and the elastic band 454 allow them to stretch when force is acted on the elastic container 452 and the elastic band 454. Removing the force contracts the elastic container 452 and the elastic band 454 to its normal size. With a larger object, such as the cleaning head, present within the elastic container 452 the force of the elastic container 452 returning to its natural size firmly grasps the object placed within.

Figure 142:
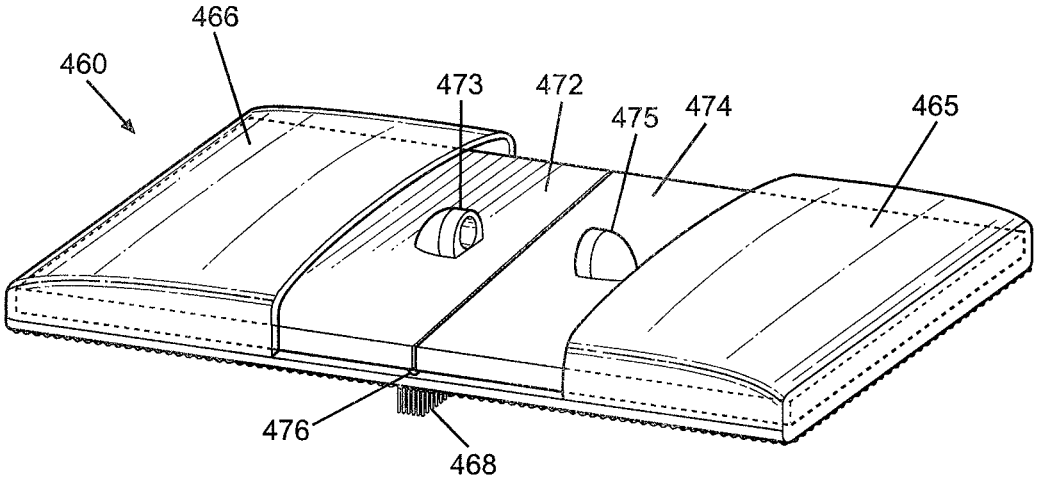
FIG. 142 shows an alternative embodiment of the tile and grout cleaning system.
Figure 143:
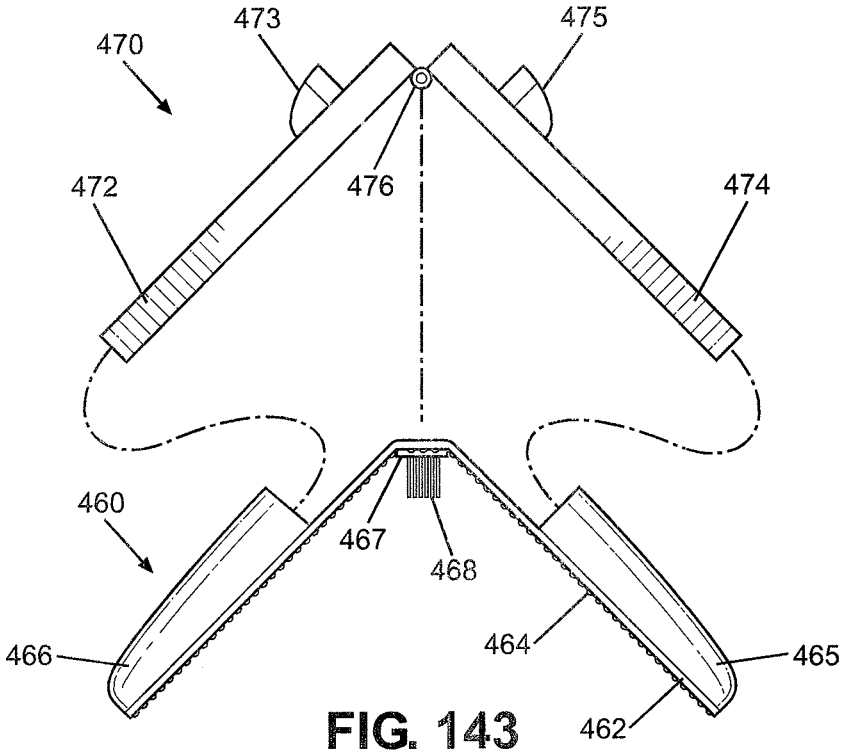
FIG. 143 is an exploded view of the alternative embodiment of the tile and grout cleaning system of FIG. 142.
Figure 144:
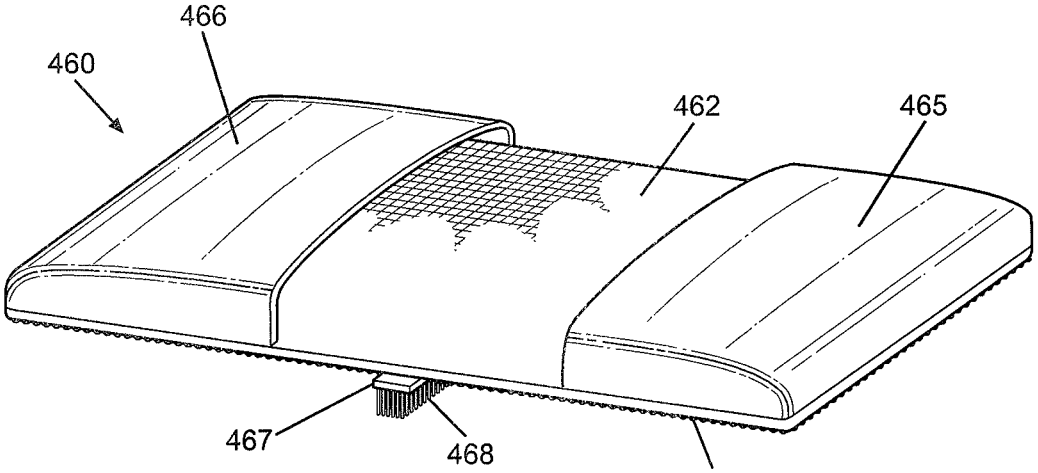
FIGS. 144-148 show the cleaning pad of the alternative embodiment of the tile and grout cleaning system of FIG. 142.
Figure 145:
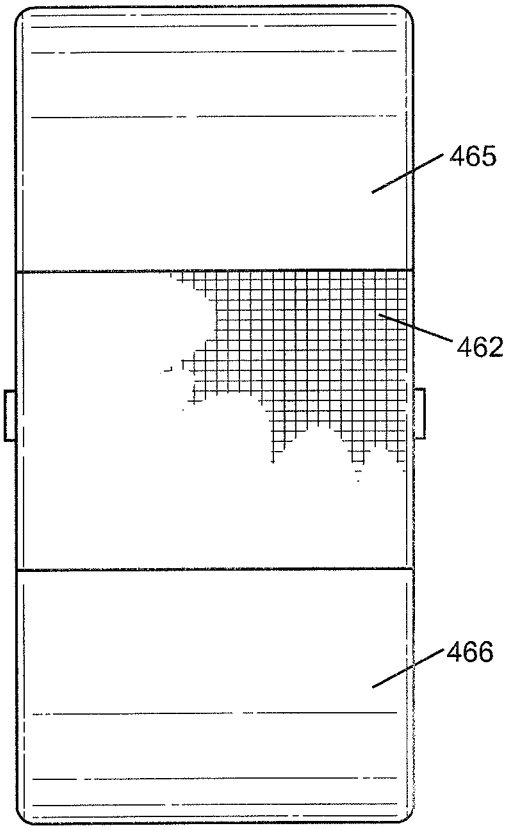
Figure 146:
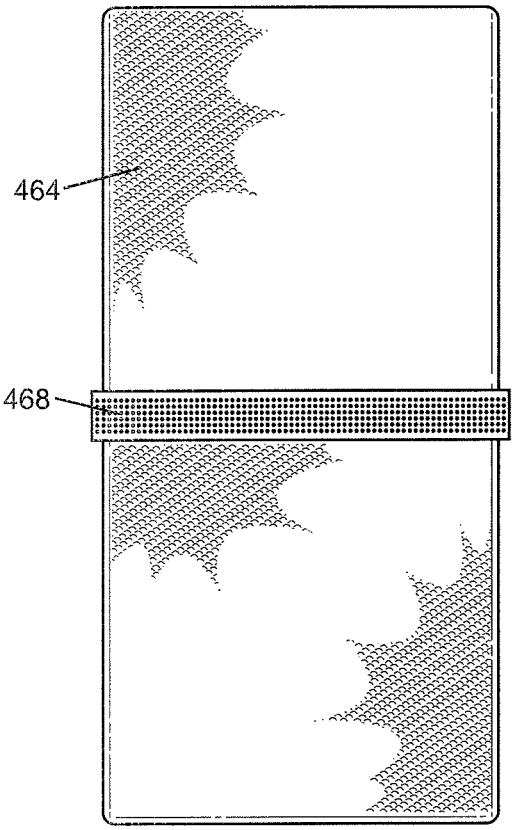
Figure 147:
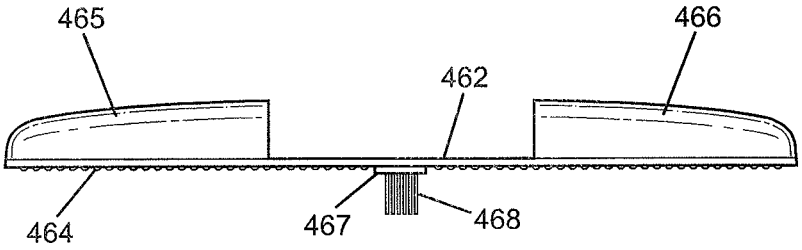
Figure 148:
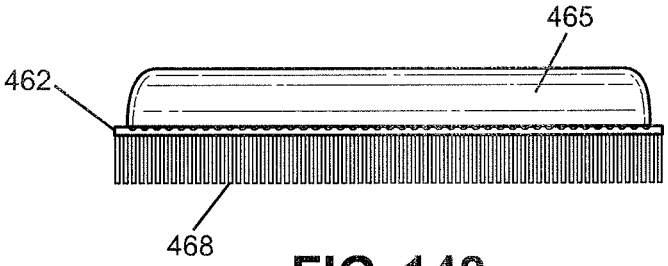

Referring now to FIG. 142, an alternative embodiment of the cleaning pad is shown and generally designated 460. The cleaning pad 460 is used in conjunction with a deformable cleaning head 470. The deformable cleaning head 470, described in conjunction with FIG. 143, includes a first section 472 and a substantially similar second section 474. The first section 472 has a first handle attachment 473 and the second section 474 has a corresponding second handle attachment 475. The first handle attachment 473 and the second handle attachment 475 provide a mounting point for a handle. The first section 472 and the second section 474 are pivotally attached together by a hinge mechanism 476. The hinge mechanism 476 allows the first section 462 and the second section 474 to pivot relative to one another.

Referring now to FIGS. 144-148, the cleaning pad 460 includes a semi-rigid flexible backing 462 having a cleaning surface 464. Attached to the midpoint of the backing 462 on the surface with the cleaning surface 464, a brush base 467 with attached bristles 468 is attached. Located on the opposite surface of the backing 462 are a first retainer 465 and a second retainer 466. The first retainer 465 and second retainer 466 are generally rectangular shaped with four sides, of the four sides three sides are attached to the backing 462. The first retainer 465 is attached to the backing 462 at one end of the backing 462 where the non-attached side of the first retainer is oriented towards the center of the backing 462. The second retainer 466 is attached to the backing 462 opposite the first retainer 465 on the backing 462 where the non-attached side of the first retainer is oriented towards the center of the backing 462 and the first retainer 465. The openings of the first retainer 465 and the second retainer 466 allow an object to be inserted and held in place.

Referring back to FIG. 143, the backing 462 is sized slightly larger than the footprint of the cleaning head 470 and the first retainer 465 and the second retainer 466 are sized to accommodate the dimensions of the cleaning head 470. This enables the cleaning head 470 to fit tightly within the cleaning pad 460 and secured in place.

To insert the cleaning head 470 into the cleaning pad 460, the first section 472 and the second section 474 are pivoted relative to each along the hinge assembly 476. This shortens the edge to edge distance of the cleaning head 470 to allow insertion of the first section 472 into the second retainer 466 and the second section 474 into the first retainer 465. To fully insert the cleaning head 470 into the cleaning pad 460, the backing 462 of the cleaning is slightly bent to accommodate the varying angles of the first section 472 and the second section 474 as it is inserted into the cleaning pad 460. Once fully inserted, the first section 472 and the second section 474 lies flat against the backing 462 of the cleaning head and are ready to be used.

Figure 149:
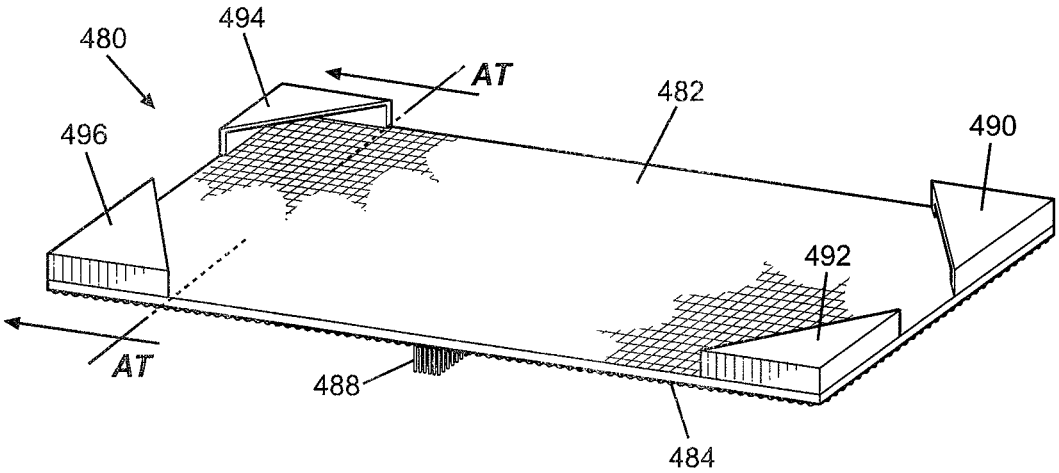
FIG. 149 is an alternative embodiment of the cleaning pad.
Figure 150:
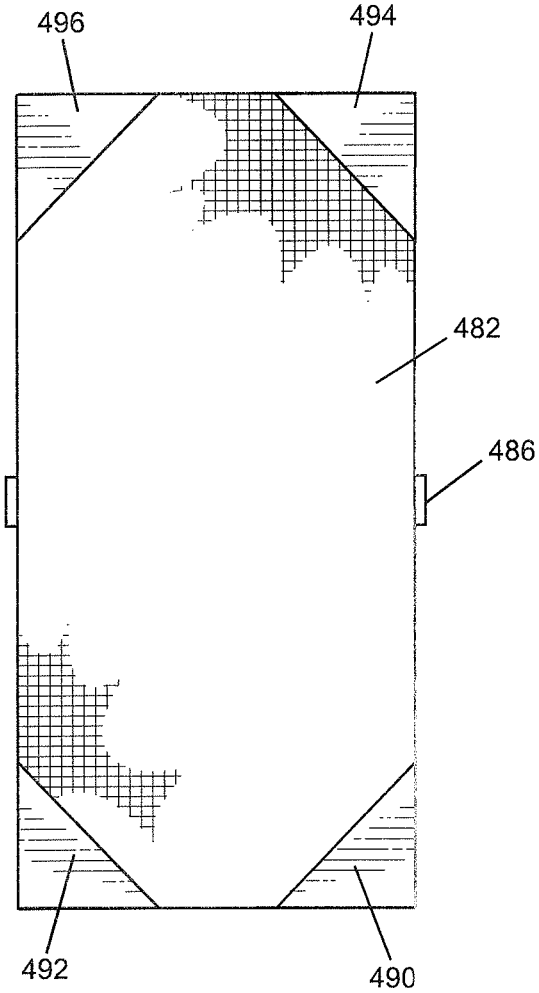
FIGS. 150-152 show various views of the cleaning pad of FIG. 149.
Figure 151:
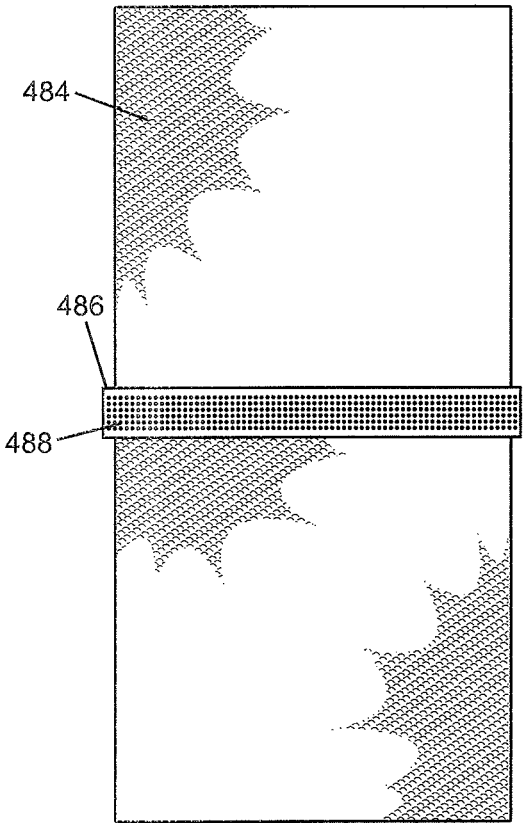
Figure 152:
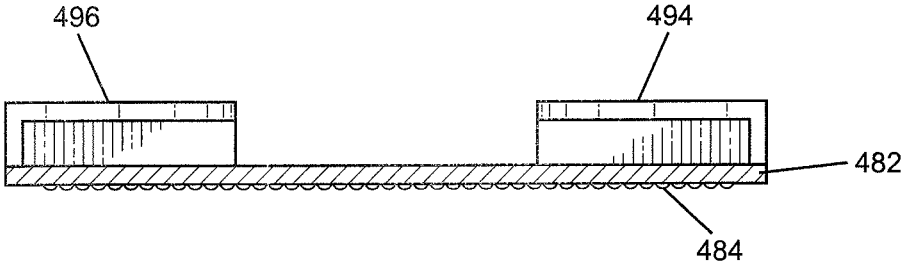

Referring now to FIG. 149, an alternative embodiment of the cleaning pad for use with the cleaning head 470 is shown and generally designated 480. The cleaning pad 480, described in conjunction with FIGS. 148-152 includes a semi-rigid flexible backing 482 having a cleaning surface 484. Attached to the midpoint of the backing 482 on the surface with the cleaning surface 484, a brush base 486 with attached bristles 488 is attached. Located on the opposite surface of the backing 482 are a first retainer 490, a second retainer 492, a third retainer 494 and a fourth retainer 496. The first retainer 490, the second retainer 492, the third retainer 494 and the fourth retainer 496 are generally triangular shaped with three sides, of the three sides two sides are attached to the backing 482. Each of the retainers, 490, 492, 494 and 496 are attached to each corner of the backing 482, with the edge oriented towards the center of the backing 482 unattached. The openings of the retainers, 490, 492, 494 and 496 allow the cleaning head 470 to be attached.

Alternatively, the first retainer 490, the second retainer 492, the third retainer 494 and the fourth retainer 496 may be made of elastic material which allows each of the retainers to be stretched to a point where a currently existing cleaning head may be inserted and retained therein.

Figure 153:
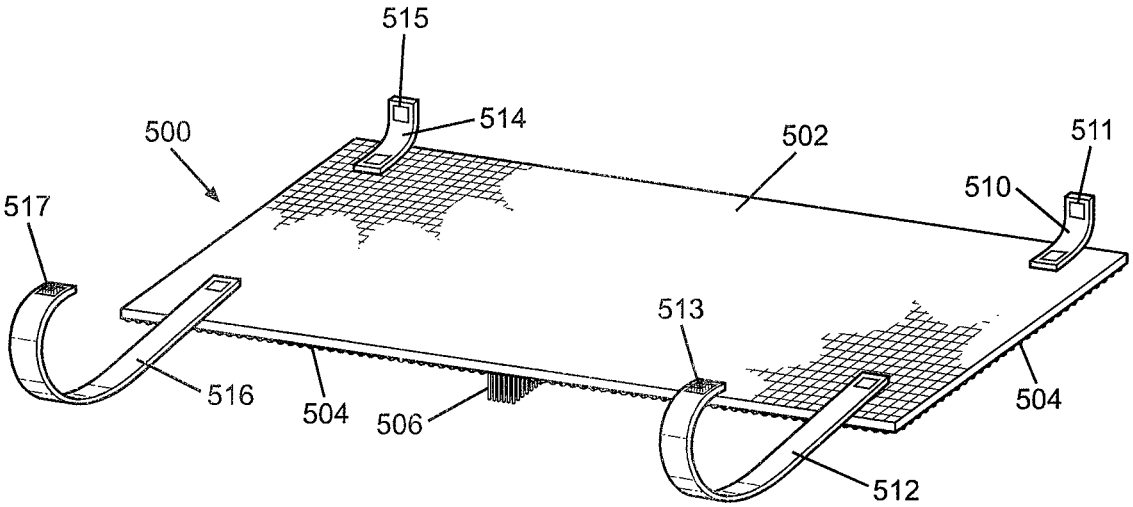
FIG. 153 is an alternative embodiment of the cleaning pad.

Referring now to FIG. 153, an alternative embodiment of the cleaning pad is shown and generally labeled 500. The cleaning pad 500 includes a semi-rigid flexible backing 502. Attached to the midpoint of the backing 502 is a plurality of bristles forming a brush 506. On either side of the brush 506 is a cleaning surface 504. This allows the cleaning pad 500 to clean multiple leveled surfaces simultaneously. Located on the opposite surface of the backing 502 are a first retaining strap 510 with loops 511 and a corresponding second retaining strap 512 with hooks 513. The hooks 513 of the second retaining strap 512 hooks into the loops 511 of the first retaining strap 510 mates to create a closed loop. A third retaining strap 514 with loops 515 and a corresponding fourth retaining strap 516 with hooks 517 are attached to the backing 502 as well. The hooks 517 of the fourth retaining strap 516 hooks into the loops 515 of the third retaining strap 514 mates to create a closed loop. The cleaning pad 500 is strapped to a cleaning head by mating the retaining straps together. Other methods of fastening the retaining straps are contemplated such as snap lock fasteners, buttons, and other mechanical type fasteners.

Figure 154:
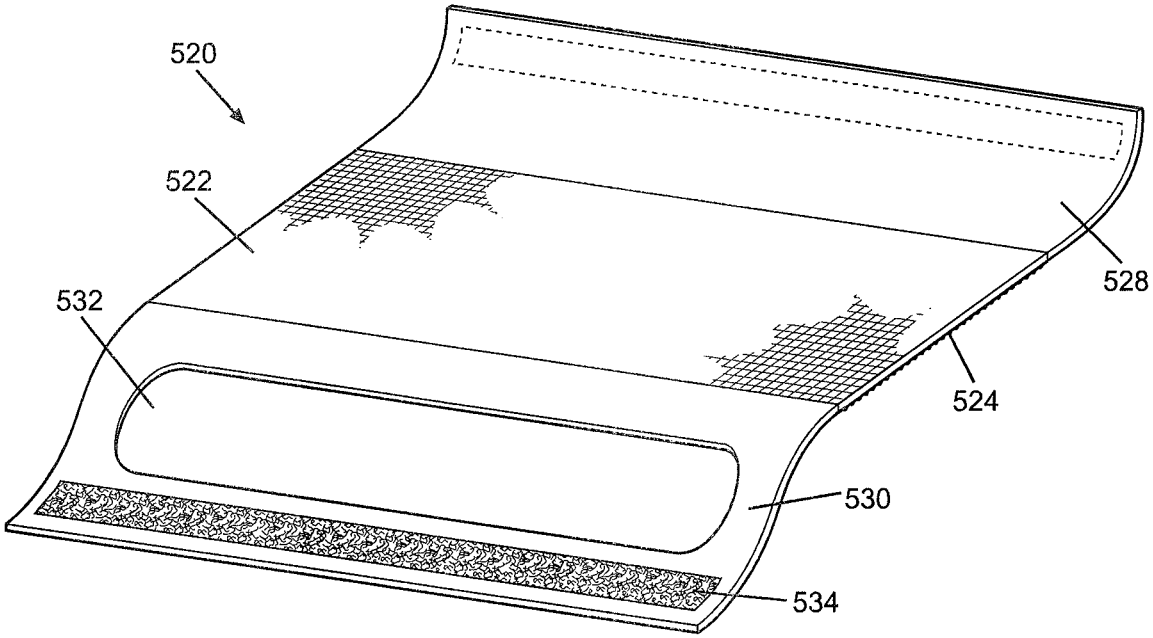
FIG. 154 is an alternative embodiment of the cleaning pad.
Figure 155:
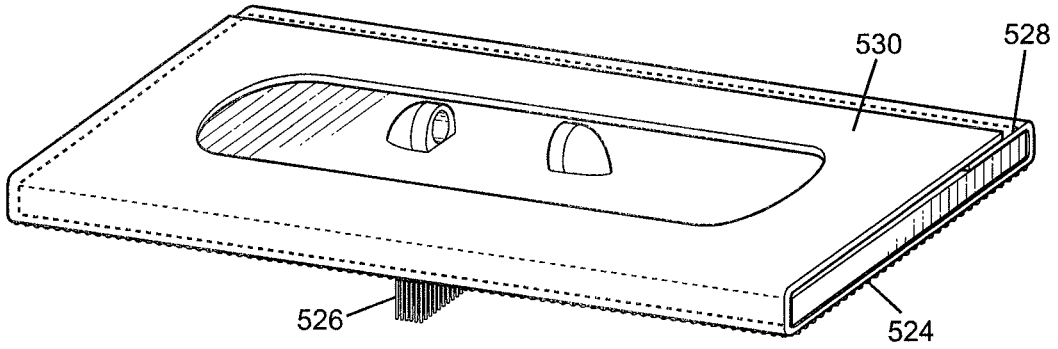
FIGS. 155-157 show various views of the cleaning pad of FIG. 154.
Figure 156:
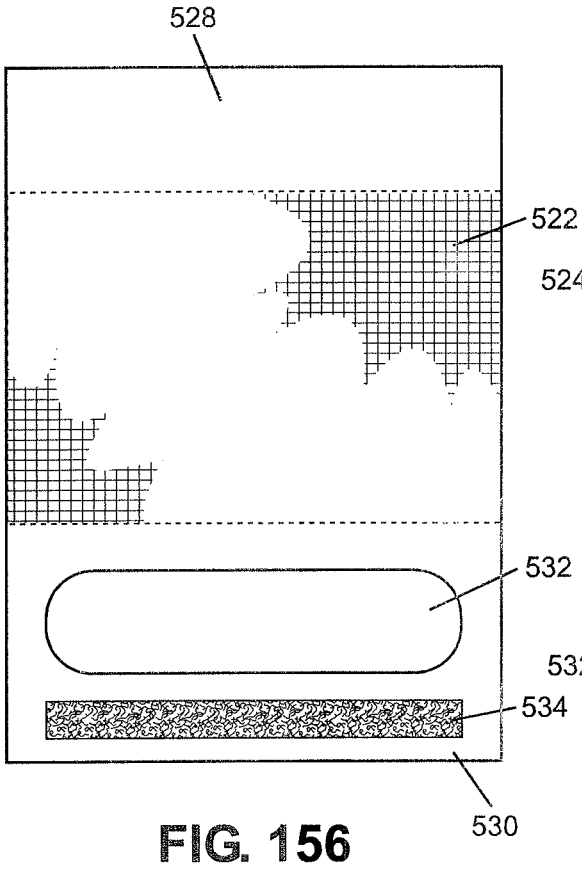
Figure 157:
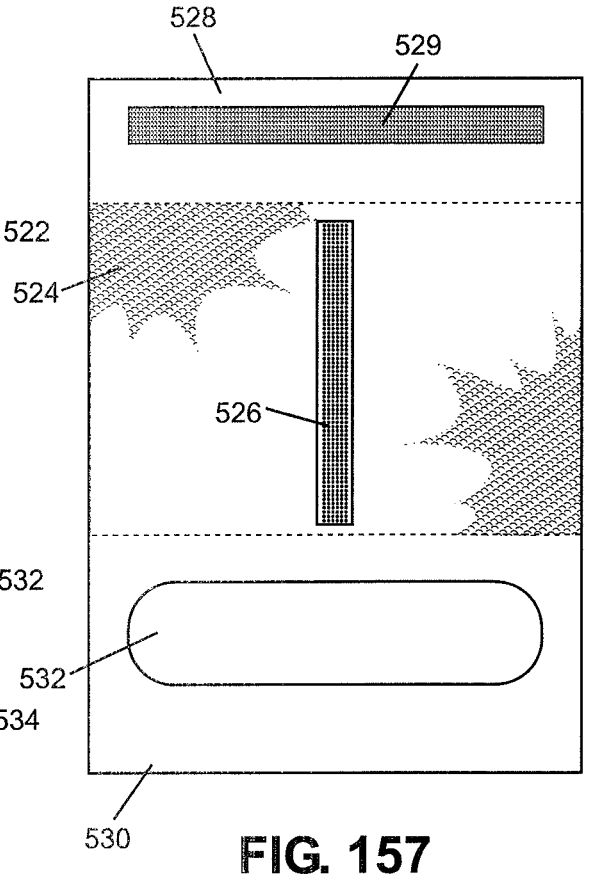

Referring now to FIG. 154, an alternative embodiment of a cleaning pad is shown and generally designated 520. The cleaning pad 520, described in conjunction with FIGS. 155-157, includes a semi-rigid flexible backing 522. Attached to the midpoint of the backing 522 is a plurality of bristles forming a brush 526. On either side of the brush 526 is a cleaning surface 524. This allows the cleaning pad 520 to clean multiple leveled surfaces simultaneously. Located on the opposite surface of the backing 522 are a first retaining strap 528 with hooks 529 and a corresponding second retaining strap 530 with loops 534, wherein both retaining straps 528 and 530 span the entire length of the backing 522, while the hooks 529 and loops 534 span substantially the length of their corresponding retaining straps 528 and 530. The second retaining strap 530 includes a center opening 532 to provide access to handle mounts of the cleaning head. The larger first retaining strap 528 and second retaining strap 530 provides additional surface area contacting the cleaning head, thereby providing a more secure attachment.

Figure 158:
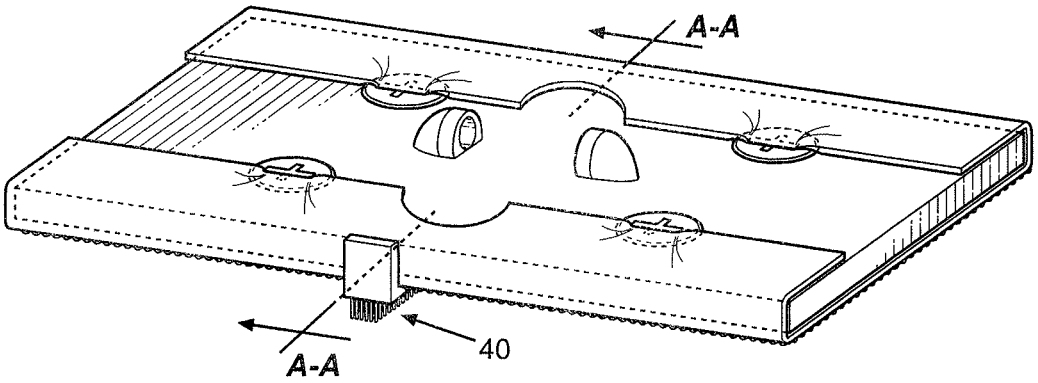
FIG. 158 shows an alternative embodiment of the attachable cleaning brush.

Referring now to FIG. 158, alternative embodiment of a cleaning brush 40 is shown attached to a currently existing a floor cleaning system. The cleaning brush 40 attaches directly to a cleaning pad of currently existing floor cleaning systems and provide guide tabs to center the brush under the floor cleaning system. This allows the use of the cleaning brush 40 with currently existing products to enable the cleaning of multiple leveled surfaces simultaneously.

Figure 159:
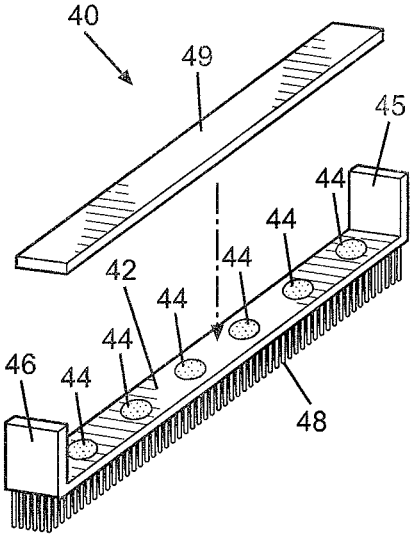
FIGS. 159-162 show various views of the cleaning brush of FIG. 158.
Figure 160:
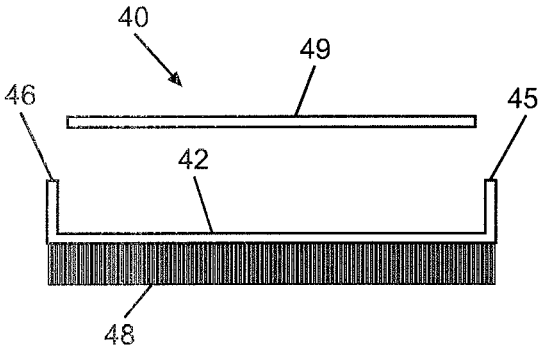

Referring now to FIGS. 159 and 160, the cleaning brush 40 includes a base 42 and a locking tab 49. The base 42 is generally rectangular shaped and includes a first guide tab 45 attached at one end and a second guide tab 46 attached at the opposite end, where both guide tabs point in the same direction. Attached to the base 42 between the first guide tab 45 and the second guide tab 46 are a plurality of magnets 44. Attached to the base 42, opposite the magnets 44, is a plurality of bristles 48. Locking tab 49 may preferably be made of a ferromagnetic material or incorporate ferromagnetic materials to allow magnets 44 to form a coupling.

Figure 161:
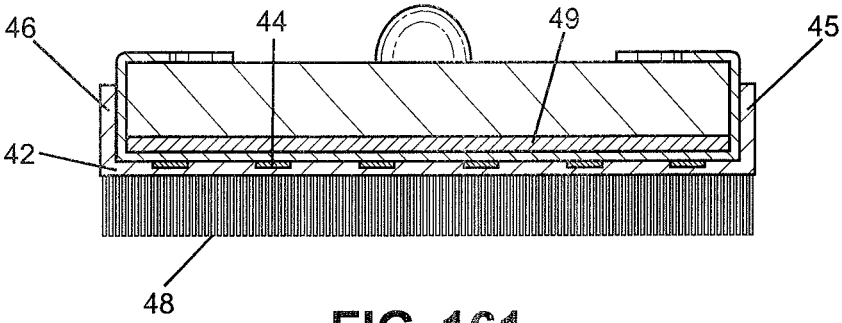

Referring now to FIG. 161, a cross-sectional view of the cleaning brush 40 attached to the cleaning pad and cleaning head taken along line A-A of FIG. 158 is shown. As shown, the brush 40 is attached to the cleaning pad by placing the cleaning pad between the base 42 and the locking tab 49. The locking tab 49 is sized to fit within the footprint of the cleaning head and the base 42 of the brush fits over the cleaning pad, the locking tab 49 and the cleaning head.

The magnetic attraction between the magnets 44 of the base 42 and the locking tab 49 ensures a firm grip on the cleaning pad. The cleaning head is aligned between the first guide tab 45 and second guide tab 46. In addition to providing the correct orientation and placement of the brush 40, the first guide tab 45 and second guide tab 46 serve as barrier to prevent the brush 40 from moving relative to the cleaning pad and cleaning head. The first guide tab 45 and second guide tab 46 prevents the horizontal forces resulting from brushing the brush 40 back and forth to clean.

Figure 162:
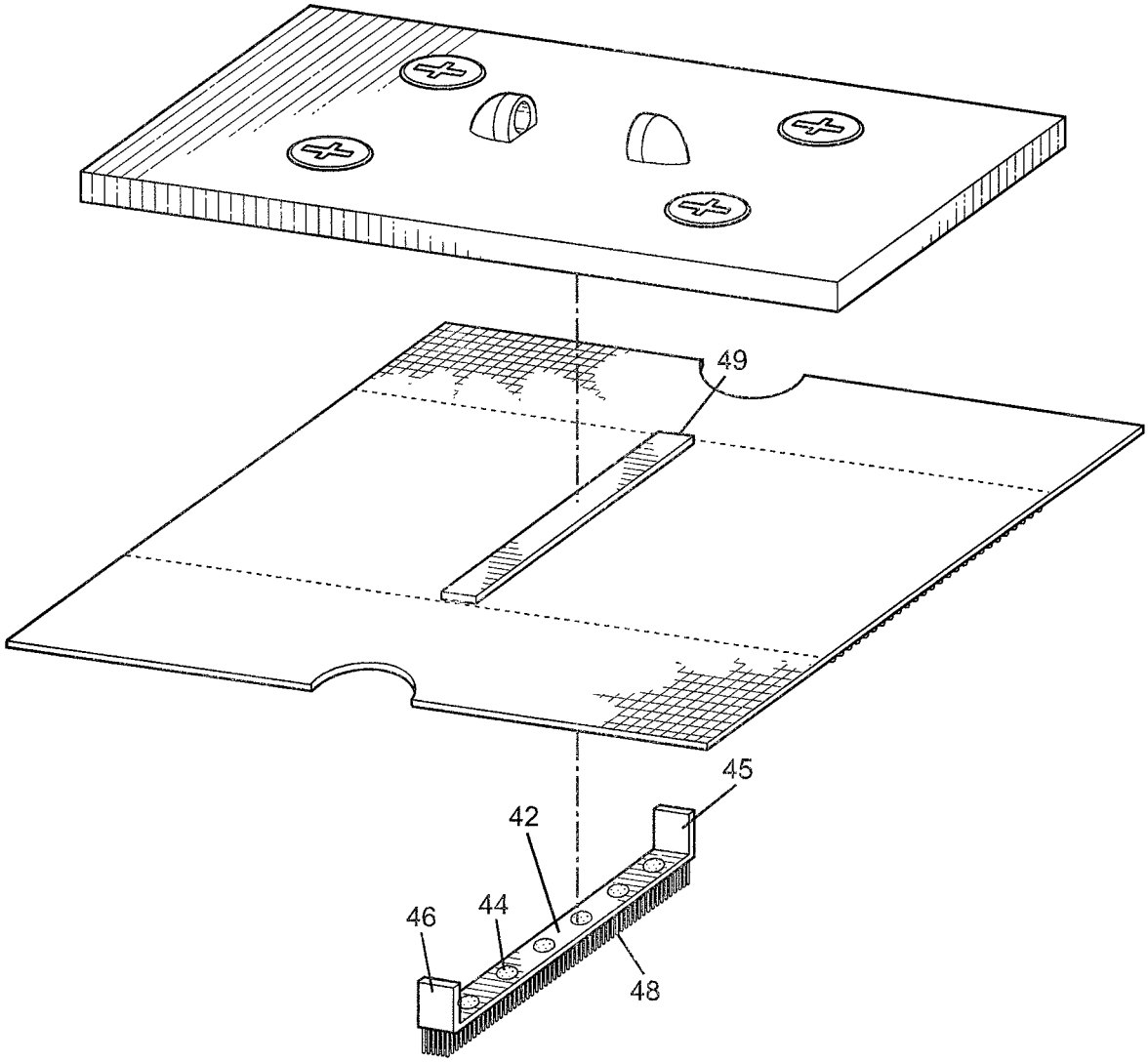

Referring now to FIG. 162, an exploded view of the cleaning system utilizing the cleaning brush 30 is shown. The locking tab 49 is placed on the cleaning pad before the cleaning pad is attached to the cleaning head. By sizing the locking tab 49 to fit within the footprint of the cleaning head, the locking tab 49 does not protrude pass the cleaning head and created sharp obstructions which may damage the cleaning pad; the cleaning pad contacts the smooth perimeter surface of the cleaning head.

While there have been shown what are presently considered to be preferred embodiments of the present invention, it will be apparent to those skilled in the art that various combinations of preferred embodiments, changes and modifications can be made herein without departing from the scope and spirit of the invention.

I claim:

1. A cleaning system for multi-level surfaces, comprising:

a cleaning head with a top surface having a cleaning pad mount and a bottom surface having a cleaning brush mount;

a handle attached to said top surface of said cleaning head;

a cleaning pad comprising:

a backing configured to attach to said cleaning pad mount of said cleaning head, a cleaning surface attached to said backing, a cleaning brush receptacle configured to allow access to said cleaning brush mount of said cleaning head, and wherein said cleaning pad is wrapped around said cleaning head to cover said bottom surface and said backing is removably attached to said cleaning pad mount on said top surface, said cleaning pad providing a first cleaning surface for cleaning a first leveled surface; and a cleaning brush comprising:

a body with a first surface having bristles extending therefrom and a second surface configured to attached to said cleaning brush mount, and wherein said cleaning brush is positioned over said cleaning brush receptacle of said cleaning pad and removably attached to said cleaning brush mount of said cleaning head, said cleaning brush providing a second cleaning surface at a lower depth than said first cleaning surface for cleaning a second leveled surface simultaneously with the cleaning of said first leveled surface.

2. The cleaning system for multi-level surfaces of claim 1, wherein said cleaning brush mount comprises a plurality of mounting holes extending from said top face to said bottom face of said cleaning head and said second surface of said cleaning brush comprises a plurality of fasteners configured to removably attach to said plurality of mounting holes of said cleaning brush mount.

3. The cleaning system for multi-level surface of claim 1, wherein said cleaning pad mount comprises a plurality of grippers.

4. The cleaning system for multi-level surface of claim 1, wherein said cleaning pad mount comprises a plurality of loop fasteners and said backing has a plurality of hook fasteners configured to attach to said loop fasteners.

5. The cleaning system for multi-level surface of claim 1, wherein said brush further comprises a first hook formed at one end of said body and a second hook formed at the opposite end of said body.

* * * * *